US009247828B2

(12) United States Patent
Cvek

(10) Patent No.: US 9,247,828 B2
(45) Date of Patent: Feb. 2, 2016

(54) SMART SEATING CHAIR WITH IC CONTROLS, ELECTRONIC SENSORS, AND WIRED AND WIRELESS DATA AND POWER TRANSFER CAPABILITIES

(76) Inventor: Sava Cvek, Jamaica Plain, MA (US)

( * ) Notice: Subject to any disclaimer, the term of this patent is extended or adjusted under 35 U.S.C. 154(b) by 392 days.

(21) Appl. No.: 13/457,485

(22) Filed: Apr. 26, 2012

(65) Prior Publication Data

US 2013/0113249 A1 May 9, 2013

Related U.S. Application Data

(63) Continuation-in-part of application No. 13/023,540, filed on Feb. 8, 2011, now Pat. No. 8,714,646, and a continuation-in-part of application No. 13/016,958, filed on Jan. 28, 2011, now Pat. No. 8,714,645.

(60) Provisional application No. 61/479,383, filed on Apr. 26, 2011, provisional application No. 61/302,284, filed on Feb. 8, 2010, provisional application No. 61/298,961, filed on Jan. 28, 2010.

(51) Int. Cl.

| | |
|---|---|
| ***A47C 31/00*** | (2006.01) |
| ***A47C 7/44*** | (2006.01) |
| ***A47C 1/024*** | (2006.01) |
| ***A47C 3/026*** | (2006.01) |

(52) U.S. Cl.

CPC ..... *A47C 31/00* (2013.01); *A47C 1/0242* (2013.01); *A47C 3/026* (2013.01); *A47C 7/44* (2013.01); *A47C 7/441* (2013.01); *A47C 7/443* (2013.01)

(58) Field of Classification Search

None

See application file for complete search history.

(56) References Cited

U.S. PATENT DOCUMENTS

| | | | | |
|---|---|---|---|---|
| 5,324,247 | A * | 6/1994 | Lepley | 482/134 |
| 5,864,105 | A * | 1/1999 | Andrews | 200/5 R |
| 6,055,473 | A * | 4/2000 | Zwolinski et al. | 701/49 |
| 6,088,643 | A * | 7/2000 | Long et al. | 701/49 |
| 6,870,477 | B2 * | 3/2005 | Gruteser et al. | 340/573.1 |
| 7,163,263 | B1 * | 1/2007 | Kurrasch et al. | 297/217.3 |
| 7,197,364 | B2 * | 3/2007 | Chernoff et al. | 700/9 |
| 8,596,716 | B1 * | 12/2013 | Caruso | 297/217.3 |
| 8,636,320 | B1 * | 1/2014 | Caruso | 297/217.3 |
| 2002/0082952 | A1 | 6/2002 | Johnston | |
| 2002/0184114 | A1 | 12/2002 | Jorgensen | |
| 2005/0015312 | A1 | 1/2005 | Hoffman et al. | |
| 2005/0017488 | A1 * | 1/2005 | Breed et al. | 280/735 |
| 2005/0046584 | A1 * | 3/2005 | Breed | 340/825.72 |
| 2005/0275554 | A1 * | 12/2005 | Patterson et al. | 340/667 |
| 2009/0088930 | A1 * | 4/2009 | Ohtsubo et al. | 701/49 |
| 2009/0216682 | A1 | 8/2009 | Foladare et al. | |
| 2010/0001567 | A1 * | 1/2010 | Powicki | A47C 1/023 297/301.1 |
| 2010/0198374 | A1 * | 8/2010 | Carson et al. | 700/90 |
| 2011/0055720 | A1 * | 3/2011 | Potter et al. | 715/747 |

(Continued)

*Primary Examiner* — David E Allred

(74) *Attorney, Agent, or Firm* — Thomas P. O'Connell; O'Connell Law Firm

(57) ABSTRACT

A chair with a control mechanism with a base structure, a seat bottom structure supported by the base structure, a seat back structure supported by the base structure, a control mechanism supported by the base structure, a power source and means for electrically coupling the power source to the control mechanism and an electrical port, wireless transmitter, or other electrical communicator for producing electrical communication relative to the control mechanism. The power source can be a portable power source that plugs into the connector of the control mechanism. One or more electrical sensors can be retained relative to the seat bottom or seat back structures and memory can be provided for retaining data from the electrical sensor.

21 Claims, 44 Drawing Sheets

(56) References Cited

U.S. PATENT DOCUMENTS

2012/0086249 A1* 4/2012 Hotary et al. ..... 297/284.3
2014/0265479 A1* 9/2014 Bennett ..... 297/217.4
2014/0319895 A1* 10/2014 Lange-Mao et al. ..... 297/463.1

* cited by examiner

• 1A (A)
•• 3B (B)
••• 23 (AB)
•••• 24 (AB)

| | | |
|---|---|---|
| • | 1 A | 1 A' |
| •• | 2 A | 3 A" |
| ••• | 23 AB | 13 A'A" |
| •••• | 24 AB | 24 A'A" |

SMART SEATING CHAIR WITH IC CONTROLS, ELECTRONIC SENSORS, AND WIRED AND WIRELESS DATA AND POWER TRANSFER CAPABILITIES

FIELD OF THE INVENTION

The present invention relates generally to mobile task chairs. More particularly, disclosed herein is a smart seating chair with integrated circuit (IC) controls, electronic sensors, and wired and wireless data and power transfer capabilities.

BACKGROUND OF THE INVENTION

The prior art has disclosed numerous mobile task chairs for providing seated support to persons in office, academic, and other occupational environments. While the task chairs of the prior art have varied widely in their features, quality, and intended purposes, they are normally united in certain basic structures. A typical mobile task chair has a seat portion, a back portion retained in an upstanding relationship relative to the seat portion, and a means for supporting the seat and back portions for movement over a support surface. The means for supporting the seat and back portions often comprises an extendable and retractable central support together with a base that retains a plurality of caster wheels. Task chairs can additionally include arms, head and lumbar supports, and still further features designed to improve the comfort and functionality of the chair.

Providing task chairs capable of adapting to the needs and desires of a broad spectrum of individuals has been a recognized need in the art. Mobile task chairs seek to accommodate occupants of different heights, weights, and body types, to be adaptable to different types of tasks, and to permit adjustment to suit each individual's preferences. Providing a task chair capable of achieving comfortable, ergonomically sound support to a wide variety of individuals can be critical not only to worker productivity but also to avoiding the deleterious health effects of poor seating support.

Accordingly, mobile task chairs commonly can be adjusted in height relative to a support surface to accommodate different users and applications. Additionally, certain task chairs permit an adjustment of the reclining resistance exhibited by the back portion to adjust to different users, to different preferences, and to different tasks. When tilting is not desired, such as during a meeting, the back portions of many mobile task chairs can be locked against pivoting. Still further, certain chairs permit the depth of the seat portion to be adjusted. With this, the knowledgeable user can adjust his or her chair selectively for ideal comfort and ergonomically sound support.

However, adjustment mechanisms on mobile task chairs are typically disposed out of the way under the chair bottom such that they are difficult to locate. Even when located, the purpose of the adjustment mechanism is often not readily obvious, particularly when the seat occupant is merely feeling around below the seat to find a given adjustment capability. Even where the seat occupant is aware of the location and purpose of the adjustment mechanism, he or she normally has no basis to understand what setting is currently active, such as whether the back portion is already exhibiting maximum resistance or whether the seat portion has already been slid as forwardly as possible. Still further, many chair adjustment mechanisms, including in particular pivoting resistance adjustment mechanisms, require laborious turning of adjustment handles to achieve any perceptible difference in chair performance.

While these problems are common to nearly all task chair users, they are accentuated in conference rooms and similar situations where the seat occupant is unfamiliar with the chair and where multiple different occupants will occupy the same chair over time. Consequently, many seat occupants simply forego attempting to adjust some or all of the chair settings so that they sit in discomfort and ergonomically unsound positions. They live with the original factory settings or the settings suitable to the body and preferences of another seat occupant.

SUMMARY OF THE INVENTION

Based on the state of the art as summarized above, the present inventor set forth with the basic object of providing a mobile task chair control mechanism that provides visual indications of control mechanism functionalities and current task chair settings.

An underlying object of embodiments of the invention is to provide a task chair control mechanism that renders the proper adjustment of task chair performance characteristics more convenient and accessible.

A further object of certain embodiments of the invention is to provide a task chair control mechanism that provides both gross and fine adjustment of pivoting resistance with a visual indication of the adjustment setting.

In certain embodiments, still another object of the invention is to provide a task chair control mechanism that enables a partially or completely automated adjustment of chair settings.

These and in all likelihood further objects and advantages of the present invention will become obvious not only to one who reviews the present specification and drawings but also to those who have an opportunity to experience an embodiment of the smart seating chair disclosed herein. However, it will be appreciated that, although the accomplishment of each of the foregoing objects in a single embodiment of the invention may be possible and indeed preferred, not all embodiments will seek or need to accomplish each and every potential advantage and function. Nonetheless, all such embodiments should be considered within the scope of the present invention.

One will appreciate that the foregoing discussion broadly outlines the more important goals and features of the invention to enable a better understanding of the detailed description that follows and to instill a better appreciation of the inventor's contribution to the art. Before any particular embodiment or aspect thereof is explained in detail, it must be made clear that the following details of construction and illustrations of inventive concepts are mere examples of the many possible manifestations of the invention.

DETAILED DESCRIPTION OF PREFERRED EMBODIMENTS

The smart seating chair disclosed herein is subject to a wide variety of embodiments. However, to ensure that one skilled in the art will be able to understand and, in appropriate cases, practice the present invention, certain preferred embodiments of the broader invention revealed herein are described below and shown in the accompanying drawing figures. Therefore, before any particular embodiment of the invention is explained in detail, it must be made clear that the following details of construction and illustrations of inventive concepts are mere examples of the many possible manifestations of the invention.

Figure 1:
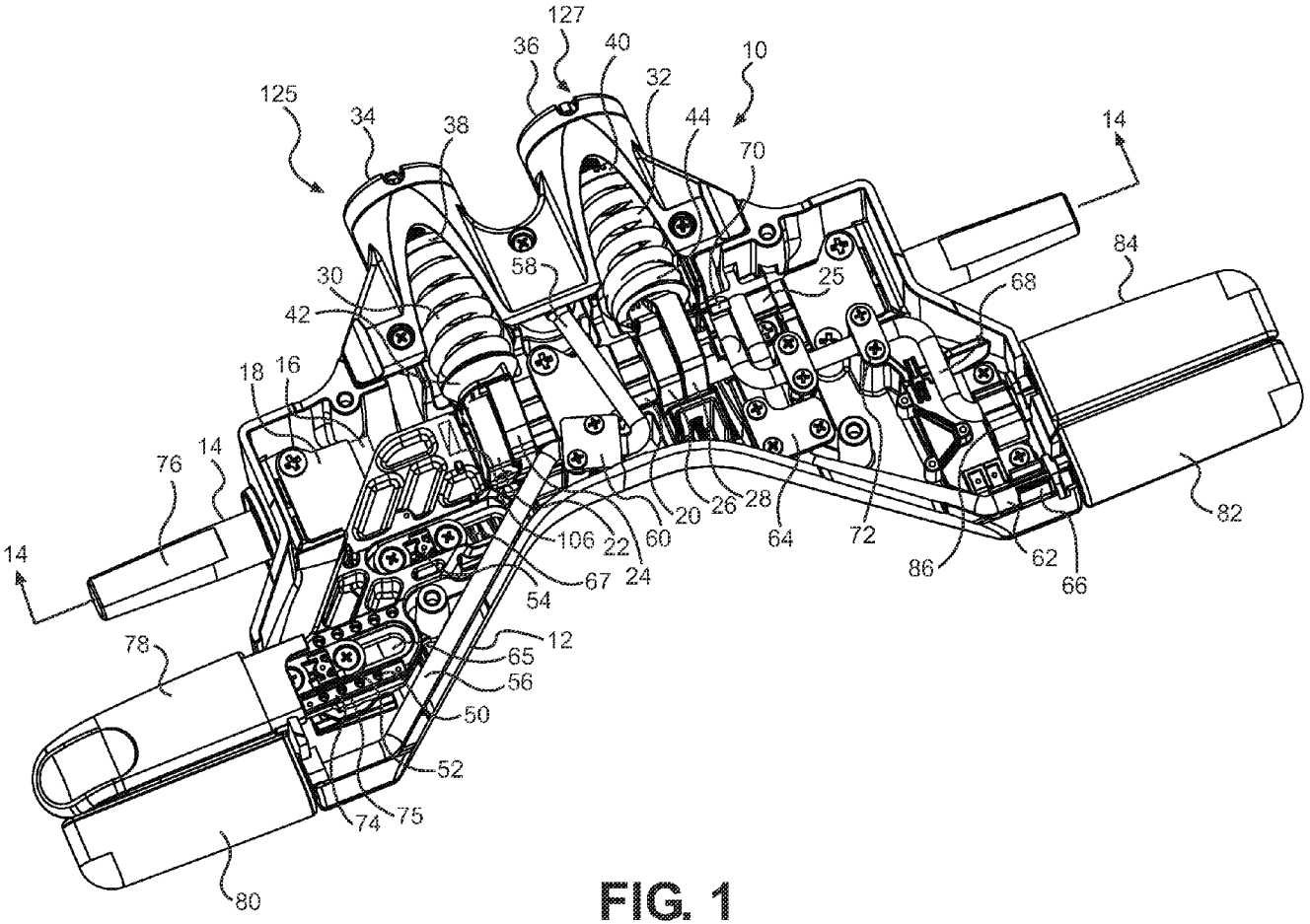
FIG. 1 is a perspective view of a pivoting mechanism with adjustment mechanisms according to the present invention.

Turning more particularly to the drawings, an embodiment of a chair control mechanism with which visual setting indicators pursuant to the present invention can be employed is indicated generally at 10 in FIG. 1. The chair control mechanism 10 is founded on a housing 12. The housing 12 has an upper rim and a contoured base portion for receiving and retaining various components of the chair control mechanism 10 as described and shown herein. The housing 12 has an anterior, a posterior, and left and right sides.

Figure 2:
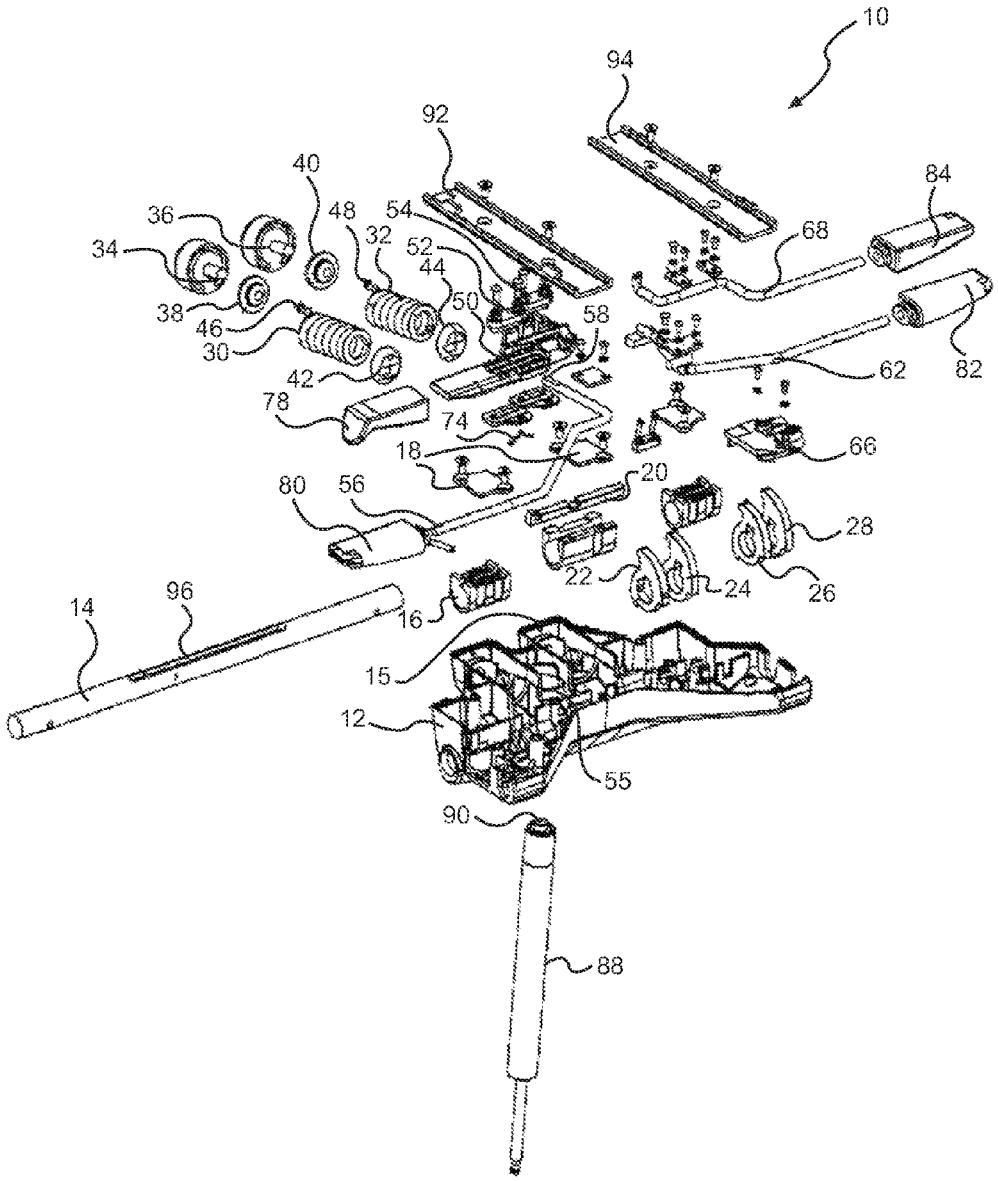
FIG. 2 is an exploded perspective view of the pivoting mechanism of FIG. 1.

An elongate shaft 14 has a round body portion that traverses laterally across the housing 12 and first and second end portions that project outboard of the first and second sides of the housing 12. The shaft 14 is supported by low friction shaft bushings 16 that are retained in place by molded or otherwise formed brackets 15, which are shown in FIG. 2, and the shaft 14 is secured in place by bushing plates 18 that overly the shaft 14 in combination with fasteners 17 that are threadedly engaged or otherwise secured relative to the housing 12. With this, the elongate shaft 14 is retained to turn within the housing 12, and the first and second outboard end portions of the shaft 14 form an output interface of the chair control mechanism 10.

Figure 3:
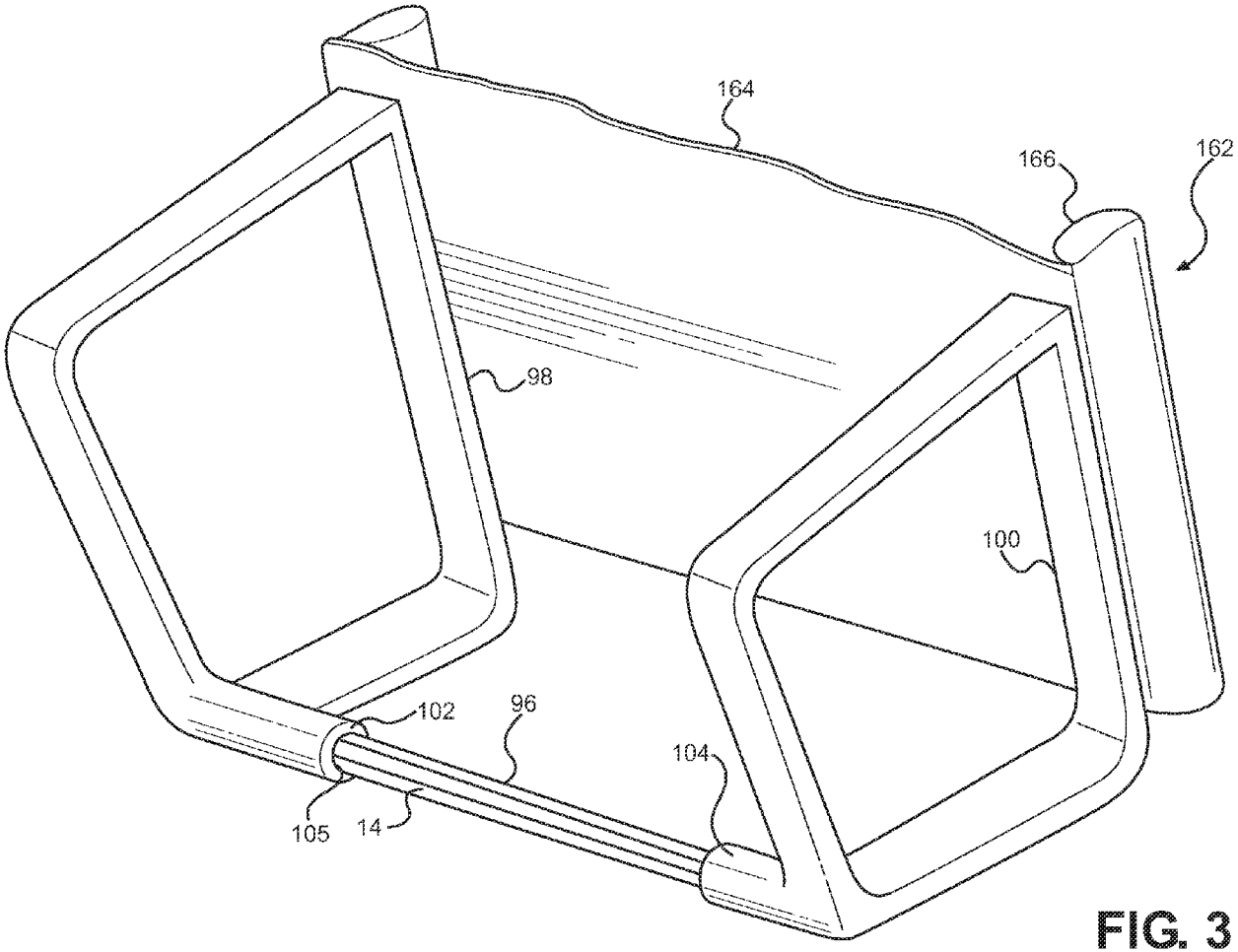
FIG. 3 a perspective view of a pivoting shaft retaining left and right armrests pursuant to the invention.
Figure 13:
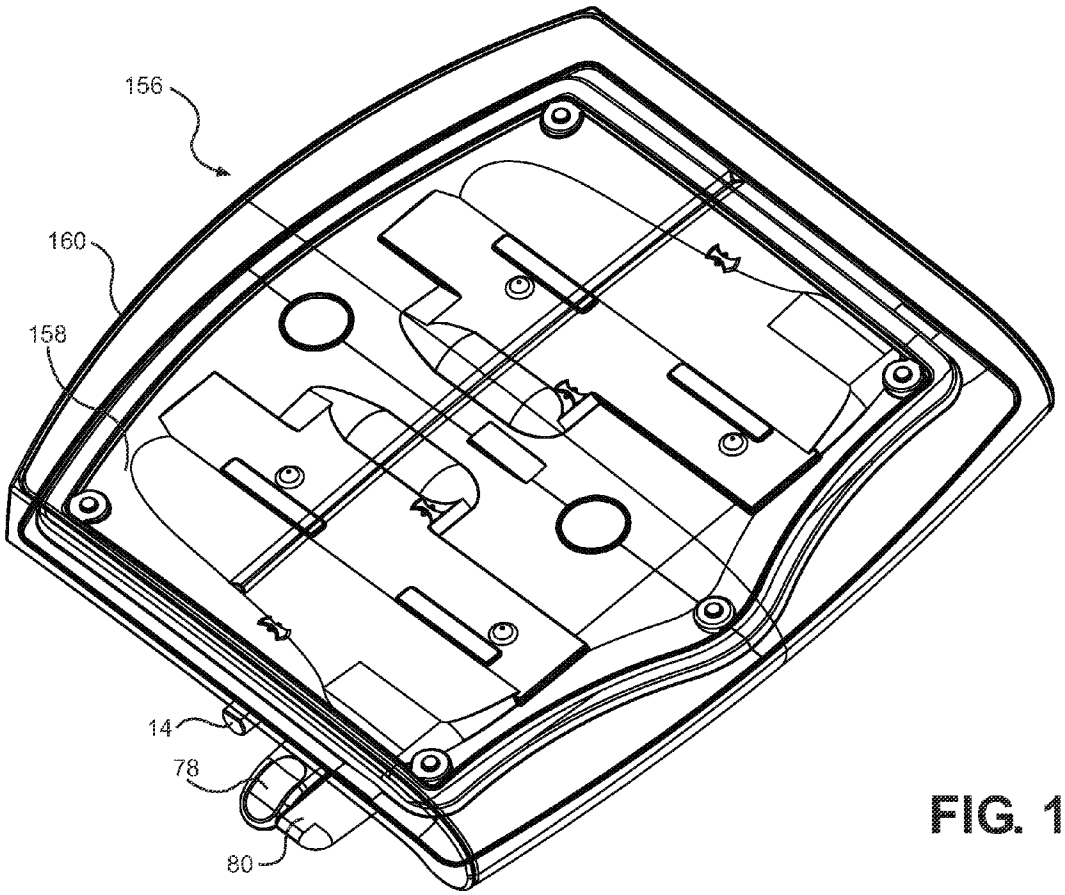
FIG. 13 is a perspective view of the pivoting mechanism of FIG. 1 with a seat secured in place.

The output interface can be better understood with additional reference to FIG. 3. There, it can be seen that the first and second end portions of the shaft 14 are retained to pivot with right and left arm structures 98 and 100 by being received into and fixed in relation to sleeves 102 and 104 of the left and right arm structures 98 and 100 respectively. In practice, the arm structures 98 and 100 retain a back structure 162. The pivoting mechanism 10 supports and retains a seat structure 156 as shown in FIG. 13. The seat and back structures 156 and 162 could be of any type pursuant to the prior art or otherwise, except as they might be expressly limited herein. In the depicted example, the back structure 162 comprises one or more layers of resilient material 164 retained by a framework 166.

The first and second end portions of the shaft 14 could be fixed in relation to the sleeves 98 and 100 in any appropriate manner, such as by welding, mechanical fasteners, adhesive, mechanical engagement, or any other effective arrangement or combination thereof. In the present embodiment, a mechanical engagement between the first and second end portions of the shaft 14 and the sleeves 98 and 100 is achieved by forming each of the first and second end portions of the shaft with a flat chamfer 76 that engages a matingly shaped inner wall 105 of the sleeves 98 and 100.

Looking additionally to FIG. 2, the housing 12 has an aperture 55 in the central portion thereof for receiving an upper portion of a hydraulic cylinder 88. The hydraulic cylinder 88 has an actuation tip 90 at the upper end thereof for permitting a selective extension and retraction of the hydraulic cylinder 88. A pivotable height adjustment lever 56 has a tip 58 at a first end thereof that is retained above the aperture 55. The height adjustment lever 56 has a second end that projects outboard of the right side of the housing 12. A handle 80 is fixed to the second end of the height adjustment lever 56. Under this arrangement, a user can actuate the height adjustment lever 56 by operation of the handle 80 to induce the tip 58 of the lever 56 to engage the actuation tip 90 of the hydraulic cylinder 88 to raise or lower the seat structure 156 and the remainder of the chair selectively.

Figure 12:
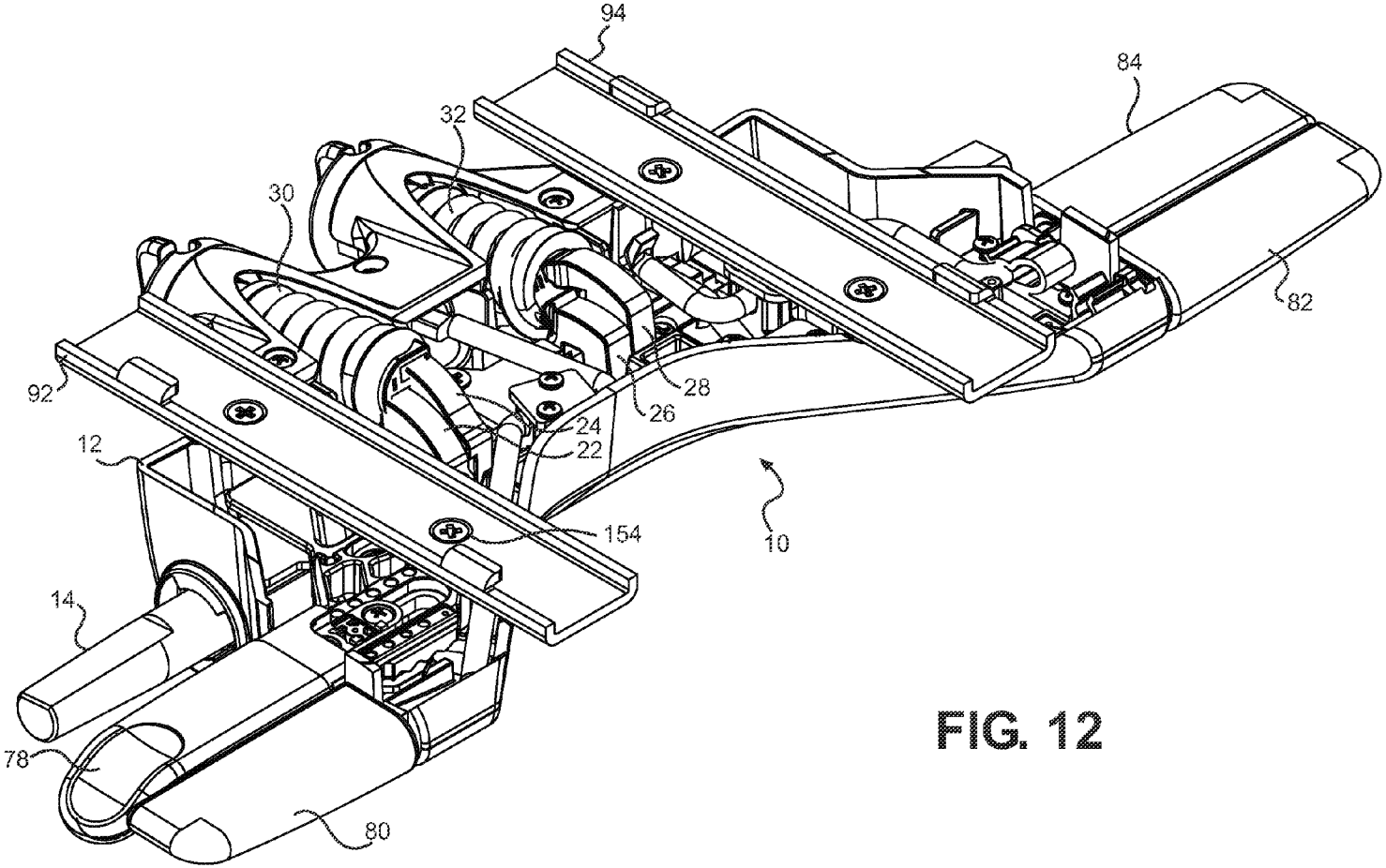
FIG. 12 is a perspective view of the pivoting mechanism of FIG. 1 with left and right slider brackets secured in place.

Left and right slider brackets 92 and 94 are secured to the housing 12 in a parallel relationship perpendicularly to the shaft 14 by fasteners 154 as is shown in FIG. 12. In this preferred embodiment, the left and right slider brackets 92 and 94 retain the seat structure 156 by a selectively slidable relationship between the brackets 92 and 94 and a base shell 158 of the seat structure 156. The base shell 158 retains a cushion arrangement 160. A seat slide lock lever 68 has a tip 70 at a first end thereof for engaging recesses that are fixed to move with the base shell 158 of the seat structure 156. The body portion of the seat slide lock lever 68 is pivotable by actuation of a handle 84 that is fixed to a second end of the seat slide lock lever 68. The handle 84 projects outboard of the left side of the housing 12. So arranged, the seat slide lock lever 68 can be pivoted by operation of the handle 84 to induce the tip 70 into and out of locking engagement with the seat structure 156. With this, the seat structure 156 can be selectively slid forwardly and rearwardly to a desired position and then locked in place.

Looking again to FIG. 1, a rebound spring clip 86, which could be formed from spring steel, resilient plastic, or any other material or combination thereof, is secured relative to the housing 12 and receives the seat slide lock lever 68. The rebound spring clip 86 has first and second resiliently engaged sides with first and second broadened portions therebetween. With this, the seat slide lock lever 68 can be positioned and retained by the clip 86 in a first position locking the seat structure 156 against movement and repositioned and retained by the clip 86 in a second position permitting sliding movement of the seat structure 156.

Under the depicted arrangement, the seat structure 156 is retained relative to the housing 12 via the left and right slider brackets 92 and 94, and the left and right arm structures 98 and 100 with the retained back structure 162 are retained relative to the housing 12 through the first and second end portions of the shaft 14 as seen in FIG. 3. With the arm structures 98 and 100 and the back structure 162 fixed to the shaft 14, the shaft 14 will turn within the housing 12 as the arm structures 98 and 100 and the back structure 162 pivot relative to the seat structure 156. The back structure 162 and the seat structure 156 are thus pivotally retained relative to one another to enable a seat occupant to sit in a fully upright manner, to recline to a given angle, or to be disposed anywhere therebetween.

Figure 19:
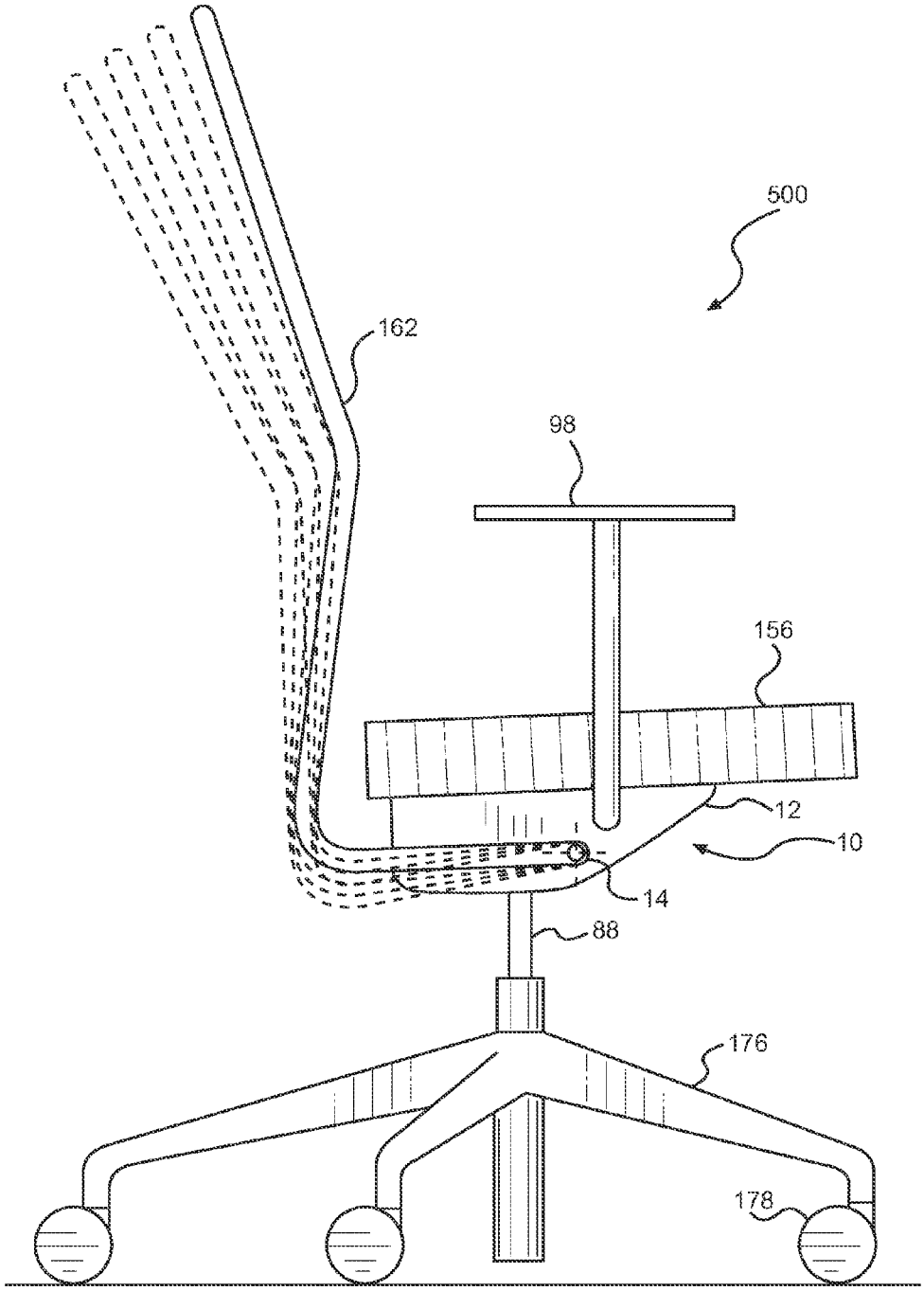
FIG. 19 is a view in side elevation of a chair incorporating a pivoting mechanism according to the present invention.

A complete chair 500 employing a pivoting mechanism 10 as taught herein is illustrated in FIG. 19. There, a seat structure 156 is secured atop the housing 12 of the pivoting mechanism 10, and arm structures 98 are secured to the outboard sides of the housing 12. A back structure 162 is pivotally retained by the pivoting mechanism 10 by the outboard ends of the shaft 14. The pivoting mechanism 10, and derivatively the seat and back structures 156 and 162, is supported by a base structure including piston 88 to permit a raising and lowering of the pivoting mechanism 10 and the seat and back structures 156 and 162. The lower end of the piston 88 is retained by a star chair base 176, and the chair 500 is rendered mobile by casters 178 retained at the distal ends of the legs of the star chair base 176. Under this arrangement, the seat and back structures 156 and 162 can be raised and lowered at the discretion of the occupant of the chair 500. The seat back structure 162 pivots independently of the seat bottom 156 whereby the seat back structure 162 can pivot rearwardly while the seat structure 156 remains stationary.

Adjustable resistance to the pivoting of the arm structures 98 and 100 and the back structure 162 relative to the seat structure 156 is provided by the pivoting mechanism 10, which is founded on the shaft 14. As seen, for example, in FIGS. 2 and 3, the shaft 14 has a channel 96 that communicates longitudinally along a central portion of the shaft 14. In this embodiment, the channel 96 is disposed facing upwardly, but it could be differently disposed.

A locking slide bar 20 is slidably received into the channel 96. In this embodiment, the locking slide bar 20 has a generally square or rectangular body portion 108, and the channel 96 has a squared base portion sized and shaped to receive the slide bar 20 in close mechanical engagement. Shown apart in FIG. 4, the locking slide 20 has a projecting tooth 112 at a first end thereof and a laterally disposed retaining channel 114 beside the tooth 112.

A resistance adjustment arm 50 is retained for longitudinal, sliding movement relative to the housing 12 by first and second slide blocks 52 and 54. The slide blocks 52 and 54 are fixed to the housing 12 and are received in corresponding slide channels 65 and 67 in the resistance adjustment arm 50. The blocks 52 and 54 provide bearing contact surfaces for the resistance adjustment arm 50 thereby providing a sliding movement aligned with the channel 96 and the retained slide bar 20.

The resistance adjustment arm 50 has a rectangular aperture 106 at a first end thereof that corresponds in size and shape to the size and shape of the tooth 112 of the locking slide bar 20, and the resistance adjustment arm 50 has a portion distal to the aperture 106 sized to be received into the retaining channel 114. Consequently, the tooth 112 can be received into the aperture 106 and the distal portion of the arm 50 can be received into the retaining channel 114 to cause the locking slide 20 to slide in response to a sliding of the resistance adjustment arm 50 within the channel 96. A handle 78 fixed to a second end of the resistance adjustment arm 50 projecting outboard of the right side of the housing 12 can thus be employed to slide the locking slide 20 within the channel 96.

As shown in FIG. 1, a bowed spring 74 can be retained relative to the housing 12 to ride over a plurality of ridges 75 on the resistance adjustment arm 50. The resistance adjustment arm 50 can thus be retained against inadvertent movement from a given position whereby the locking slide 20 can be retained in any one of a plurality of longitudinal positions in the channel 96. It will be appreciated that the spring 74 and the ridges 75 could be oppositely disposed and that numerous other means for selectively retaining the locking slide 20 in multiple longitudinal positions in the channel 96 would be possible and well within the scope of the invention.

Figure 5:
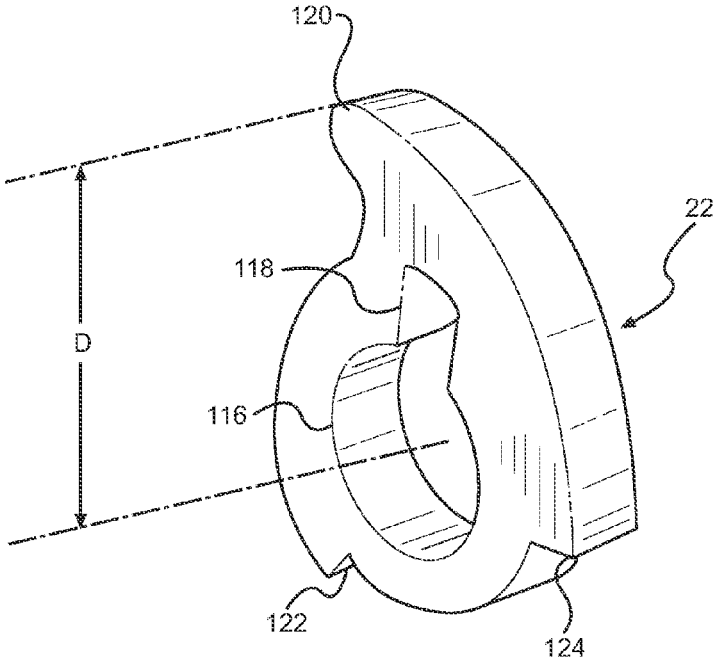
FIG. 5 is a perspective view a pivoting cam as taught herein.

As is shown in relation to a first cam 22 in FIG. 5, each of first, second, third, and fourth cams 22, 24, 26, and 28 has a round aperture 116 therein for receiving the shaft 14. The aperture 116 has a diameter marginally larger than the diameter of the shaft 14 whereby the cams 22, 24, 26, and 28 share a common center and axis of rotation with the shaft 14. Each cam 22, 24, 26, and 28 additionally has a lateral key channel 118 contiguous with the aperture 116 that corresponds in size and shape to that of the protruding portion of the locking slide 20. Accordingly, when the locking slide 20 is engaged with the key channel 118 of one or more cams 22, 24, 26, or 28, the cam or cams 22, 24, 26, and 28 is keyed or locked by the locking slide 20 to pivot with the shaft 14.

Figure 7:
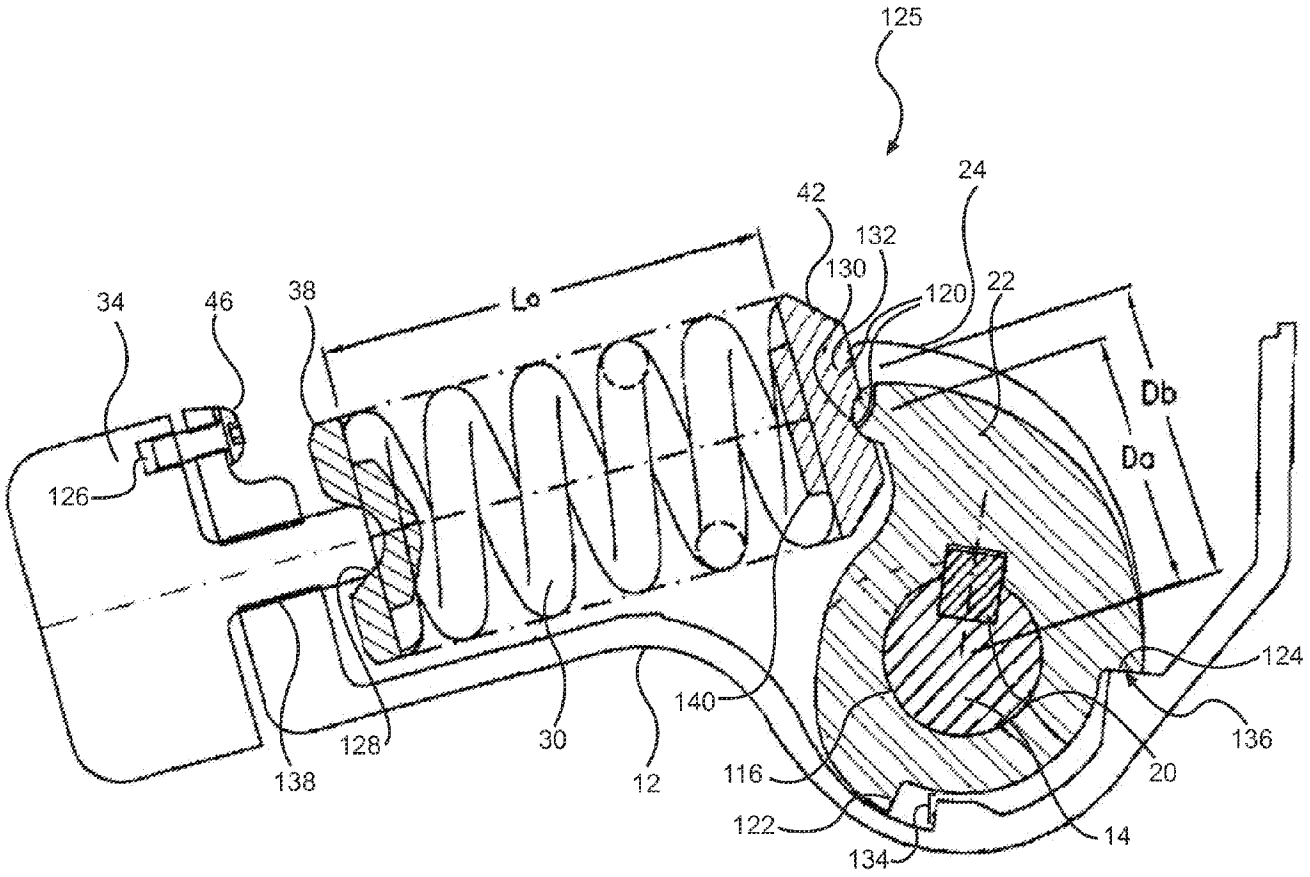
FIG. 7 is a partially sectioned view in side elevation of the pivoting mechanism of FIG. 1 in a first configuration.

As shown in FIG. 7, each cam 22, 24, 26, and 28 has a recline stop shoulder 122 and an oppositely facing upright stop shoulder 124. The stop shoulders 122 and 124 communicate generally radially from the center of the aperture 116 and are spaced by a given angular degree. The housing 12 has a recline stop shoulder 134 and an oppositely facing upright stop shoulder 136. The stop shoulders 134 and 136 communicate generally along a radius relative to the center of the aperture 116 and are spaced by an angular degree less than the separation between the stop shoulders 122 and 124 of the cams 22, 24, 26, and 28. The stop shoulders 122, 124, 134, and 136 thus permit the shaft 14 and the retained arm and back structures 98, 100, and 162 to pivot between a first, upright position where the upright stop shoulders 124 and 136 make contact to prevent further pivoting and a second, reclined position where the recline stop shoulders 122 and 134 make contact to prevent further pivoting.

Figure 4:
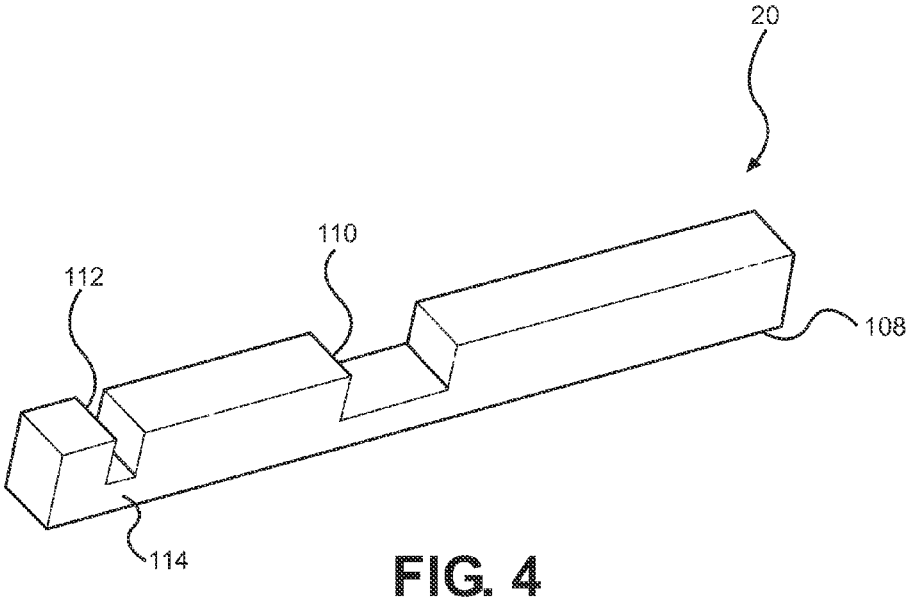
FIG. 4 is a perspective view of a locking slide pursuant to the invention disclosed herein.

As best seen in FIG. 4, a laterally disposed cam channel 110 is disposed in a mid-portion of the body portion 108 of the locking slide 20 between the retaining channel and the second end of the locking slide 20. The cam channel 110 is wider than the cams 22, 24, 26, and 28. Consequently, when the cam channel 110 is aligned with a given cam 22, 24, 26, or 28, that cam 22, 24, 26, or 28 will not be keyed to pivot with the shaft 14. Each cam 22, 24, 26, and 28 will also be freed from pivoting with the shaft 14 where the locking slide 20 is moved beyond the respective cam 22, 24, 26, or 28 by operation of the resistance adjustment arm 50. It would also be possible for multiple cam channels 110 to be provided or for the cam channel 110 to be wide enough to permit passage of more than one cam 22, 24, 26, and 28 simultaneously.

Each cam 22, 24, 26, and 28 has a lobe with an arcuate tip 120 spaced a given distance D from the center of the aperture 116. The distance D of the second cam 24 is greater than the distance D for the first cam 22, and the distance D of the fourth cam 28 is greater than the distance D of the third cam 26. The first and third cams 22 and 26 may have the same or different distances D, and the second and fourth cams 24 and 28 may have the same or different distances D.

Figure 6:
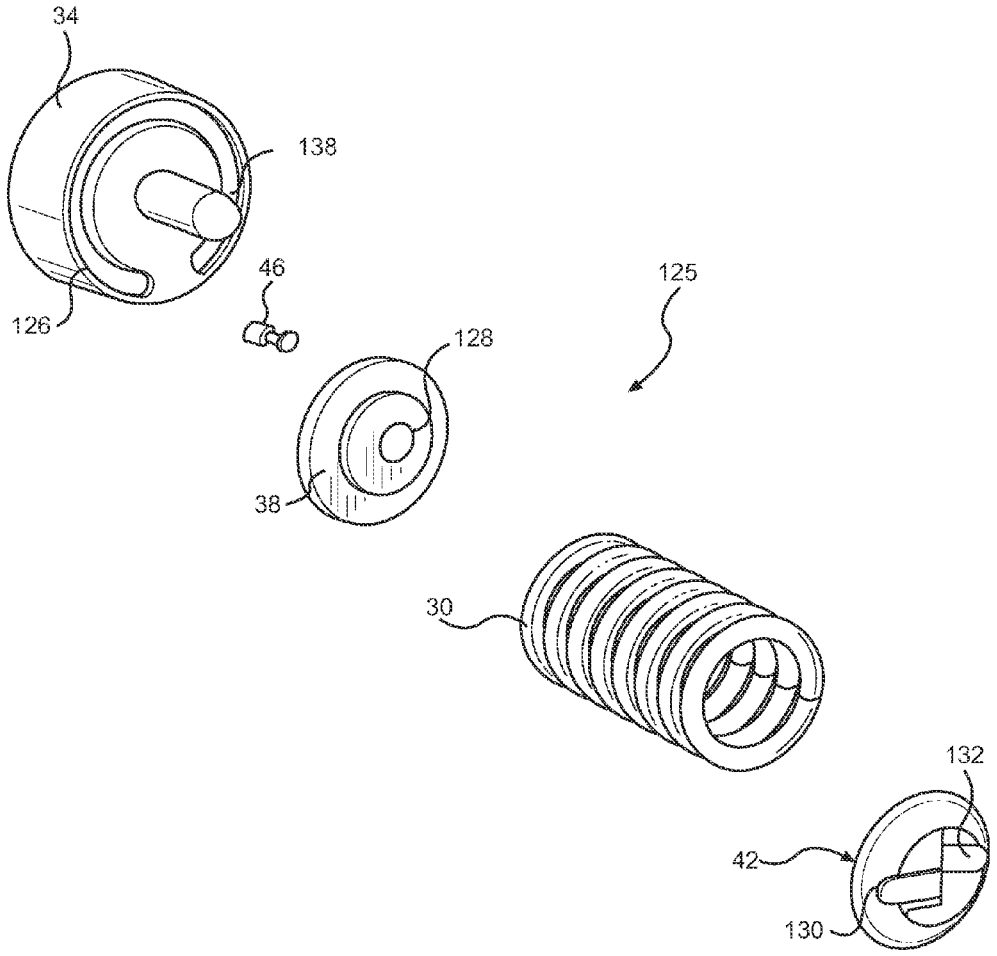
FIG. 6 is an exploded perspective view of a spring arrangement under the instant invention.

The tips 120 of the cams 22 and 24 contact a cam end spring cap 42 of a first spring arrangement 125, which is shown apart in FIG. 6. The tips 120 of the cams 26 and 28 contact a spring cap 44 of a second spring arrangement 127. Each of the caps 42 and 44 has an outer surface with an arcuate proximal receiving groove 130 and an arcuate distal receiving groove 132 that is staggered from the proximal receiving groove 130, preferably by the difference between the distances D of the cams 22 and 24 and 26 and 28. With reference to FIG. 7, each of the spring caps 42 and 44 has an annular retaining protuberance 140 that is received into and retains a first end of the respective springs 30 and 32.

Adjustment end spring caps 38 and 40 are disposed to a second end of the respective springs 30 and 32. Each spring cap 38 and 40 has a central conical protuberance 128 that is received into and retains a second end of the respective spring 30 and 32. The central conical protuberances 128 have a hemispherical underside surface into which the tip of an extension and retraction rod 138 is received. The rod 138 is extendable and retractable, which could be accomplished by a number of different means within the scope of the invention. In the depicted embodiment, the extension and retraction rod 138 is threadedly engaged with the housing 12 and can be selectively rotated by an adjustment knob 34 relative to the first spring arrangement 125 and by an adjustment knob 36 relative to the second spring arrangement 127. Under this arrangement, the adjustment knobs 34 and 36 can be rotated to extend and retract the rod 138 and thereby to tend to compress or decompress the spring 30 or 32. With that, the initial deflection of the springs 30 and 32, and consequently the resistance provided, can be adjusted by a rotation of the knobs 34 and 36.

Where necessary or desirable, a means can be provided for limiting rotation of the knobs 34 and 36 to control the limits of the extension and refraction of the rod 138 and, as a result, the initial compression of the springs 30 and 32. In the present embodiment, the rotation of the knobs 34 and 36 is limited by a knob stop 46 fixed to the housing 12 that is received into an annular adjustment channel 126 that traverses less than the entire inner surface of the knobs 34 and 36 so that it has first and second ends. The knob stop 46 and the channel 126 thus prevent the springs 30 and 32 from being over tightened and prevent the rods 138 from being rotated out of engagement with the housing 12.

Figure 10:
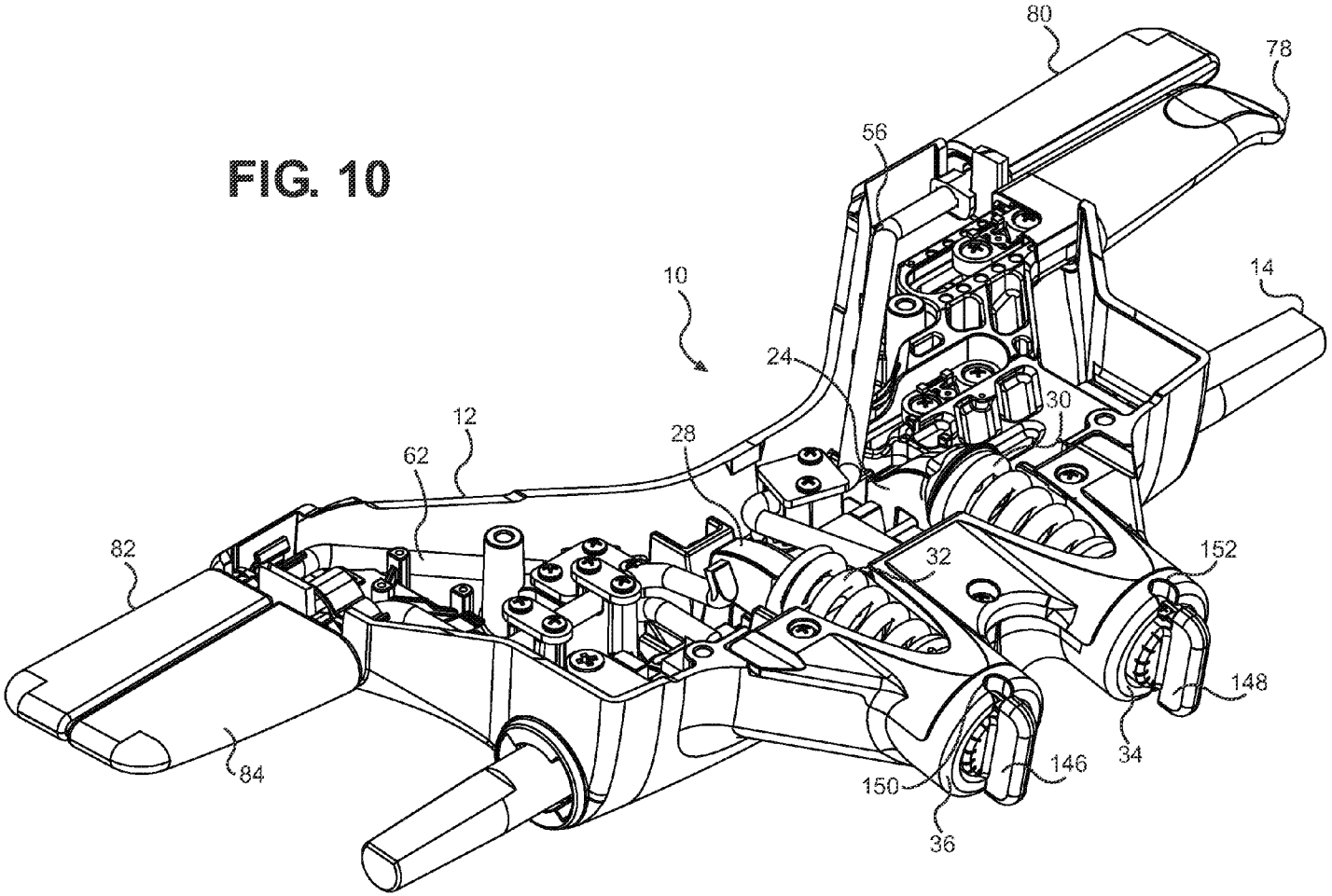
FIG. 10 is a rearward perspective view of the pivoting mechanism of FIG. 1 with the fine tension adjustment handles in an outwardly facing disposition.
Figure 11:
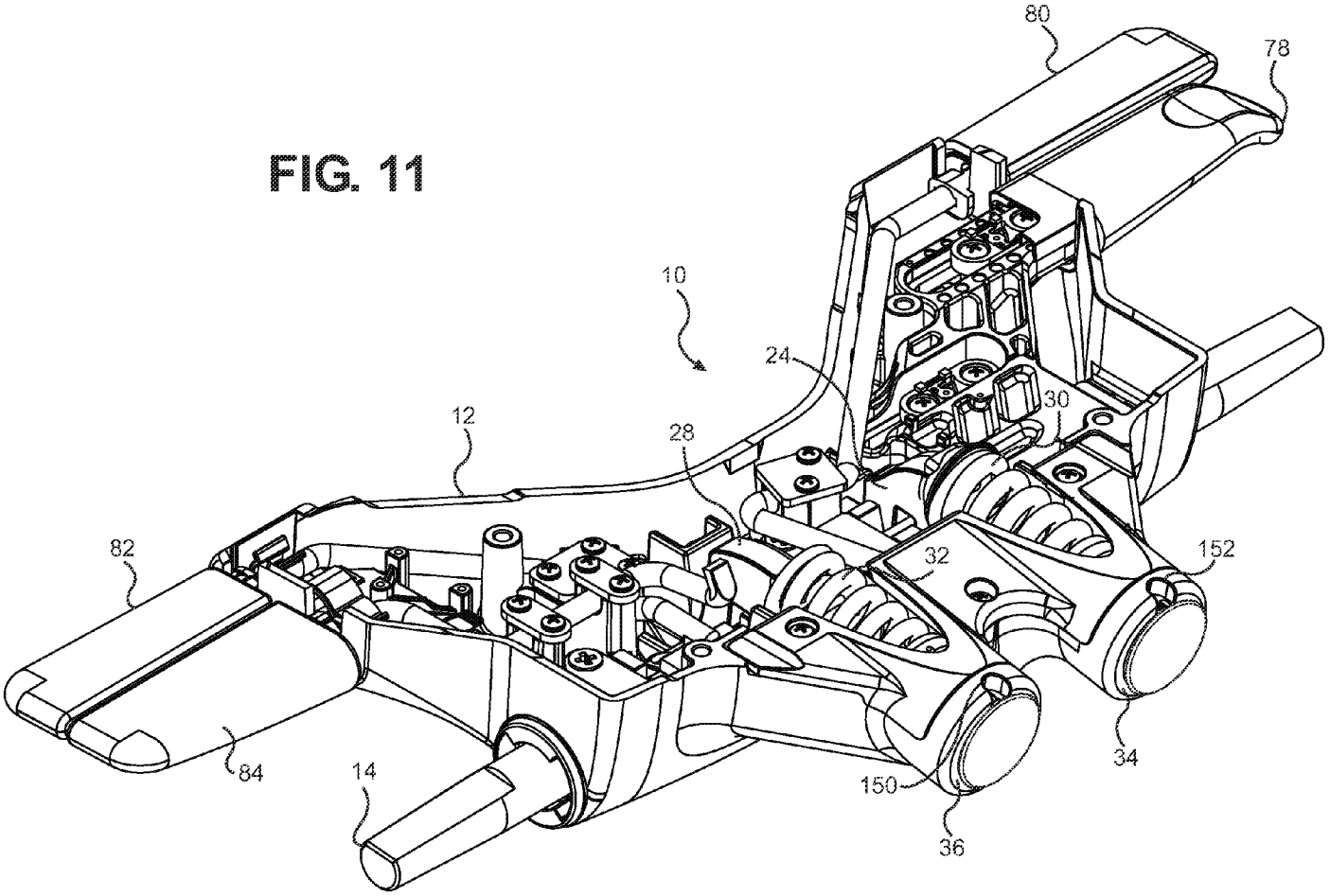
FIG. 11 is a rearward perspective view of the pivoting mechanism of FIG. 1 with the fine tension adjustment in an inwardly facing disposition.

As shown in FIGS. 10 and 11, it is possible that the knobs 34 and 36 could be reversible. The knobs 34 and 36 can have base portions and raised handles 146 and 148, and the housing 12 can have corresponding channels 150 and 152. With this, the knobs 34 and 36 can be disposed with the handles 146 and 148 facing outwardly as in FIG. 10 for permitting a rotation of the knobs 34 and 36, and the knobs 34 and 36 can alternatively be disposed with the handles 146 and 148 facing inwardly as in FIG. 11 once a desired adjustment setting is achieved to present a finished appearance and to prevent inadvertent repositioning of the handles 146 and 148.

Figure 8:
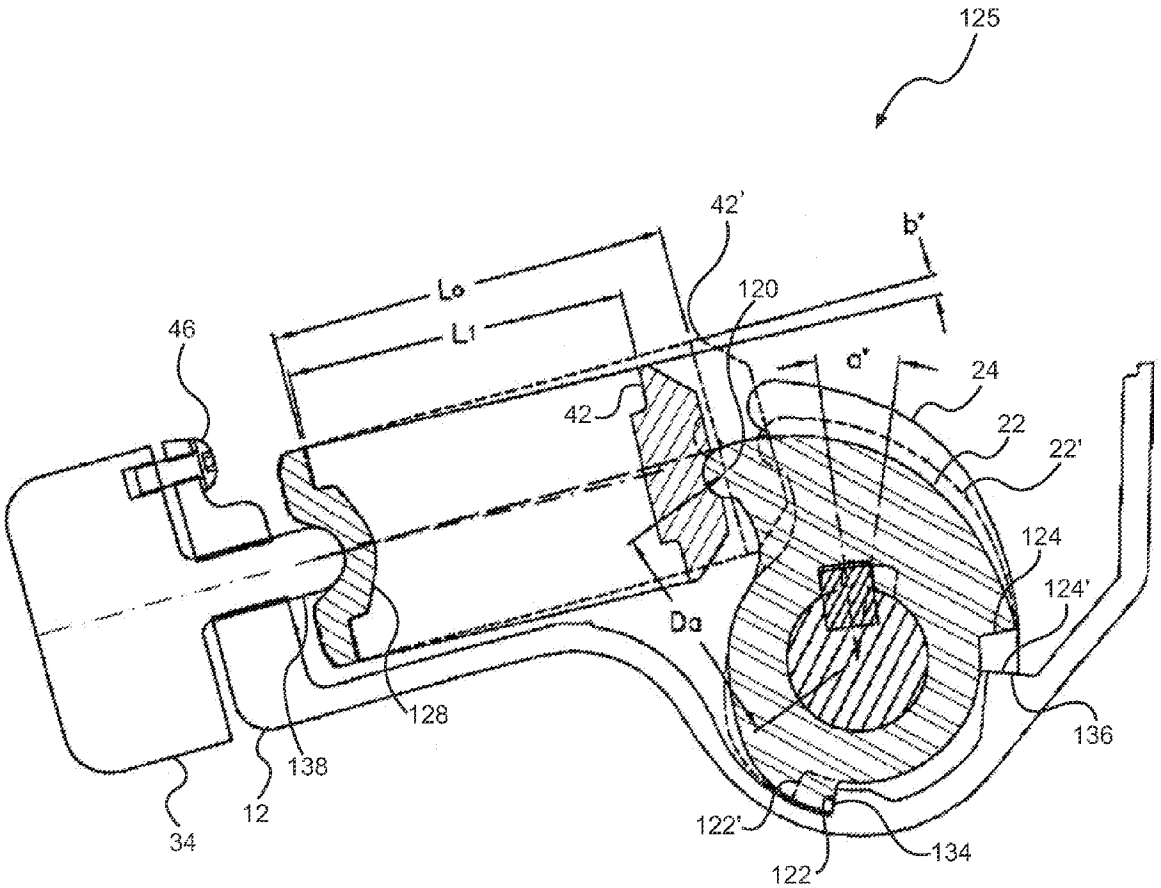
FIG. 8 is a partially sectioned view in side elevation of the pivoting mechanism of FIG. 1 in a second configuration.

With the spring arrangements 125 and 127 assembled as is shown in relation to the first spring arrangement 125 in FIGS. 7 and 8, the springs 30 and 32 and the caps 38, 40, 42, and 44 will be entirely suspended between the tip of the extension and retraction rod 138 and the tips 120 of the respective cam or cams 22, 24, 26, and 28, potentially with no other points of contact. The rounded tips 120 of the cams 22, 24, 26, and 28 engage the correspondingly rounded grooves 130 and 132, and the rounded tip of the rod 138 engage the rounded surface of the protuberance 128. Consequently, there will be minimal friction losses, and substantially all energy instilled into the springs 30 and 32 will be returned to the shaft 14 and, ultimately, to the seat occupant thereby enabling a seat occupant to pivot to a reclined position as desired and to return to an upright position with minimized effort. Substantially the entire force imparted by the cams 22, 24, 26, and 28 is directed along the longitudinal axis of the spring 30.

As shown in FIG. 7, when engaged by the locking slide 20, the first cam 22 will act upon the cap 42 and thus the spring 30 over a moment arm $D_a$ while the second cam 24 will act upon the cap 42 and thus the spring 30 over a moment arm $D_b$ when the second cam 24 is engaged by the locking slide 20. Therefore, with the single spring 30, at least first and second pivoting resistance zones can be established by selectively aligning the body portion 108 of the locking slide 20 to engage one cam 22 or 24 while causing the other cam 24 or 22 to align with the channel 110.

Figure 9:
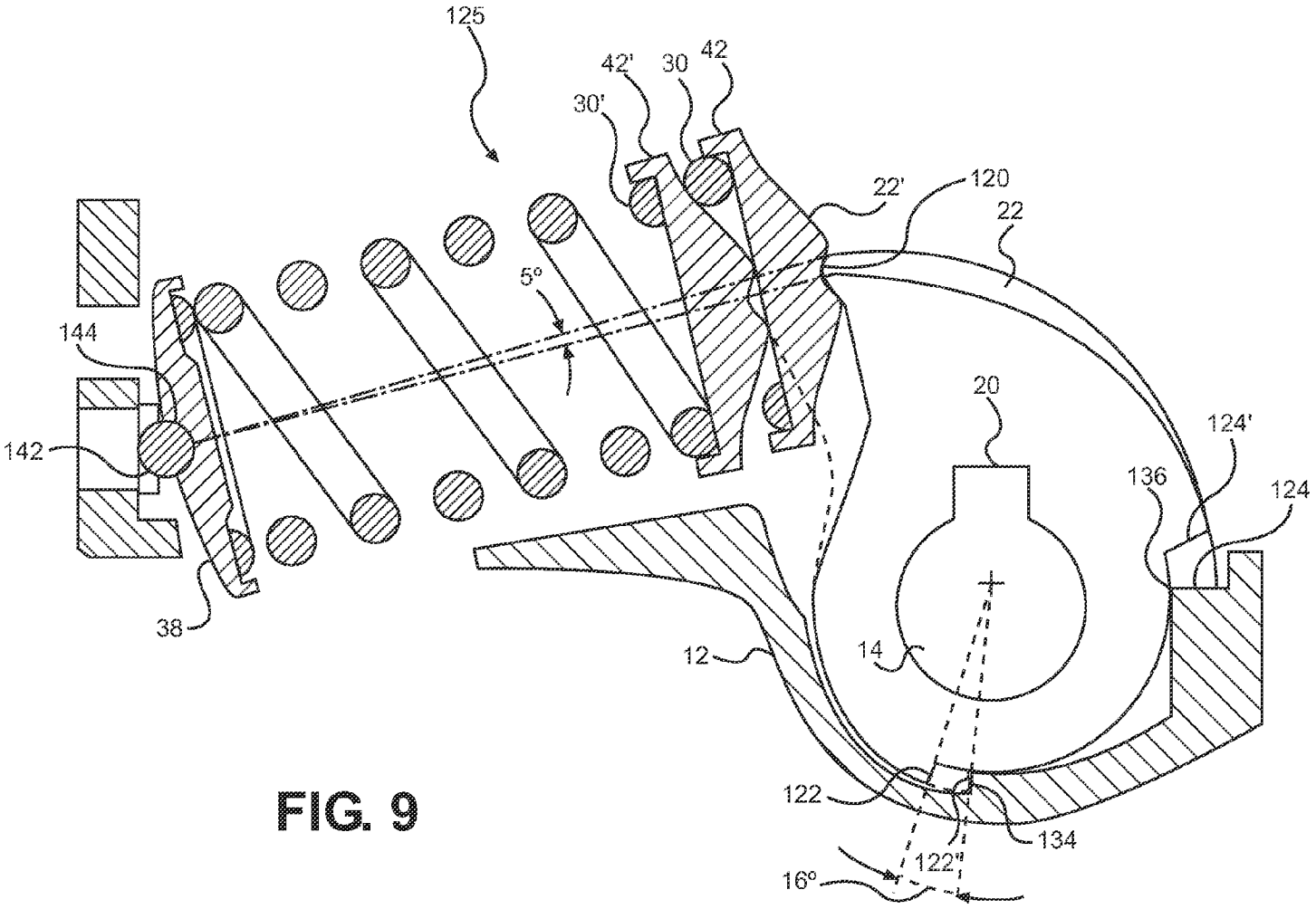
FIG. 9 is a partially-sectioned view in side elevation of an alternative pivoting mechanism as taught herein.

As shown in relation to the embodiment of the spring arrangement 125 of FIG. 9, it is also possible to have a single cam 22 associated with a given spring 30. With multiple such arrangements 125, one could select which and how many arrangements 125 are actuated thereby adjusting between resistance zones provided by one spring 30 as compared to another spring 30 and combinations of springs 30. When engaged, the cam 22 will pivot with the shaft 14 in a counterclockwise direction. Acting over the moment arm from the tip 120 to then pivot axis of the cam 22, the tip 120 will press on the spring cap 42 thereby to compress the spring 30 until the spring and spring cap are positioned as shown at 30' and 42'. The spring cap 38 has a hemispherical indentation 144 on its outer surface, which receives a ball bearing 142.

So configured, the spring 30 will be permitted to pivot about a given angle, which is shown as 5 degrees in the drawing. The cam 22 is adjusted to the position shown at 22' as the stop surfaces 122 and 124 move from the upright position where the upright stop surfaces 124 and 136 engage one another to the positions shown at 122' and 124' where the reclined stop surfaces 122' and 134 make contact. While the degree of pivoting will vary, the depicted embodiment permits a pivoting of the shaft 14 and thus the retained arm and seat back structures 98, 100, and 162 through an angle of 16 degrees.

Within the contemplated scope of the invention, there are numerous possible variations in the number of springs 30 and 32, the performance characteristics of the springs 30 and 32, the number of cams 22, 24, 26, and 28, the number and location of cam channels 110 in the locking slide 20, and other variables that might be employed to enable the provision of multiple resistance zones that can readily be set simply by actuation of the locking slide 20 via the resistance adjustment arm 50. Compression springs are shown at 30 and 32 in the previously referenced drawings. However, it will be appreciated that substantially any type of resiliently compressible member or members, which could be formed from any one of a wide variety of materials or combinations thereof, could potentially be employed as springs, including those indicated at 30 and 32, within the scope of the invention.

Figure 18:
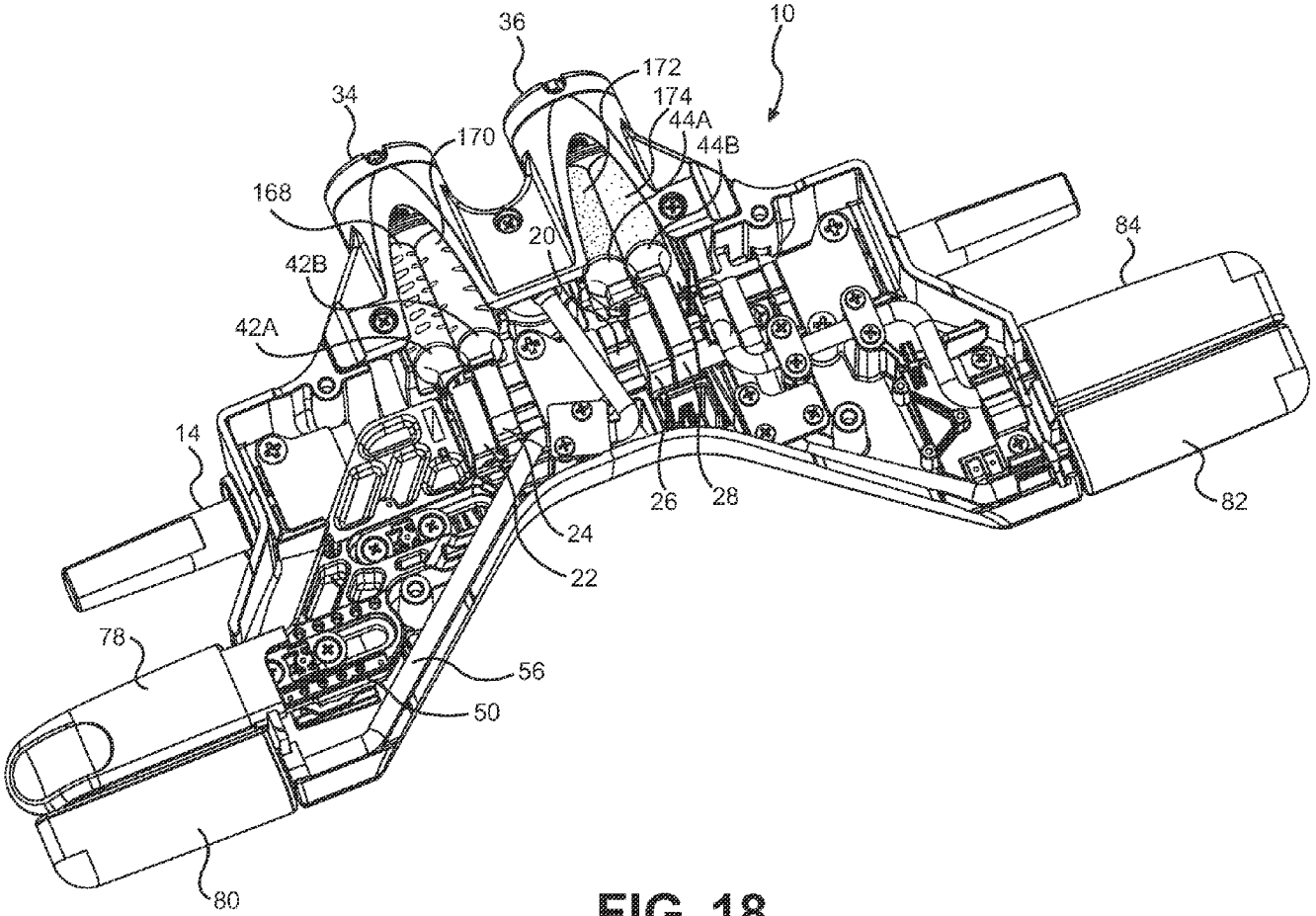
FIG. 18 is a perspective view of an alternative pivoting mechanism with gross and fine resistance adjustment under the present invention.

One alternative example of many alternative resiliently compressible members that could be employed within the scope of the invention is shown in relation to the chair control mechanism 10 of FIG. 18. There, the first compression spring 30 is replaced by first and second rods 168 and 170 of resiliently compressible foam sponge, and the second compression spring 32 is replaced by third and fourth rods 172 and 174 of resiliently compressible foam sponge. The rods 168 and 170 and the rods 172 and 174 can have different compression properties, which may or may not be characterized by spring constants. The first rod 168 has a spring cap 42A that engages the tip of the first cam 22 to be selectively compressed thereby, and the second rod 170 has a spring cap 42B that engages the tip of the second cam 24. Likewise, the third cam 26 engages a spring cap 44A at the end of the third rod 172, and the fourth cam 28 engages a spring cap 44B disposed at the end of the fourth rod 174. With this, the locking slide 20 can be adjusted to engage one or more of the cams 22, 24, 26, and 28 thereby to compress and be resisted by one or more of the resiliently compressible rods 168, 170, 172, and 174.

Figure 14:
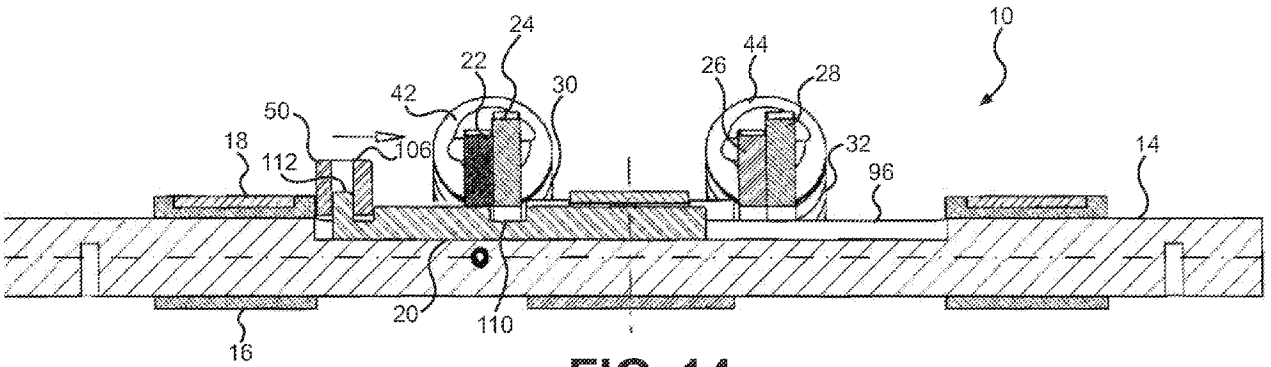
FIG. 14 is a cross-sectional view of the pivoting mechanism taking along the line 14-14 in FIG. 1 in a first resistance setting.
Figure 15:
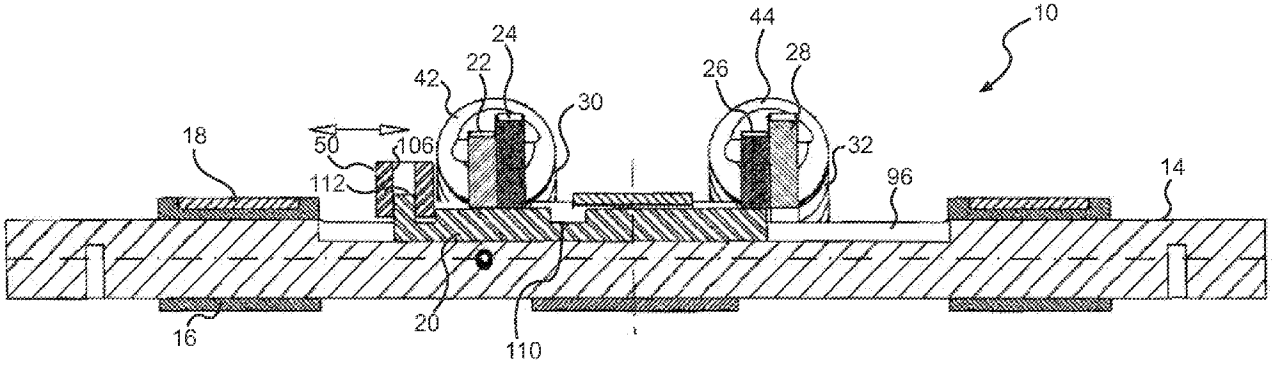
FIG. 15 is a cross-sectional view of the pivoting mechanism taking along the line 14-14 in FIG. 1 in a second resistance setting.

Looking to FIGS. 14 and 15, one can gain a further understanding of the adjustments between resistance zones enabled by the exemplary embodiment of FIG. 1. In FIG. 14, the locking slide 20 is positioned along the channel 96 with its end clear of the third and fourth cams 26 and 28. The third and fourth cams 26 and 28 are thus free from pivoting with the shaft 14 such that the second spring 32 is entirely inactive. The cam channel 110 is aligned with the second cam 24 whereby it too is free from pivoting with the shaft 14. The locking slide 20 is engaged with the first cam 22 such that it is locked to pivot with the shaft 14 and, in doing so, to compress the first spring 30. The force of the first cam 22 will act over its moment arm, which is less than the moment arm that would be produced by the second cam 24, which is greater in height, and will for the same reason produce less compression of the spring 30 per degree of pivoting of the shaft 14. This can be considered the first setting of the chair control mechanism 10 establishing a first resistance zone.

The chair control mechanism 10 can be adjusted to a second setting by repositioning the locking slide 20 until the cam channel 110 is beyond the second cam 24 while leaving the end of the locking slide 20 clear of the second and third cams 26 and 28. So positioned, the locking slide 20 will engage the first and second cams 22 and 24 to cause them to pivot with the shaft 14. The third and fourth cams 26 and 28 will remain free from pivoting with the shaft 14 whereby the second spring 32 will remain inactive. As the shaft 14 is pivoted, the second cam 24 will dominate over the first cam 22 based on the greater height of the second cam 24. The reclining torque produced by the second cam 24 will compress the first spring 30 acting over the greater moment arm produced by the greater height of the second cam 24 as compared to the first cam 22 thereby establishing a second resistance zone.

A third resistance zone can be achieved under the third setting of the chair control mechanism 10 shown in FIG. 15. There, the locking slide 20 is positioned with the cam channel 110 beyond the first and second cams 22 and 24 and with the end of the locking slide 20 received into and engaging the third cam 26 but not the fourth cam 28. With this, the first, second, and third cams 22, 24, and 26 will be active and keyed to pivot with the shaft 14 while the fourth cam 28 will not. The second cam 24 will act over its moment arm in compressing the first spring 30, and the third cam 26 will act over its moment arm in compressing the second spring 32. The forces of the first and second springs 30 and 32 will thus resist the pivoting of the cams 24 and 26, the shaft 14, and consequently the reclining of the arm and back structures 98, 100, and 162.

Repositioning the locking slide 20 to be received into the fourth cam 28 will establish a fourth resistance zone. In the fourth resistance zone, all four cams 22, 24, 26, and 28 will be keyed to pivot with the shaft 14. The first and second springs 30 and 32 will be compressed by the torque imparted by the second and fourth cams 24 and 28 acting over their moment arms, which may be the same or different.

The chair control mechanism 10 thus permits substantially instant adjustment between multiple resistance zones so that persons of significantly different sizes, weights, and preferences can be immediately accommodated without excessive adjustment requirements. Likewise, a single person can adjust to different resistance zones for differing tasks, such as by adjusting to the fourth resistance zone during a meeting where maximum resistance to pivoting might be desired and by adjusting to the first resistance zone during a phone call where minimal resistance to pivoting might be desired to enable easy reclining. Furthermore, once the gross adjustment to a desired resistance zone is achieved, the pivoting resistance provided the chair control mechanism 10 can be finely adjusted to the occupant's exact preference by operation of one or both adjustment knobs 34 and 36 to adjust the initial deflection of the spring or springs 30 and 32.

By operation of the resistance adjustment arm 50 to control the positioning of the locking slide 20, the chair control mechanism 10 permits selective control over the cam or cams 22, 24, 26, and 28 that are engaged to pivot with the shaft 14. In doing so, the chair control mechanism 10 potentially permits the selection of the number of springs 30 and 32 that are engaged, the spring constant of springs 30 and 32 that are engaged, and the moment arm between the shaft 14 and the spring or springs 30 and 32. Herein, the inventor attempts to expound on the structural and functional advantages of the varied configurations of the chair control mechanism 10, but it will be understood by one skilled in the art that numerous advantages and possibilities are inherent in the structural combinations disclosed herein.

Figure 16:
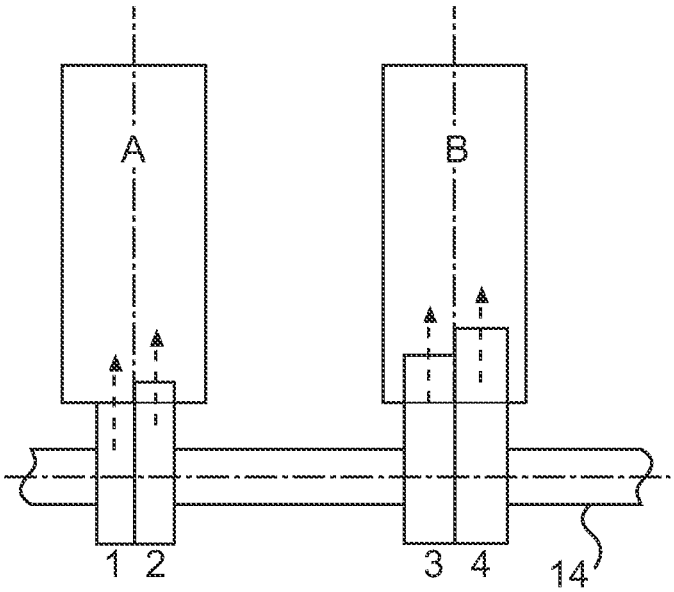
FIG. 16 is a schematic view of a first spring arrangement and various resistance settings therefor.
Figure 17:
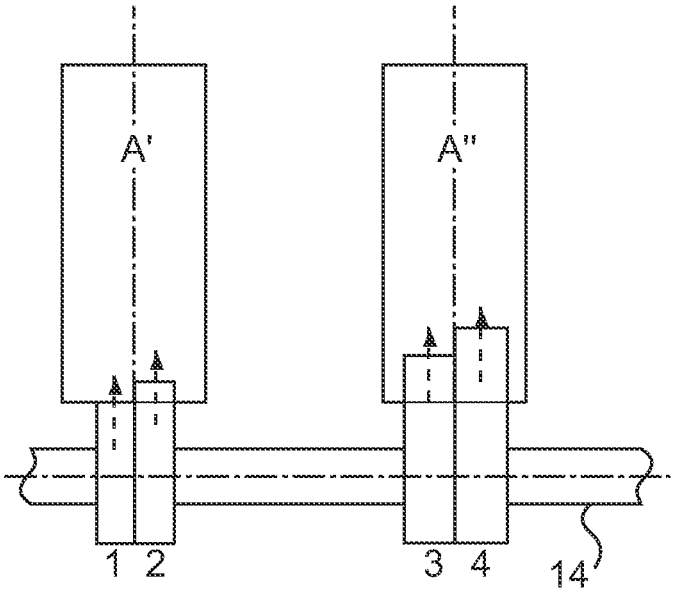
FIG. 17 is a schematic view of a second spring arrangement and various resistance settings therefor.

The schematic depictions of FIGS. 16 and 17 illustrate some possible resistance zones with the chair control mechanism 10. In FIG. 16, first and second springs A and B have different spring constants, and first, second, third, and fourth cams 1, 2, 3, and 4 can be selectively keyed to pivot to provide resistance to pivoting of the shaft 14. The resistance adjustment arm 50 (not shown in FIGS. 16 and 17) can have setting indications associated therewith indicating a first setting • where the first cam 1 is engaged with the first spring A, a second setting •• where the third cam 3 is engaged with the second spring B, which has a different spring constant than the first spring A, a third setting ••• where the second and third cams 2 and 3 are engaged with the first and second springs A and B respectively, and a fourth setting •••• where the second and fourth cams 2 and 4 are engaged with the first and second springs A and B respectively.

In FIG. 17, the first and second springs A' and A" have the same spring constants. First, second, third, and fourth cams 1, 2, 3, and 4 can again be selectively keyed to pivot to provide resistance to pivoting of the shaft 14. The resistance adjustment arm 50 can have setting indications associated therewith indicating a first setting • where the first cam 1 is engaged with the first spring A', a second setting •• where the third cam 3 is engaged with the second spring A", a third setting ••• where the first and third cams 1 and 3 are engaged with the first and second springs A' and A" respectively, and a fourth setting •••• where the second and fourth cams 2 and 4 are engaged with the first and second springs A and A" respectively.

Figure 26:
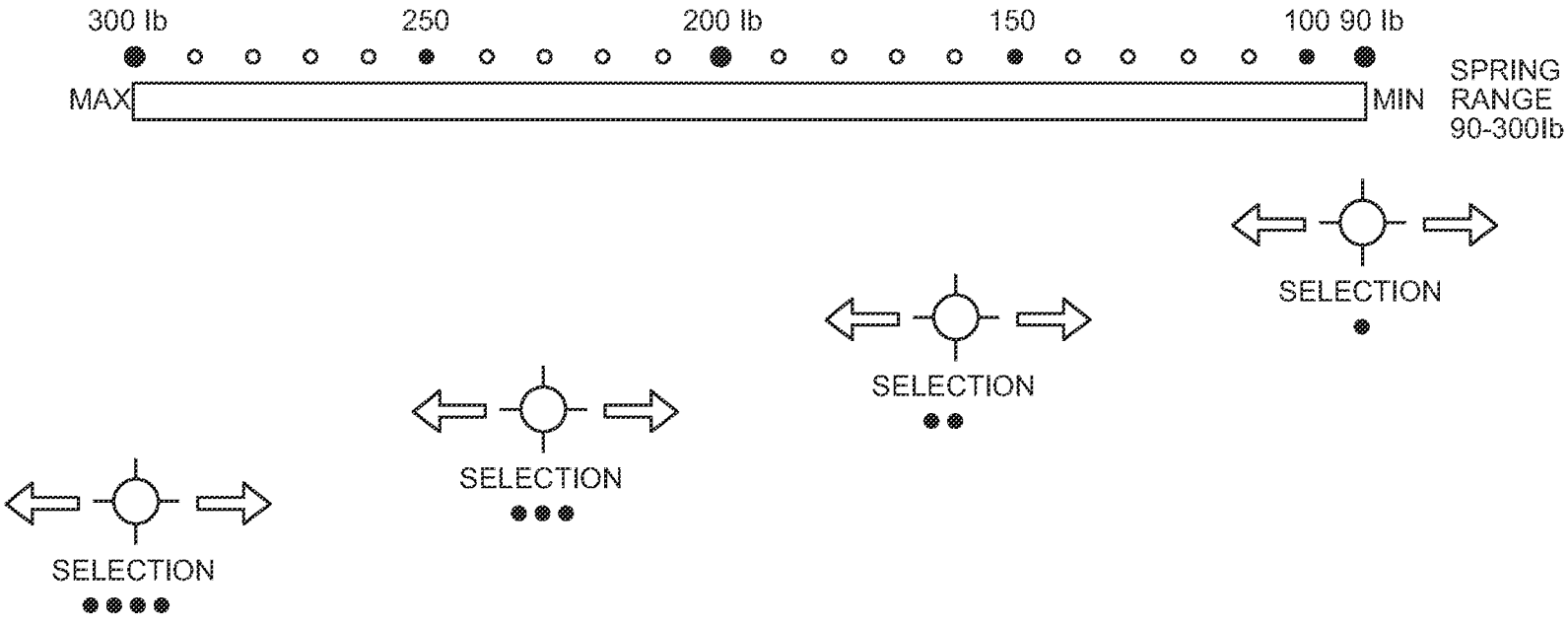
FIG. 26 is a diagram depicting the gross and fine tension adjustment characteristics of a pivoting mechanism according to the invention.

Perhaps an even better understanding of the capabilities of the gross and fine pivoting resistance adjustments permitted under the present invention can be had by reference to the schematic depiction of FIG. 26. There, for one specific exemplary embodiment to which the invention is by no means limited, it can be seen that the pivoting mechanism 10 can provide immediate gross adjustment to suit seat occupants ranging in weight from 90 pounds to 300 pounds by adjustment to pre-established settings having predetermined pivoting resistance. The pivoting mechanism 10 can also provide fine pivoting resistance adjustment within a given range of each pre-established setting, whether only upward, only downward, or both upward and downward as suggested by the directional arrows.

The gross adjustment can be carried out by selectively positioning the locking slide 20 as previously described, and the fine adjustment can be carried out by selectively turning one or both adjustment knobs 34 and 36. A person in the range of 90 pounds can thus immediately and conveniently adjust to the first setting • and then, if desired, finely adjust resistance for personal preference, varied tasks, or some other reason. Similarly, a person weighing in the range of 160 pounds can slide the locking slide 20 to the second setting ••, a person in the range of 230 pounds can select the third setting •••, and a person weighing 300 pounds can select the fourth setting ••••, with each person additionally being able to make fine adjustments if necessary and desired.

While the ability to adjust pivoting resistance as described and illustrated herein is considered highly advantageous, it is appreciated that there will be occasions where absolutely no pivoting of the arm and seat back structures 98, 100, and 162 is desired. To facilitate that, the chair control mechanism 10 of FIG. 1 includes a means for restricting the shaft 14 against pivoting. More particularly, the chair control mechanism 10 includes a locking wedge 25 fixed to a first end of a pivotable recline lock lever 62 and can be actuated into and out of engagement with the channel 96 in the shaft 14 by operation of the lock lever 62. The lock lever 62 projects outboard of the left side of the housing 12 and can be controlled by a handle 82 that is fixed thereto. So arranged, the handle 82 can be adjusted to a first position where the locking wedge 25 is inserted into the channel 96 to prevent pivoting of the shaft 14 and to a second position where the locking wedge 25 is clear of the channel 96 to permit pivoting of the shaft 14.

A spring clip 62, which could be formed from spring steel, resilient plastic, or any other material or combination thereof, is secured relative to the housing 12 and receives the lock lever 62. The spring clip 62 has first and second resiliently engaged sides with first and second broadened portions therebetween. With this, the lock lever 62 can be positioned and retained by the clip 62 in the first position locking the arm and back structures 98, 100, and 162 against reclining and repositioned and retained by the clip 62 in the second position permitting reclining.

As depicted in relation to the chair 500 of FIG. 19, chairs 500 exploiting the present invention are contemplated where the back structure 162 is pivotally retained by the pivoting mechanism 10 by the outboard ends of the shaft 14 so that the seat back structure 162 can pivot rearwardly while the seat structure 156 remains stationary. However, as shown for example in FIGS. 20 and 21, embodiments of pivoting mechanisms 10 and resulting chairs 500 according to the invention are contemplated where both the seat back structure 162 and the seat bottom structure 156 are retained to pivot together by the pivoting mechanism 10.

The pivoting mechanism 10 in FIGS. 20 through 23 again has a shaft 14 with distal ends projecting outboard of a housing 12. The pivoting inner workings of the pivoting mechanism 10 can be as described previously or hereinbelow or in any other construction that exploits the invention disclosed herein. Left and right pivot arms 180 have proximal ends fixed to pivot with the outboard ends of the shaft 14 by a chamfering of the shaft 14 in combination with bolts 186 that pass through apertures at the proximal end of the pivot arms 180 and into the ends of the shaft 14. The distal ends of the pivot arms 180 have support brackets 182 fixed thereto whether by integral formation or some other method. The seat structure 156 is fixed to the support brackets 182 of the support arms 180, and the back structure 162 is retained by being fastened to the seat structure 156 and, additionally or alternatively, the support brackets 182 of the support arms 180. The arm structures 98, which are extendable and retractable, are also fastened to the seat structure 156 and, additionally or alternatively, the support brackets 182 of the support arms 180.

Figure 22:
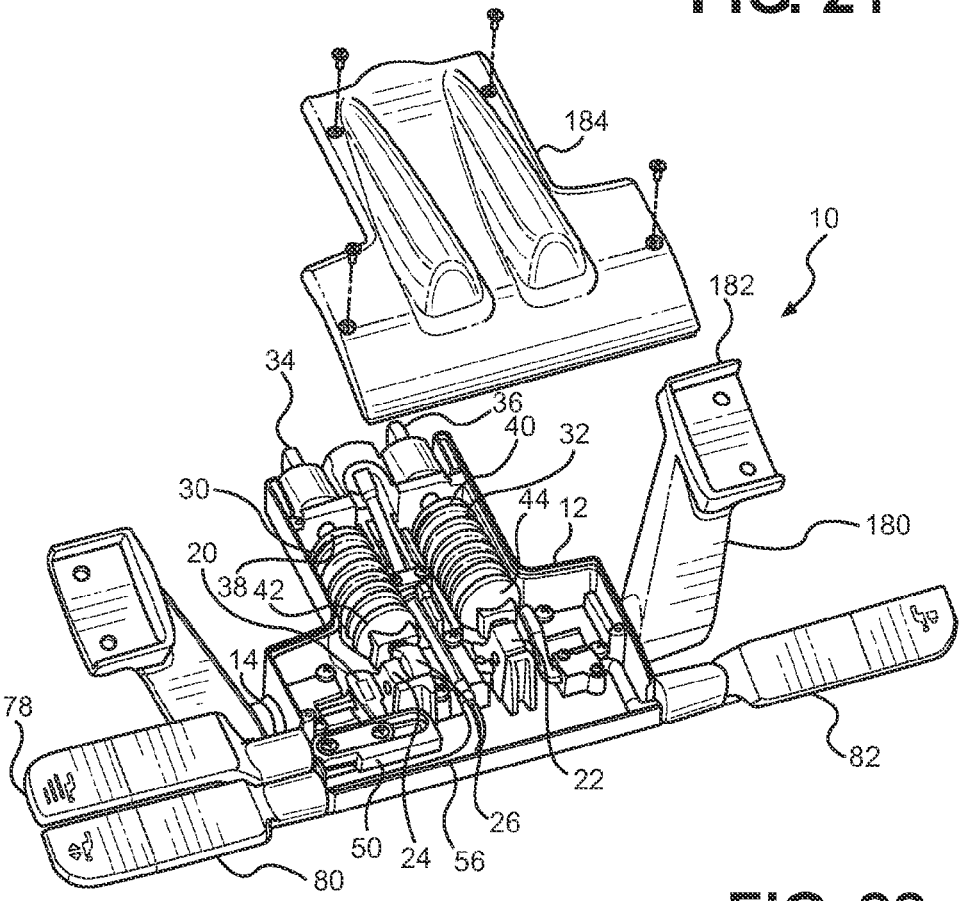
FIG. 22 is a partially exploded perspective view of the pivoting mechanism of FIG. 21.

Under this configuration of the chair 500, the seat and back structures 156 and 162 will pivot together relative to the pivoting mechanism 10 as the support arms 180 impart torque on the shaft 14. The arm structures 98 can be raised and lowered as desired. The pivoting resistance exhibited by the pivoting mechanism 10 can undergo a gross adjustment by operation of the handle 78 to slide the resistance adjustment arm 50 thereby moving the locking slide 20 within the channel 96, and the pivoting resistance exhibited by the pivoting mechanism 10 can undergo a fine adjustment by a selective rotation of the handles 34 and 36 to adjust the initial compression of the springs 30 and 32 as shown in FIG. 22, for example. Moreover, the overall height of the arm, seat, and back structures 98, 156, and 162 can be adjusted by operation of the piston 88 through the handle 80.

Figure 20:
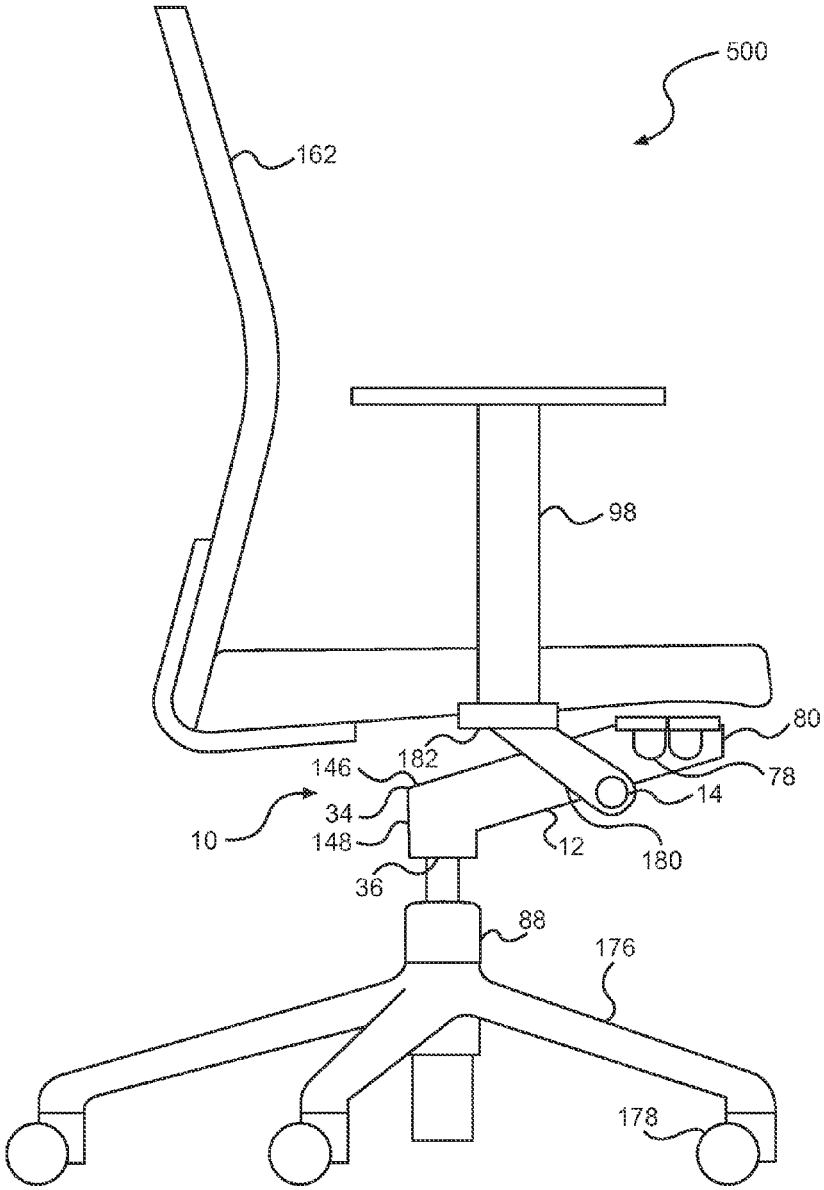
FIG. 20 is a view in side elevation of an alternative chair incorporating the pivoting mechanism of the invention.
Figure 21:
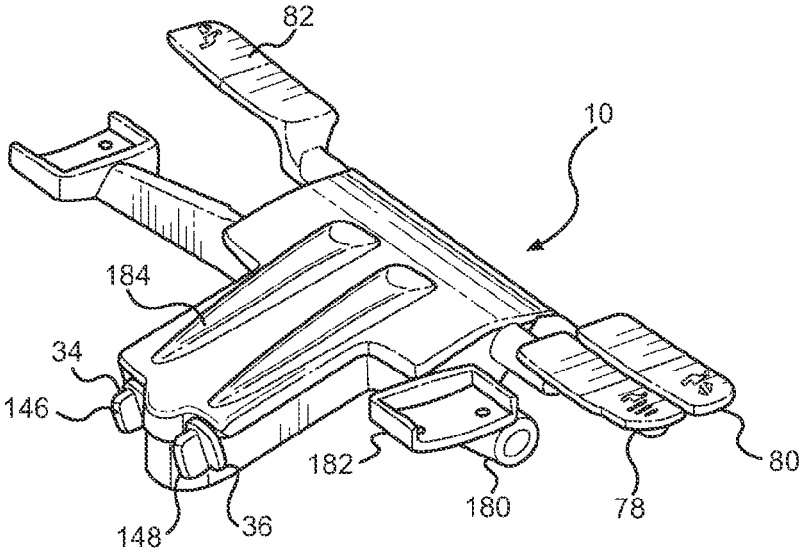
FIG. 21 is a perspective view of a pivoting mechanism as disclosed herein.
Figure 23:
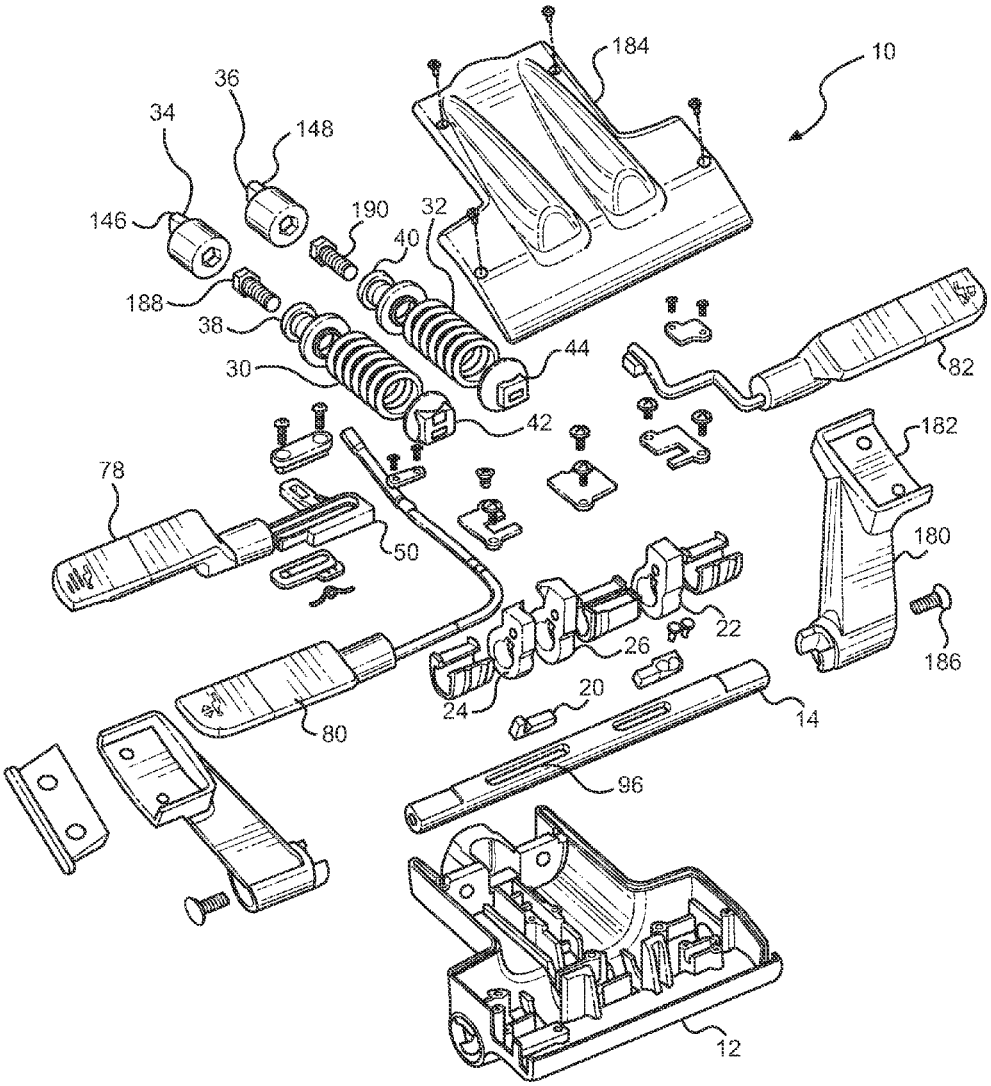
FIG. 23 is an exploded perspective view of the pivoting mechanism of FIG. 21.

Looking further to FIGS. 22 and 23, the alternative pivoting mechanism 10 according to the invention exploited in FIG. 20 and depicted in FIG. 21 is shown with the protective cover 184 thereof removed. With that, one can see that first and second springs 30 and 32 are again disposed to be compressed by one or more cams 22, 24, and 26 that are turned when keyed to the shaft 14 by the locking slide 20 by a pivoting of the shaft 14 thereby to provide pivoting resistance to the pivoting of the seat bottom and back structures 156 and 162 through the support arms 180. Resistance adjustment can be finely adjusted by use of the handles 34 and 36 to rotate bolts 190 and 192 thereby to adjust the initial compression of the springs 30 and 32.

This alternative pivoting mechanism 10 exploits three cams 22, 24, and 26 to provide a gross adjustment of the pivoting resistance. Just the first cam 22 is retained to pivot selectively with the shaft 14 to compress the second spring 32 while second and third cams 24 and 26 are retained to pivot selectively with the shaft 14 to compress the first spring 30, all under the control of the locking slide 20 as manipulated by the handle 78. The second and third cams 24 and 26 have different effective radii of contact with the spring cap 42 with the third cam 26 having a greater radius of contact with the spring cap 42 than the second cam 24 thereby producing a different pivoting resistance. By adjusting the longitudinal location of the locking slide 20, three predetermined pivoting resistances can be reached immediately to accommodate distinctly different persons and preferences. For example, the first cam 22 can be constantly engaged, and the second and third cams 24 and 26 can be selectively engaged so that only the first cam 22 can provide a first pivoting resistance, the first and second cams 22 and 24 can provide a second pivoting resistance, or the first and third cams 22 and 26 can provide a third pivoting resistance.

Figure 24:
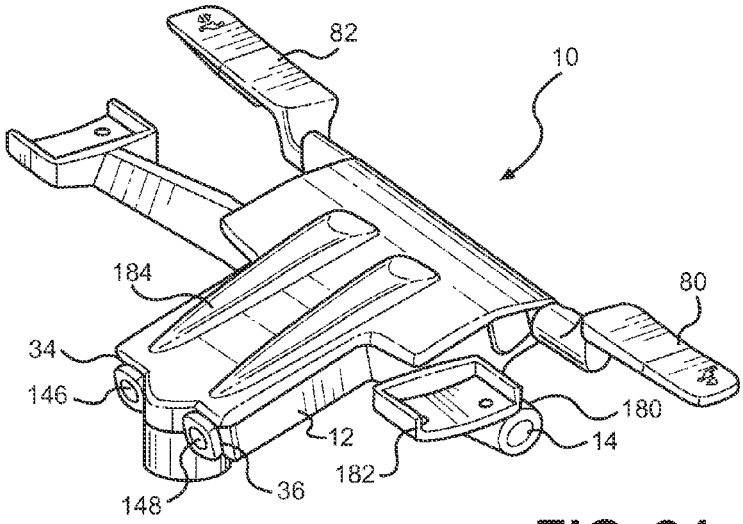
FIG. 24 is a perspective view of an alternative pivoting mechanism pursuant to the present invention.
Figure 25:
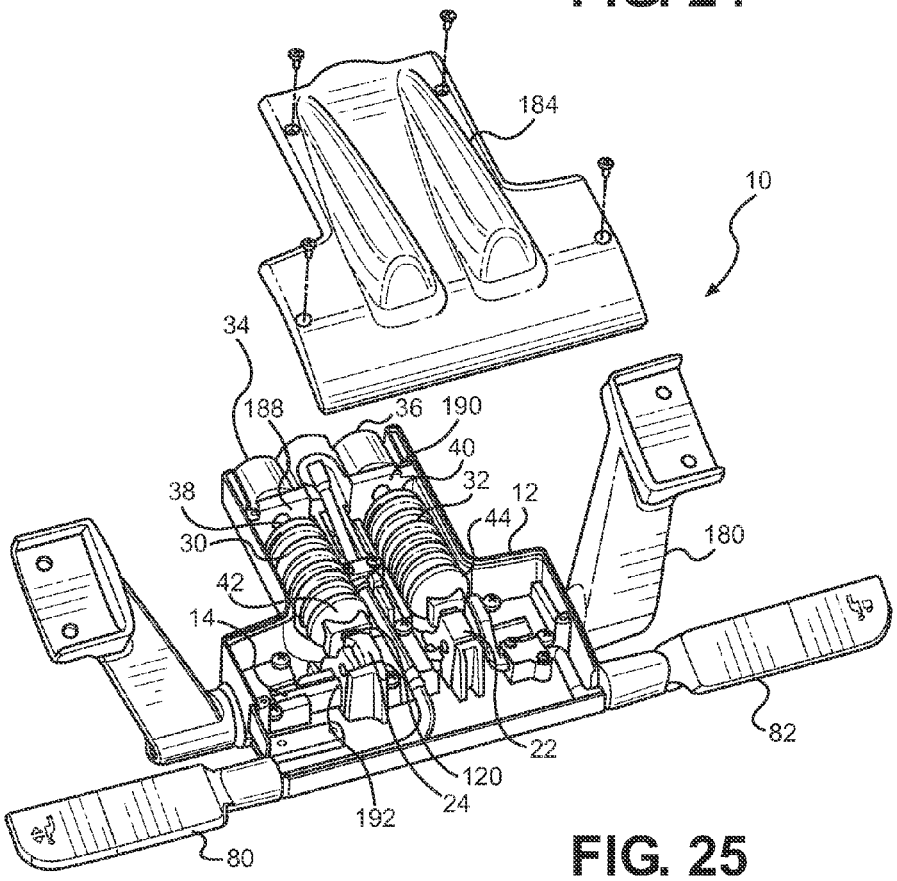
FIG. 25 is a partially exploded perspective view of the pivoting mechanism of FIG. 24.

Turning finally to FIGS. 24 and 25, an embodiment of the pivoting mechanism 10 is shown where seat bottom and back structures (not shown) would again be retained to pivot together by support arms 180. The support arms 180 again have proximal ends fixed to pivot with the shaft 14 against pivoting resistance provided by the first and second springs 30 and 32. Here, however, the locking slide 20 is eliminated, and the cams 22 and 24 are constantly keyed to pivot with the shaft 14, such as by a key 192. Fine resistance adjustment can be accomplished by rotation of one or both handles 34 and 36. The springs 30 and 32 are suspended with only a single contact point at a first end thereof with the tips of the bolts 188 and 190 and the caps 40 and 42 and a single contact point at a second end thereof with the tips 120 of the respective cams 22 and 24 with the caps 42 and 44.

The pivoting resistance adjustment mechanism described above advantageously provides a plurality of advantages in permitting gross pivoting resistance adjustment between resistance zones and fine pivoting resistance adjustment within each given resistance zone. However, it will again be appreciated that permitting the seat occupant to be aware of the location, purpose, and status of the several adjustment settings would be highly advantageous in facilitating the full exploitation of the adjustment characteristics provided by the mobile task chair. Moreover, it would be beneficial in particular embodiments of the mobile task chair control mechanism 10 to permit a partially or completely automated adjustment of some or all chair settings.

Figure 27:
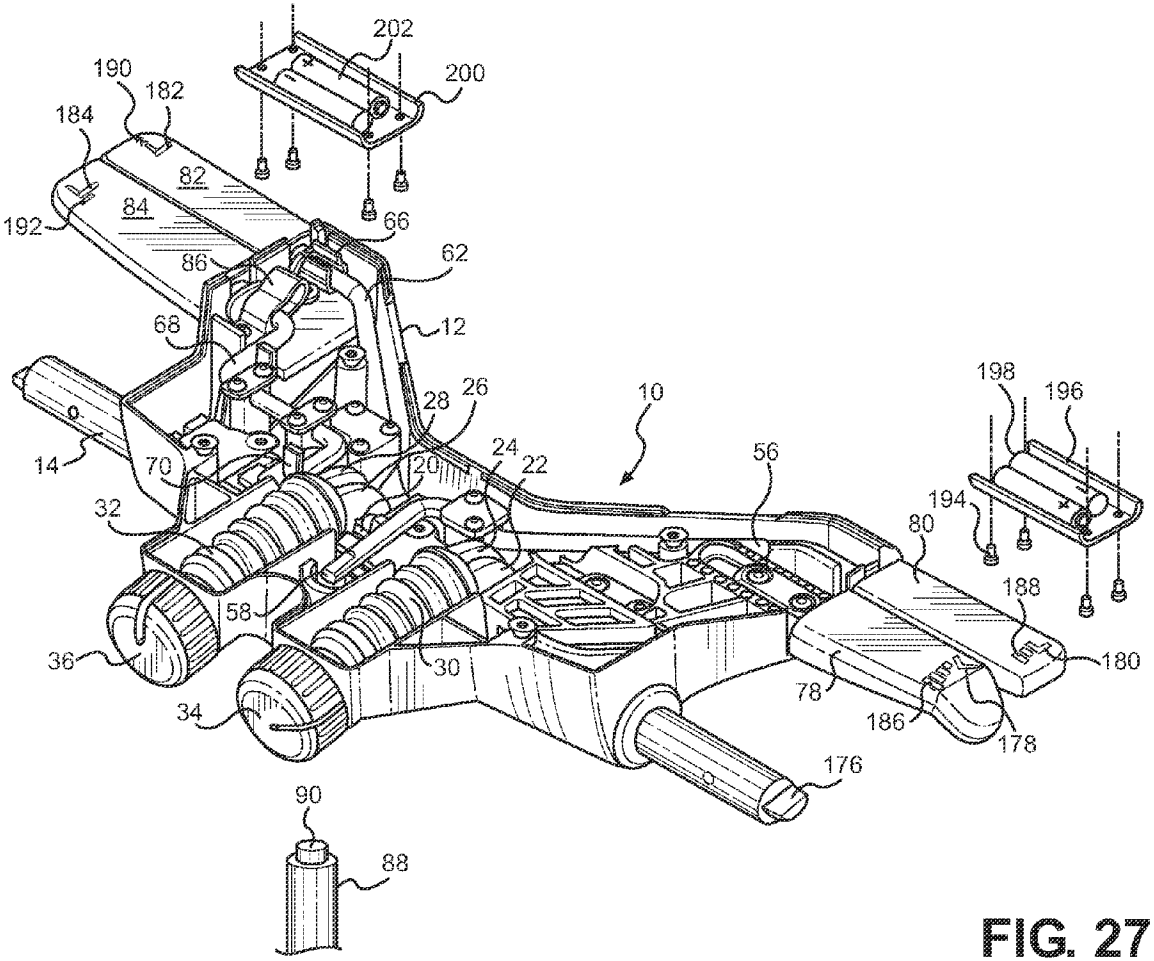
FIG. 27 is a perspective view of a task chair control mechanism with visual setting indicators and adjustment arrangements according to the present invention.

Accordingly, the mobile task chair control mechanism 10 first shown in FIG. 27 provides visual setting indicators to provide a visual indication of the settings of the adjustment arrangements provided by the task chair 500. In FIG. 27, each of the handles 78, 80, 82, and 84 has a seat icon 178, 180, 182, and 184 in association with a setting indicator 186, 188, 190, and 192. Together, the icons 178, 180, 182, and 184 and the setting indicators 186, 188, 190, and 192 provide visual and, additionally or alternatively, tangible indications of the purpose and setting of each of the adjustment arrangements. To accomplish this, the icons 178, 180, 182, and 184 and the setting indicators 186, 188, 190, and 192 can be actuated to provide a visual indication, such as by becoming illuminated, either automatically, continuously, or selectively.

In one example, a user could activate a switch, button, or similar actuation means to cause all icons 178, 180, 182, and 184 and all setting indicators 186, 188, 190, and 192 to be illuminated for a given period of time or until the actuation means is again triggered. Alternatively, the icons 178, 180, 182, and 184 and the setting indicators 186, 188, 190, and 192 could be automatically actuated upon a seat occupant's sitting in the mobile task chair. In one preferred embodiment, all icons 178, 180, 182, and 184 and setting indicators 186, 188, 190, and 192 can be automatically illuminated upon a user's touching any one of the control handles 78, 80, 82, and 84. With this, the task chair control mechanism 10 can effectively come alive to enable a seat occupant immediately to perceive the location and purpose of each handle 78, 80, 82, and 84 and the setting of the respective adjustment arrangement. The user can then employ the task chair control mechanism 10 to adjust any one of the adjustment arrangements to suit his or her body, preferences, or the task at hand.

The icons 178, 180, 182, and 184 and the setting indicators 186, 188, 190, and 192 could be powered in a number of possible ways. As shown in FIG. 27, power to the icons 178 and 180 and the setting indicators 186 and 188 could be provided by batteries 198 retained by either or both handles 78 or 80 by a casing 196 by use of fasteners 194. Similarly, batteries 202 retained by a casing 200 provide power to the icons 182 and 184 and the setting indicators 190 and 192.

Figure 28:
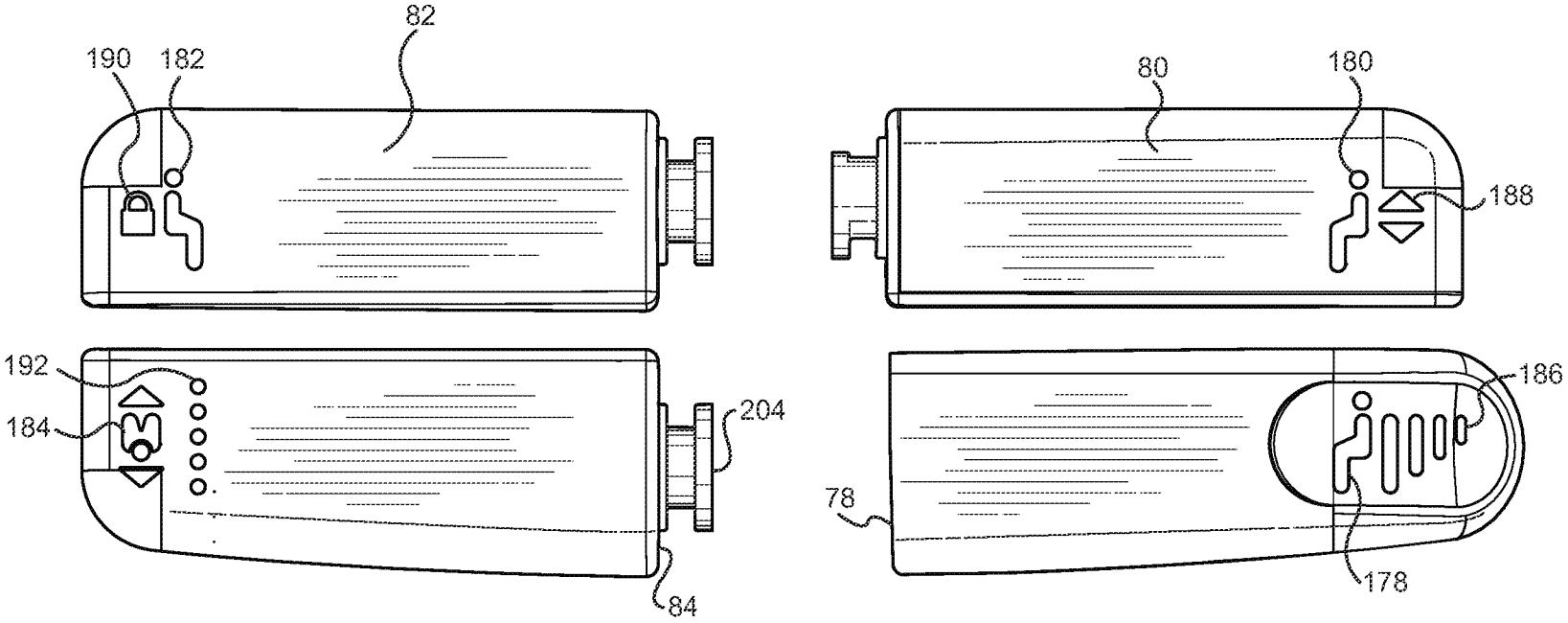
FIG. 28 is a top plan view of control handles with visual setting indicators pursuant to the invention disclosed herein.
Figure 29:
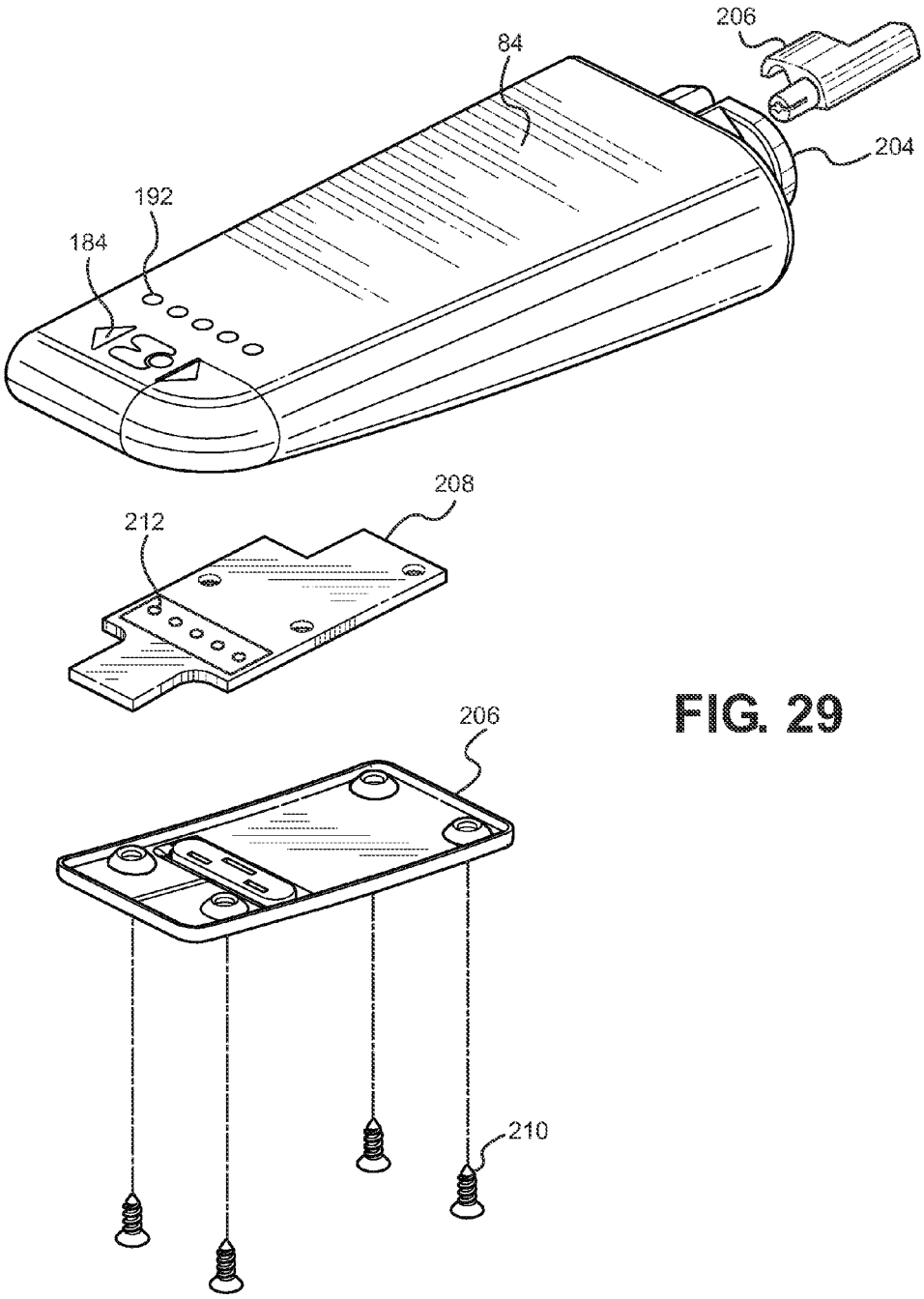
FIG. 29 is an upper exploded perspective view of a control handle with visual setting indicators.

Of course, numerous other combinations of means and mechanisms could be provided for providing seat setting indications, which may be illuminated or not. By way of example and not limitation, one may look to the alternative means for providing visual setting indications depicted in FIG. 28. There, the tension adjustment handle 78 disposed to actuate the resistance adjustment arm 50 is provided with a seated human icon 178 that has its back to a progressively shorter series of bars that together form a seat resistance setting indicator 186. The seat resistance setting indicator 186 and potentially the human icon 178 can be actuated to provide a visual and, additionally or alternatively, a tangible indication, such as by being selectively or continuously illuminated or otherwise actuated, to provide an indication of the resistance zone setting in which the task chair control mechanism 10 is disposed. For example, when the resistance mechanism is in the fourth resistance zone, the longest bar of the seat resistance setting indicator 186 can be illuminated. The remaining bars can be illuminated corresponding to each succeeding resistance zone.

Similarly, the height adjustment handle 80 fixed to the second end of the height adjustment lever 56 can have a seated human icon 180 and up and down arrows forming a seat height adjustment setting indicator 188. To provide an indication of the adjustment setting of the handle 80, either the up arrow or the down arrow together with the human icon 180 can be actuated to provide a visual and, additionally or alternatively, a tangible indication, such as by becoming illuminated, when the handle 80 is raised or lowered to raise or lower the seat 156.

To provide an indication of the location, function, and status of the seat lock handle 82, which is fixed to the second end of the seat slide lock lever 68, a seated human icon 182 and a padlock icon forming a seat slide lock indicator 190 are disposed in the surface of the handle 82. When the seat 156 is locked against sliding movement, the seat slide lock indicator 190 and the human icon 182 can be actuated to provide a visual and, additionally or alternatively, a tangible indication, such as by becoming illuminated, to provide an indication of the adjustment setting of the handle 82 and the seat 156.

Finally, the seat depth adjustment handle 84 fixed to the second end of the seat slide lock lever 68 has a human icon and forward and rearward arrows 184 together with a linear series of circles 192, each corresponding to a linear position of the seat 156. Under this arrangement, the appropriate circle 192 corresponding to the position of the seat 156 and potentially the human icon and forward and rearward arrows 184 can be actuated to provide a visual and, additionally or alternatively, a tangible indication, such as by becoming illuminated, to provide an indication of the adjustment setting of the seat 156.

Figure 33:
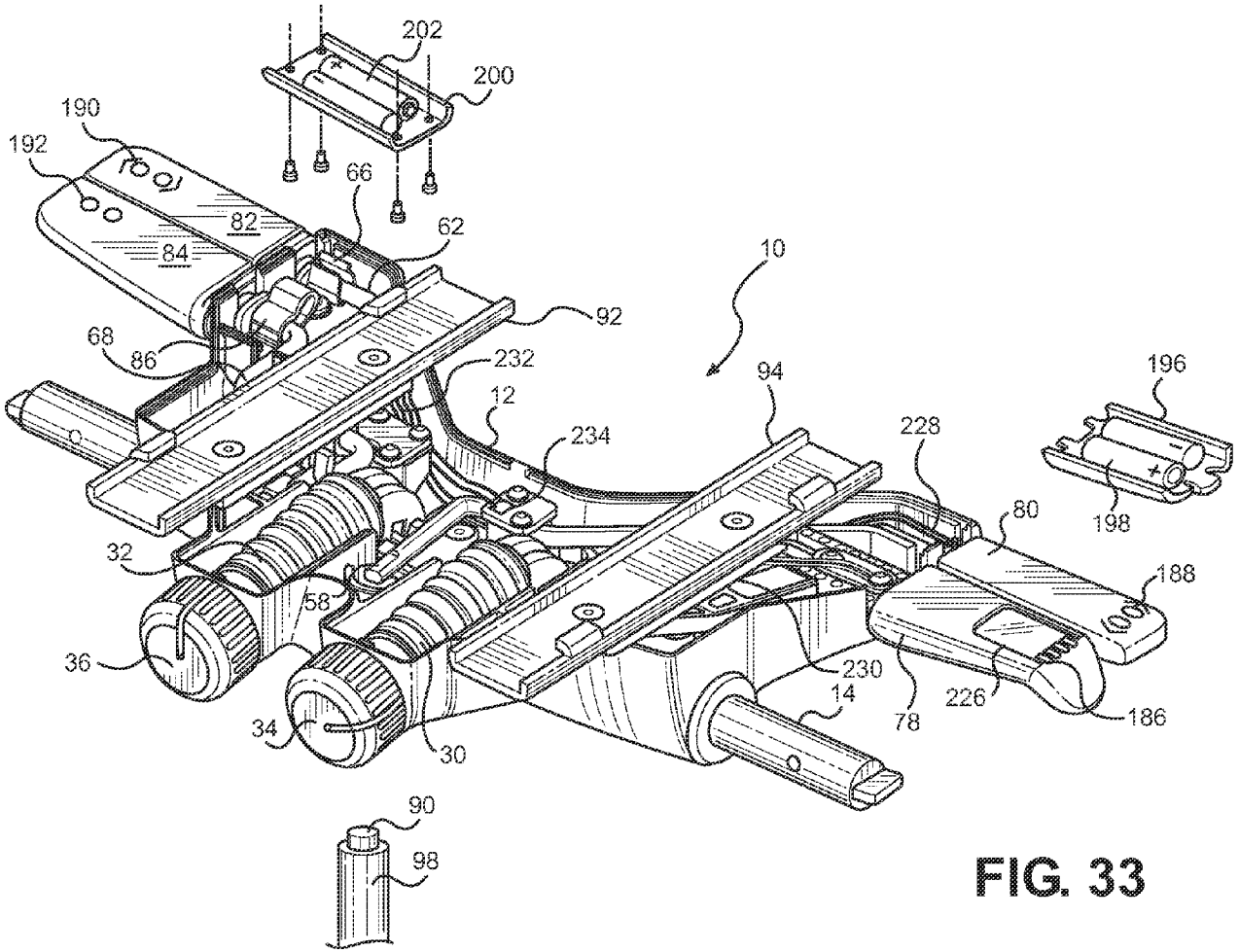
FIG. 33 is a perspective view of the task chair control mechanism of FIG. 32 with chair seat slider brackets attached.
Figure 34:
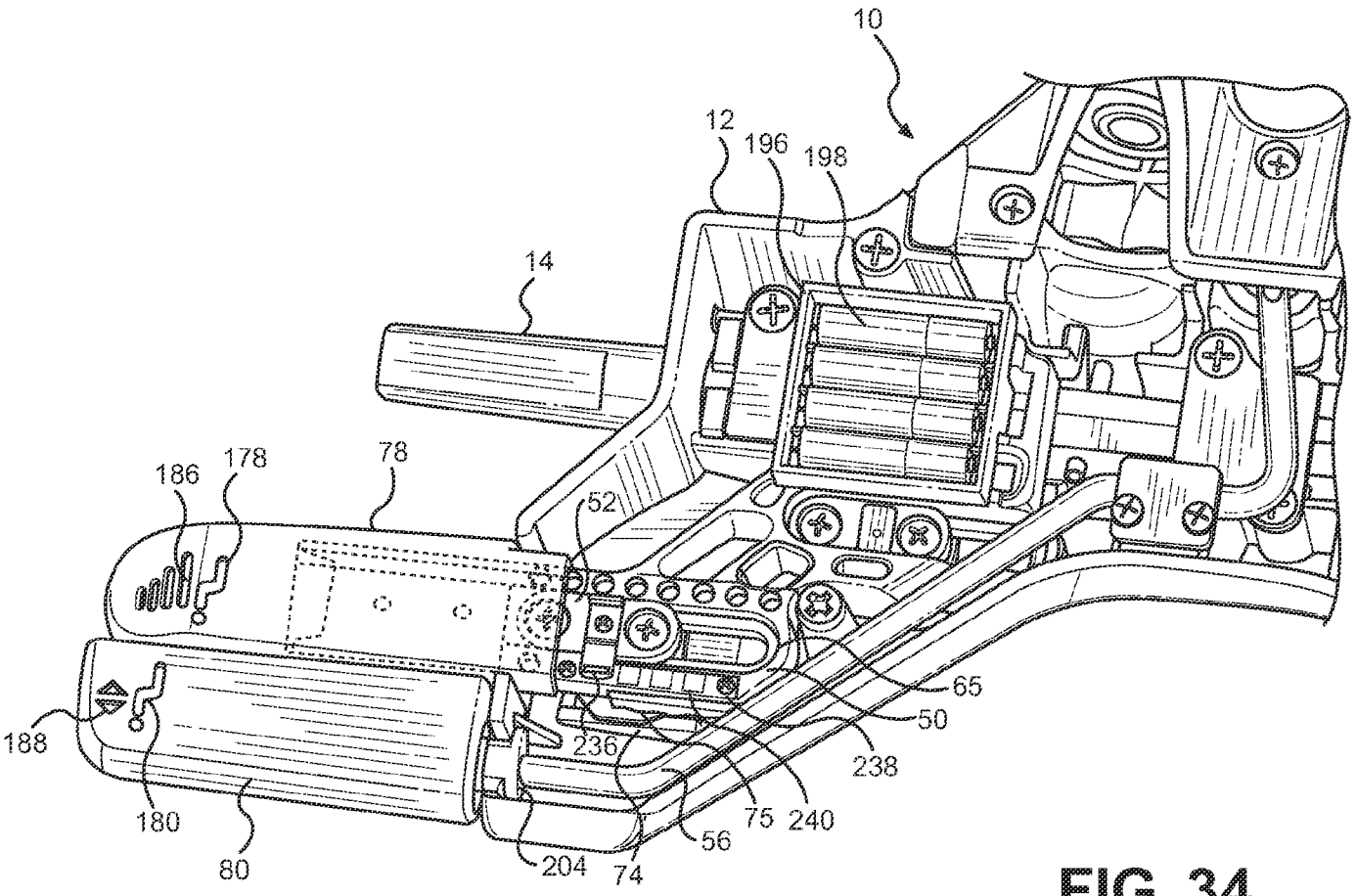
FIG. 34 is a perspective view of a partially sectioned portion of another alternative task chair control mechanism.
Figure 35:
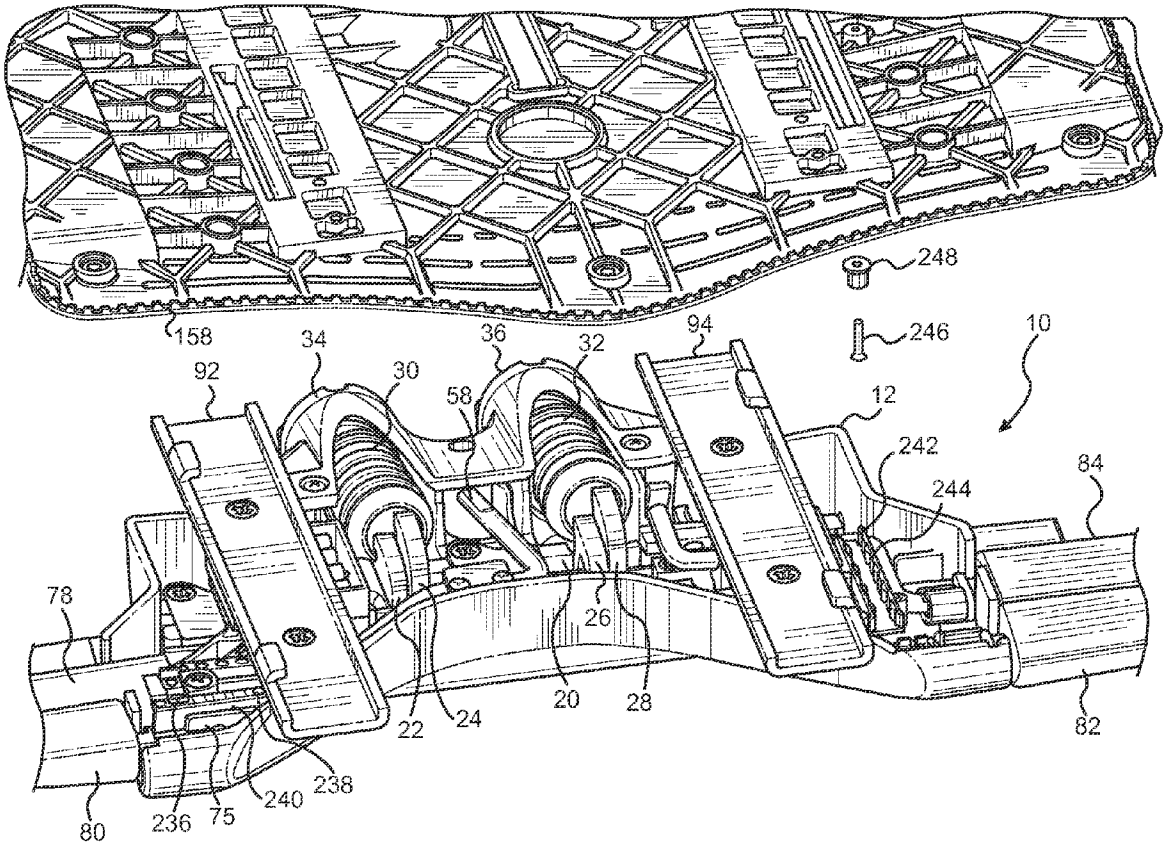
FIG. 35 is a partially exploded perspective view of a task chair control mechanism and chair base as disclosed herein.
Figure 36:
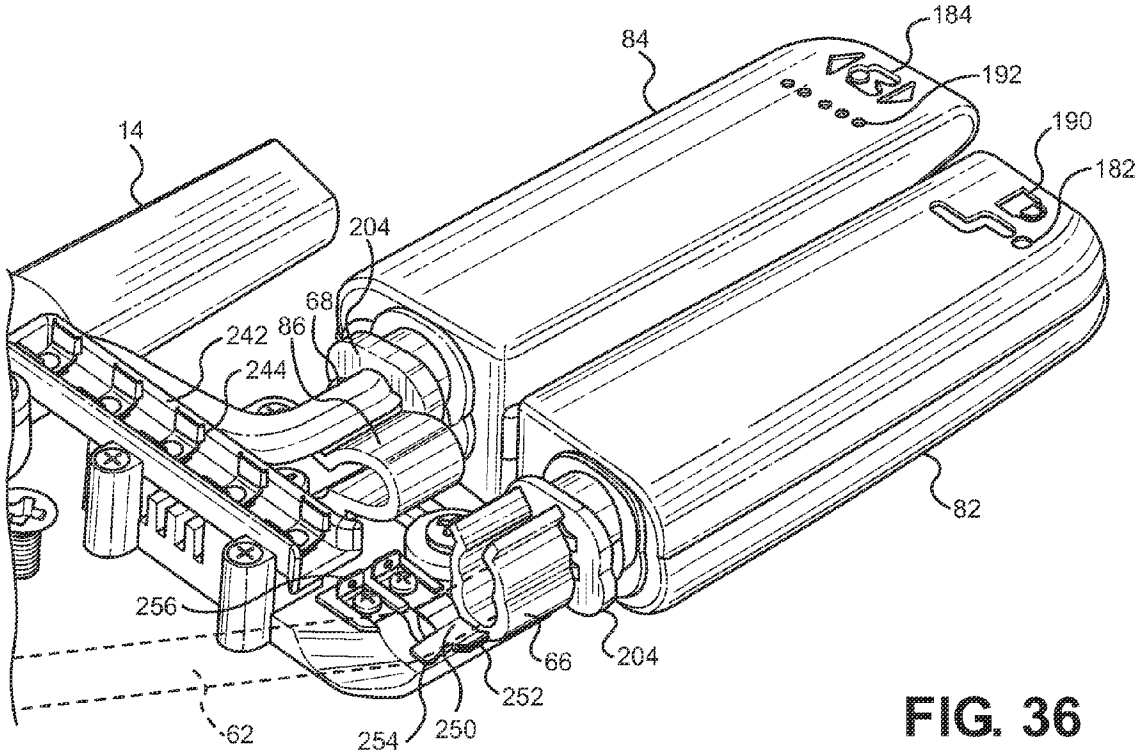
FIG. 36 is a is a partially exploded perspective view of a portion of a task chair control mechanism.

A better understanding of the structure and function of the handles 78, 80, 82, and 84 and the electronics that enable the visual indication of the settings of the adjustment mechanism can be had by combined reference to FIGS. 29 through 31, 39, and 40. In FIGS. 35 and 36, the seat depth adjustment handle 84, which is exemplary of the handles 78, 80, and 82, is shown to have an inner compartment 214 that can be selectively closed by a plate 206 in combination with fasteners 210. A passage 216 communicates from the compartment 214 to the proximal end of the handle 84. A coupling 204 with a flange and a through hole aligned with the passage 216 acts to retain the handle 84 relative to the housing 12. A wire guide 205 with a wire passage 218 can be received into the coupling 204 for guiding wiring 228 from wiring harnesses as shown in FIGS. 33 and 34.

Figure 39:
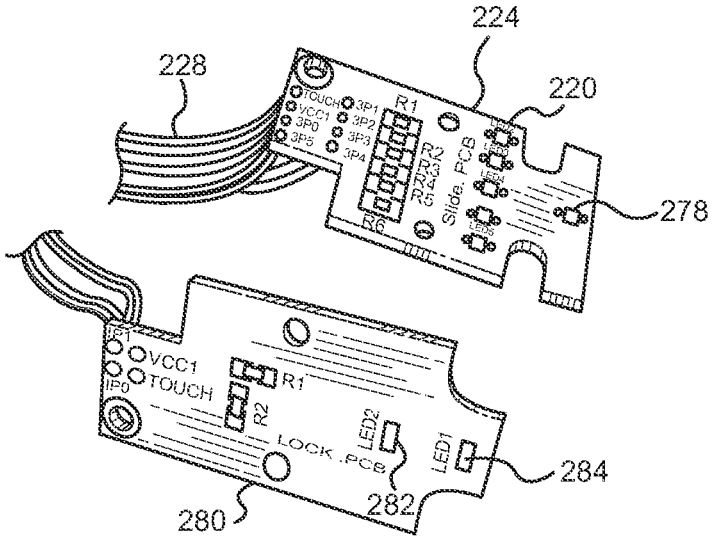
FIG. 39 is a perspective view of the control boards and wiring harnesses for the seat lock and seat slide handle controls.
Figure 40:
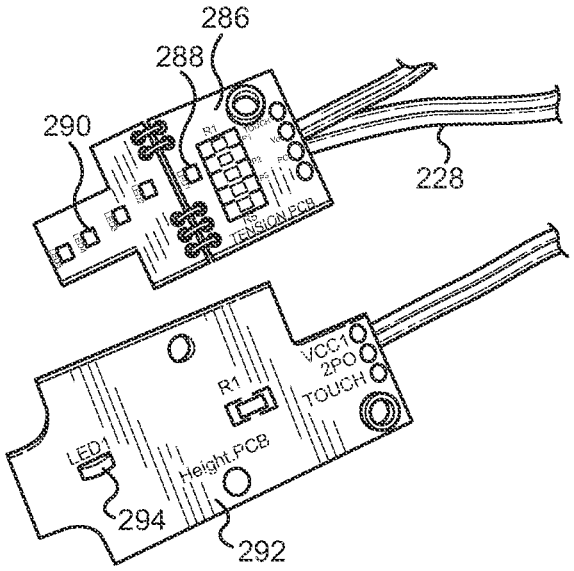
FIG. 40 is a perspective view of the control boards and wiring harnesses for the seat height and pivoting resistance handle controls.

When the handle 84 is assembled, the compartment 214 receives a circuit board 224, which is shown in FIG. 39. A wiring harness 228 extends from the circuit board 224, through the passages 216 and 218, and into the housing 12 for connection with a main circuit board 296 and the remaining electronic components. The circuit board 224 has a linearly aligned series of LED's 220 corresponding in number and disposition to the longitudinally aligned series of circles 192 in the handle 84. A further LED 278 is disposed to align with the icon 184.

Figure 31:
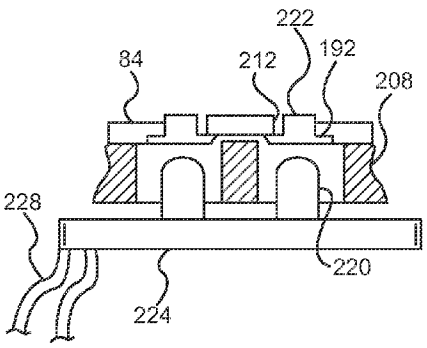
FIG. 31 is a cross-sectional view of a visual setting indicator lighting mechanism.
Figure 30:
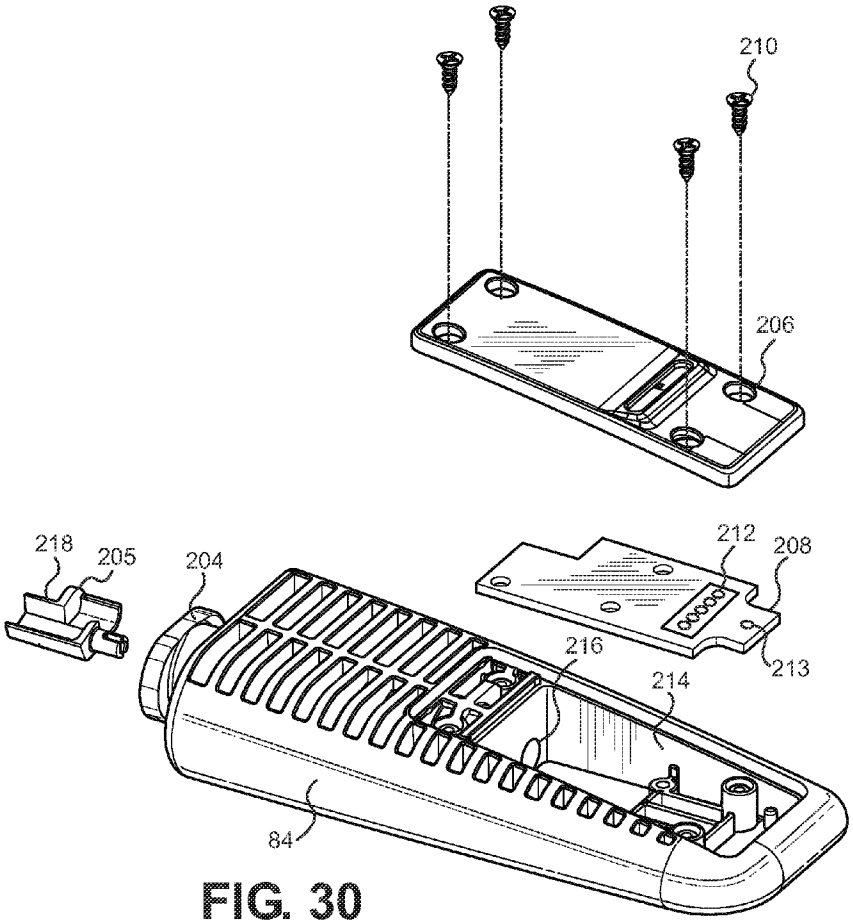
FIG. 30 is a lower exploded perspective view of the control handle with visual setting indicators of FIG. 29.

The icon 184 and the circles 192 are translucent for permitting light from the activated LED's 220 and 278 to be visually perceived. It would be possible for the icons 184 and 192 simply to comprise openings in the shell of the handle 84. In this embodiment, however, the icon 184 and the circles 192 are enclosed and protected by appropriately shaped translucent inserts 222 that are received into the openings formed by the icon 184 and the circles 192 as is shown in FIG. 31.

To prevent light from one LED 220 or 278 from being received through an aperture or circle 192 designated for another LED 220 or 278, the several LED's 220 and 278 can be isolated from one another, such as by an isolation pad 208 that has apertures 212 and 213 disposed to receive the corresponding LED's 220 and 278 therethrough. With this, adjacent LED's 220 and 278 are isolated from one another to ensure crisp and clear visualization of the setting of the adjustment arrangements as the LED 220 corresponding to the position of the seat 156 is activated while the remaining LED's 220 are not activated.

The remaining icons 178, 180, and 182 and setting indicators 186, 188, and 190 are similarly constructed. The resistance adjustment handle 78 retains a circuit board 286 that has a series of LED's 290 disposed to align with and selectively illuminate the individual setting indicator bars of the seat resistance setting indicator 186. The circuit board 286 additionally includes an LED 288 for illuminating the icon 178. The height adjustment handle 80 retains a circuit board 292 with an LED 294 disposed to illuminate the icon 180 and the indicator 188. Finally, the seat lock handle 82 retains a circuit board 280 with first and second LED's 282 and 284 for illuminating the icon 182 and the setting indicator 190.

Figure 41:
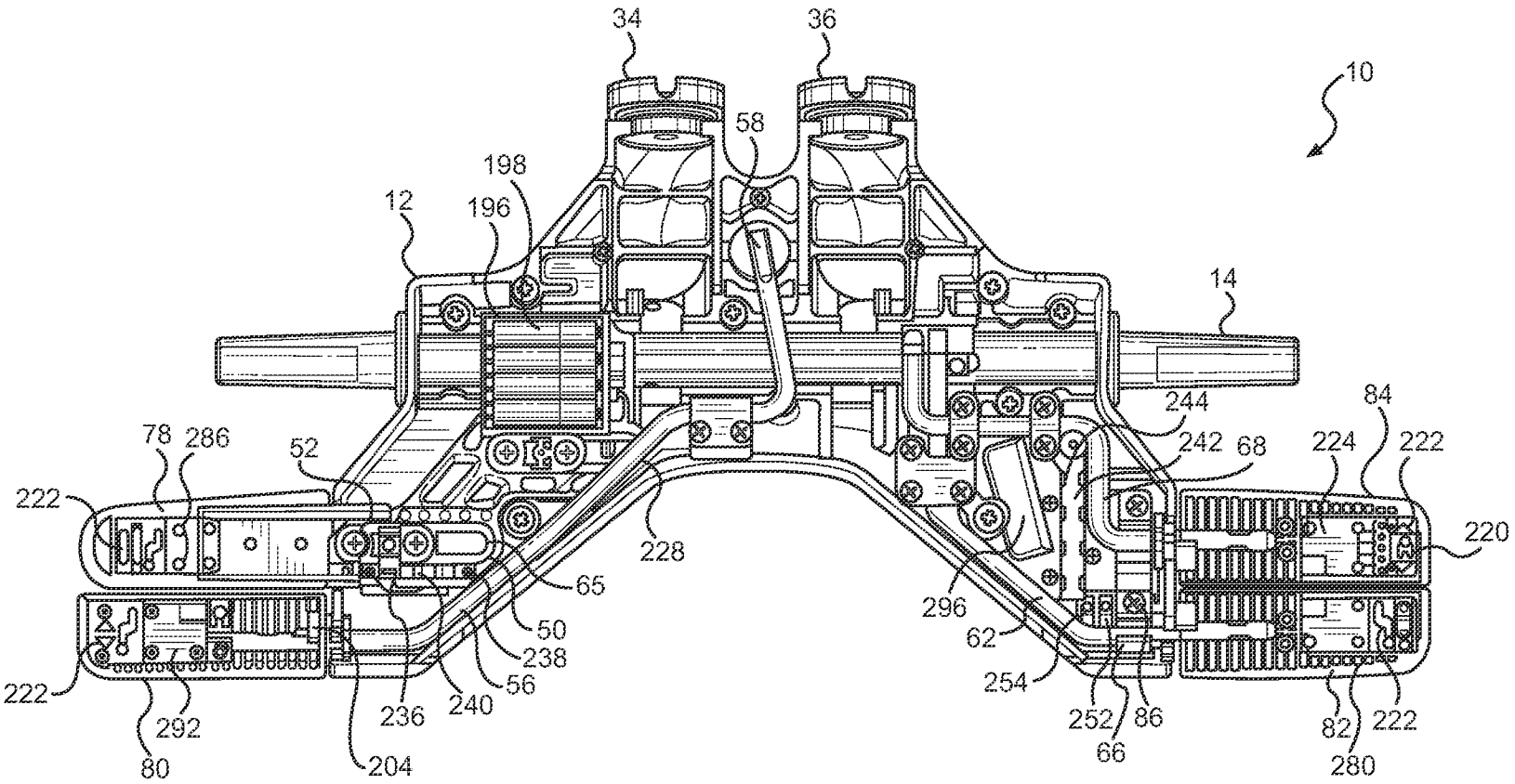
FIG. 41 is a top plan view of a task chair control mechanism as taught herein.

To permit the visual indication of the settings of the adjustment arrangement, it is necessary to provide sensors of each of the visually indicated adjustment settings. To that end regarding pivoting resistance, the chair control mechanism 10 is capable of sensing the resistance adjustment zone to which the locking slide 20 is disposed based on the positioning of the resistance adjustment handle 78 and the resistance adjustment arm 50. While a number of sensing means would be possible within the scope of the invention, the embodiment shown, for example, in FIGS. 34, 35, and 41 senses the positioning of the resistance adjustment arm 50 by use of an electrical contact 236 that is fixed to the slide block 52 extending outboard therefrom in combination with a positioning bar 238 with positioning indentations 240 disposed therealong corresponding to the several resistance zones. For each resistance adjustment position, an LED 290 corresponding to the positioning indentation 240 into which the electrical contact 236 is received is activated.

To permit the visual indication of the longitudinal position of the seat 156, the chair control mechanism 10 is also capable of sensing the longitudinal position of the seat 156 relative to the housing 12. Such sensing could be accomplished in a number of ways within the scope of the invention. With reference to FIGS. 35 through 42, the present embodiment achieves the sensing by a longitudinal channel 242 with a plurality of contacts 244 disposed therealong that are fixed in relation to the housing 12 in combination with a retaining fastener 246 and bushing 248 that project from the underside of the seat base 158 to be received into the channel 242. Under this arrangement, the fastener 246 and the bushing 248 can selectively contact one of the contacts 244 to provide an indication of the depth to which the seat 156 is set, and an LED 240 corresponding to that depth can be consequently activated to provide a visual indication of the setting.

Figure 42:
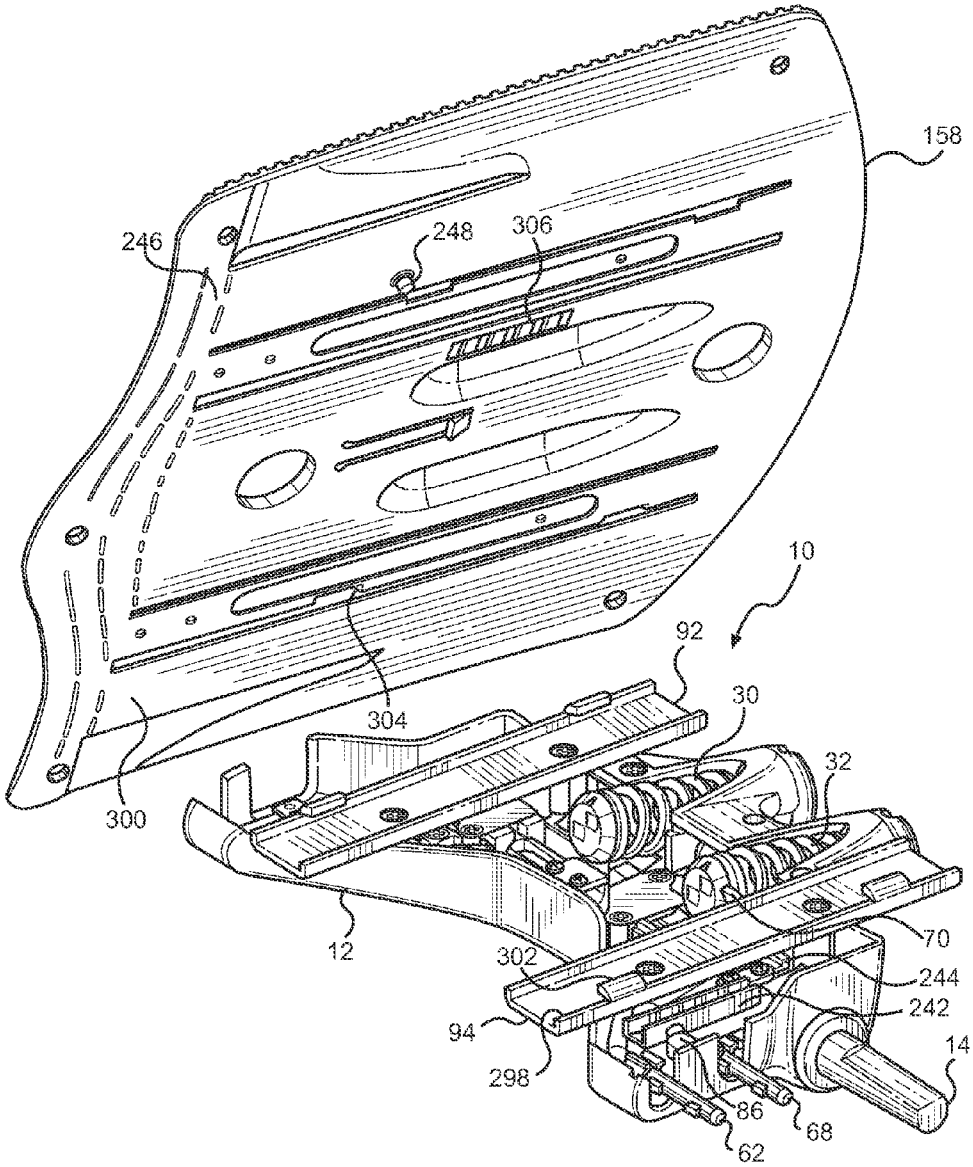
FIG. 42 is a perspective view of the task chair control mechanism with a seat bottom detached therefrom.

As perhaps best perceived by reference to FIG. 42, the slider brackets 92 and 94, which are fixed in parallel communicating longitudinally from front to back of the housing 12 and generally perpendicular to the shaft 14, have upstanding rails 298 for being slidably received into longitudinal channels 300 molded into the underside of the seat bottom 158. The outside rail 298 of each slider bracket 92 and 94 has two inwardly angled fingers 302 that are initially received through corresponding receiving openings 304 along the channels 300. Once the fingers 302 are slid out of alignment with the receiving openings 304, they operate to prevent the seat bottom 158 from inadvertently disengaging from the slider brackets 92 and 94.

Figure 37:
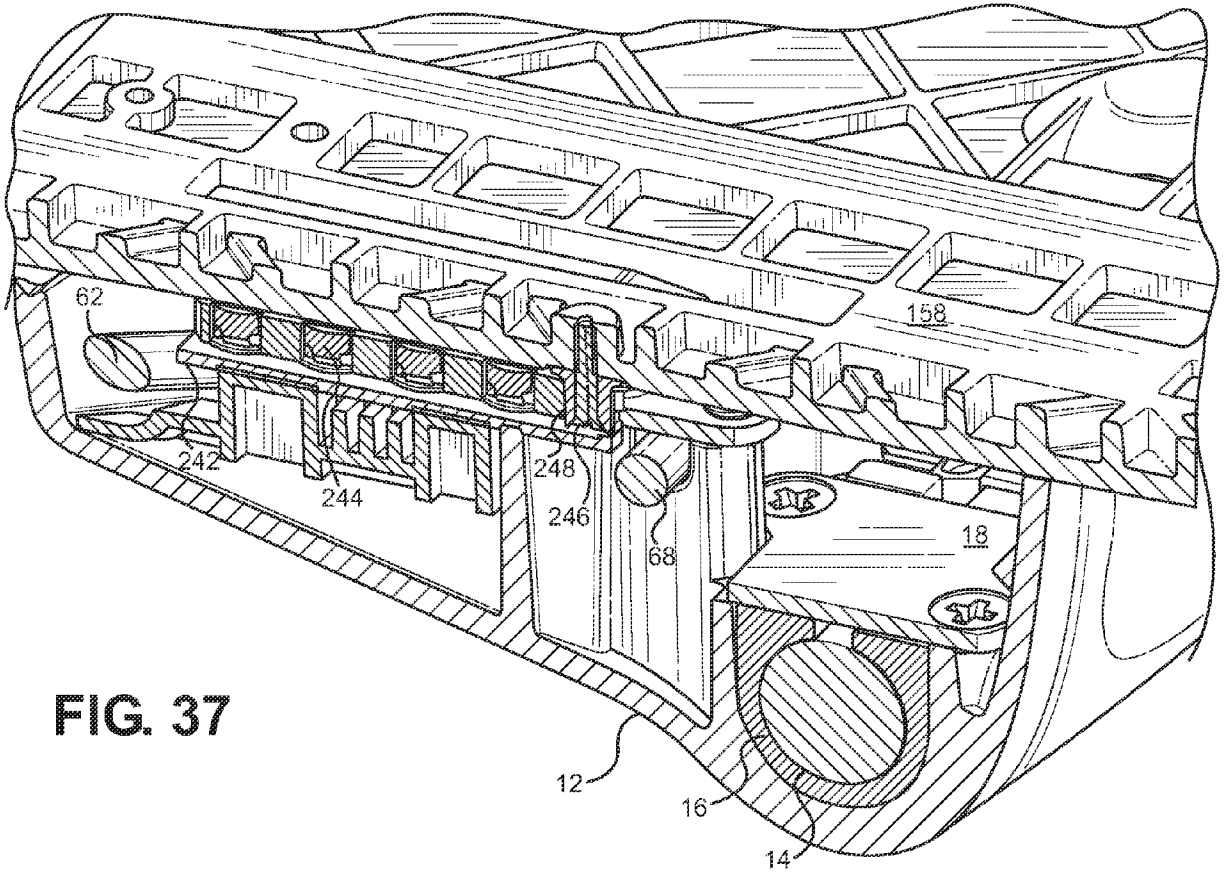
FIG. 37 is a cross-sectional view of a chair seat position sensing arrangement of the task chair control mechanism.

A series of longitudinally aligned notches 206 are molded into the underside of the seat bottom 158 for selectively receiving the locking tooth 70 of the locking lever 68 to lock the seat bottom 158 against forward and rearward sliding. The locking tooth 70, the notches 206, the bushing 248, and the contacts 244 are disposed in coordinated positions and spacing such that the bushing 248 will align with one sensor contact 244, and only one sensor contact 244, when the locking tooth 70 is received into a given notch 206. With this, the setting indicator 192 provides an accurate indication of the respective setting of the seat bottom 158 in relation to the slider brackets 92 and 94. To facilitate this preferred relationship, the center-to-center distance between the notches 206 is consistent and matches the consistent center-to-center distance between the sensor contacts 244. As a result, when the locking tooth 70 is received in the forward-most notch 206, the bushing 248 will be disposed to contact and actuate the forward-most sensor contact 244 as shown in FIG. 37. Accurate alignment of the bushing 248 with the remaining sensor contacts 244 is ensured. When the locking tooth 70 is not aligned with any notch 206, no sensor contact 244 and no setting indicator 192 will be actuated.

Advantageously, with the fastener 246 and bushing 248 together forming a projection from the seat base 158 and all of the sensing circuitry retained by the housing 12, the seat 156 can be readily separated from the housing 12 and the remainder of the mobile task chair 500 without any need to disconnect wiring and with substantially no risk of damage to the chair control mechanism 10. The seat 156 can thus be conveniently detached and removed, such as might be necessary for reupholstering or repair.

The locking setting of the seat 156 is sensed based on the position of the seat lock handle 82 and the locking lever 62. Under the exemplary embodiment shown, for example, in FIGS. 36 and 41, a locking of the seat 156 against tilting can be sensed based on an electrical connection of a contact 250 retained by the locking lever 62 in combination with first and second contacts 252 and 254 with leads 156 that are secured to the housing 12, potentially by use of a mounting plate. With this, the LED 284 is activated to indicate a locked setting when there is contact between the contacts 250, 252, and 254 and is not activated to indicate an unlocked setting when there is no contact between the contacts 250, 252, and 254. The lock lever 62 can be retained in each position by the mounting spring 66, which has proximal and distal broadened portions.

Figure 32:
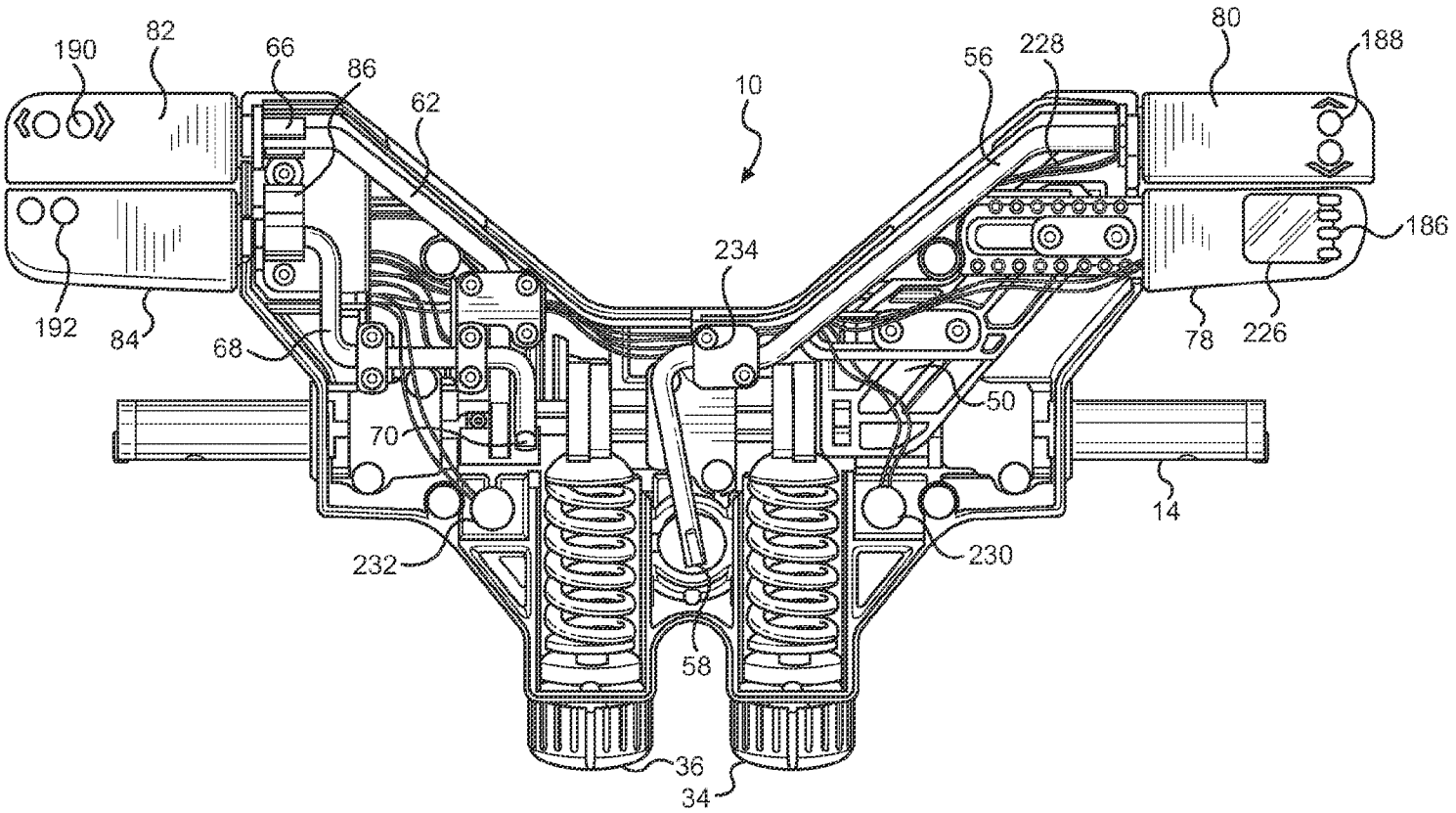
FIG. 32 is a top plan view of an alternative task chair control mechanism with visual setting indicators and adjustment arrangements as disclosed herein.

As shown in FIGS. 32 and 33, a sensor 234 could additionally be provided for sensing the disposition of the height adjustment lever 56 and thus whether it is actuating the actuator 90 of the piston 88. Under such a configuration, one or both arrows 188 could be illuminated to indicate the adjustment setting of the height adjustment lever 56 and the handle 80.

An alternative embodiment of the mobile task chair control mechanism 10 is shown in FIGS. 32 and 33. There, the chair control mechanism 10 additionally includes first and second weight sensors 230 and 232 that cooperate to enable a weight of a seat occupant to be determined. The chair control mechanism 10 additionally incorporates a display 226, which in this example is on the resistance adjustment handle 78, for displaying the weight of the occupant. In one example, the indicator 188 for the height adjustment handle 80 can have a convex bubble for indicating upward adjustment and a convex bubble for indicating downward adjustment.

The seat occupant can additionally input his or her preferences and, additionally or alternatively, information regarding the task at hand. The chair control mechanism 10 can provide a recommended resistance zone setting based on the sensed weight of the occupant, based on the task at hand, and based on the user's preferences. The recommended resistance setting can be compared to the current setting indicated by the seat resistance setting indicator 186. The occupant can thus adjust the pivoting resistance to suit his or her body and preferences with the guidance of the display 226 and the seat resistance setting indicator 186. The illumination for the resistance setting indicator 186 can achieve a second actuation condition, such as by turning green, when the recommended or desired setting is reached.

Figure 38:
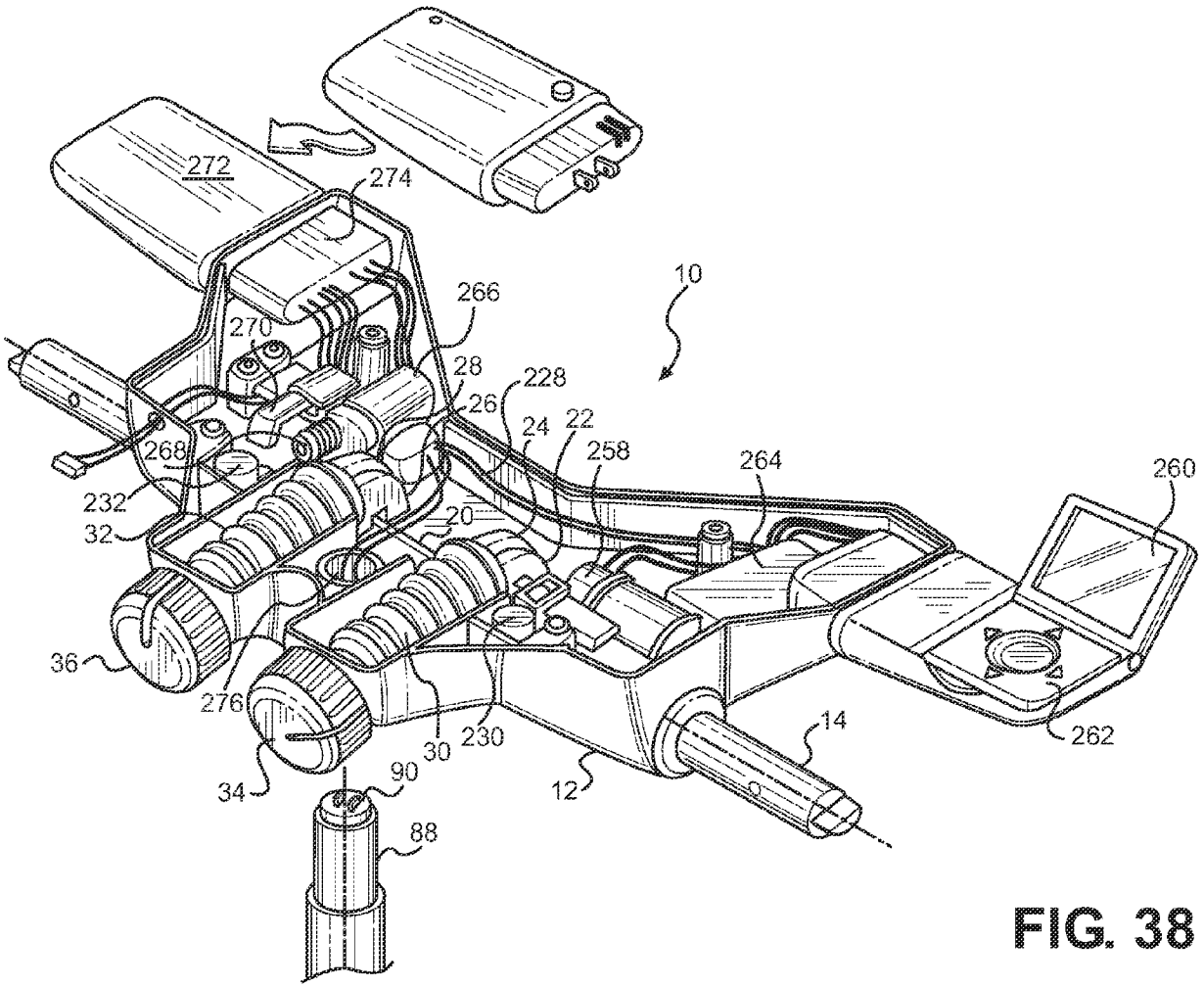
FIG. 38 is a perspective view of another task chair control mechanism pursuant to the invention.

A further embodiment of the chair control mechanism 10 is depicted in FIG. 38. There, the chair control mechanism 10 again enables control over and a visual indication of chair pivoting resistance settings, longitudinal seat depth settings, chair height adjustment settings, and chair pivoting lock settings. However, in the current embodiment, the adjustment of the several settings can be carried out in an automated manner under electric power, such as by a removable and replaceable rechargeable battery 272 that is received by a connector 274.

The chair control mechanism 10 has an interactive display screen 260 operated by touch and, additionally or alternatively, by a control pad 262. The display screen 260 and the control pad 262 cooperate with a control board 264 and setting sensors as described above to enable setting visualization and adjustment. The weight sensors 230 and 232 can sense an occupant's weight, and the display screen 260 can permit entry of selected data, including user body type, preferences, and task information.

Under control by the seat occupant through the control pad 262, the display screen 260 and the control board 264, a motor 258 can actuate movement of the locking slide 20 to adjust the resistance zone exhibited by the cams 22, 24, 26, and 28 and the compressible members 34 and 36. A motor 266 can actuate a worm gear 268 to adjust the depth of the seat 156, and a locking arm 270 can be selectively actuated to lock the seat back structure against pivoting. Still further, a height control actuator 276 can selectively actuate the actuator 90 of the piston arrangement 88 to permit the height of the mobile task chair 500 to be adjusted. The adjustments of the height, resistance, seat depth, and locking can be carried out under direct control from the seat occupant, automatically by the chair control mechanism 10, or by some combination thereof.

Indeed, it is possible for the chair control mechanism 10 to undergo automatic adjustments, which could be preliminary, immediately upon an occupant's sitting in the mobile task chair 500.

Figure 43:
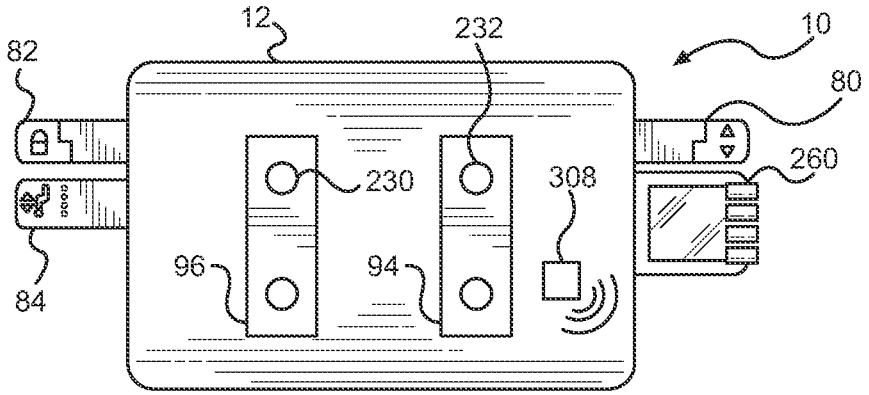
FIG. 43 is a top plan view of an alternative task chair control mechanism according to the invention.

An additional embodiment of the chair control mechanism 10 is shown in FIG. 43. The chair control mechanism 10 again enables control over chair settings and a visual indication thereof. Adjustment of the several settings can be carried out in an automated manner as described herein and, additionally or alternatively, manually by use of one or more handles 80, 82, and 84. The chair control mechanism 10 again exploits an interactive display screen 260, which is shown in a larger view in FIG. 44. The display screen 260 can be fixedly or removably retained by the housing 12 of the chair control mechanism 10. Where the display screen 260 is removable, a wireless transmitter 308 can send and receive sensed settings, control commands, seat occupant data, and other communications. The display screen 260 can be operated by touch or otherwise. Weight sensors 230 and 232 can sense the weight of the seat occupant, and sensors as described above can sense seat characteristics, such as pivoting resistance and seat position, for display on the display screen 260 and, additionally or alternatively, on the handles 80, 82, and 84.

The display screen 260 and setting sensors thus provide setting visualization and, potentially, setting adjustment capability. The display screen 260 can again permit entry of selected data, including user body type, preferences, and task information. Adjustments of the height, resistance, seat depth, and locking can be carried out under direct control from the seat occupant, automatically by the chair control mechanism 10, or by some combination thereof. The chair control mechanism 10 could automatically adjust, whether to preliminary settings or final settings, immediately upon an occupant's sitting in the mobile task chair 500 based, for example, on the sensed weight of the occupant, the task at hand, and user preferences.

Figure 44:
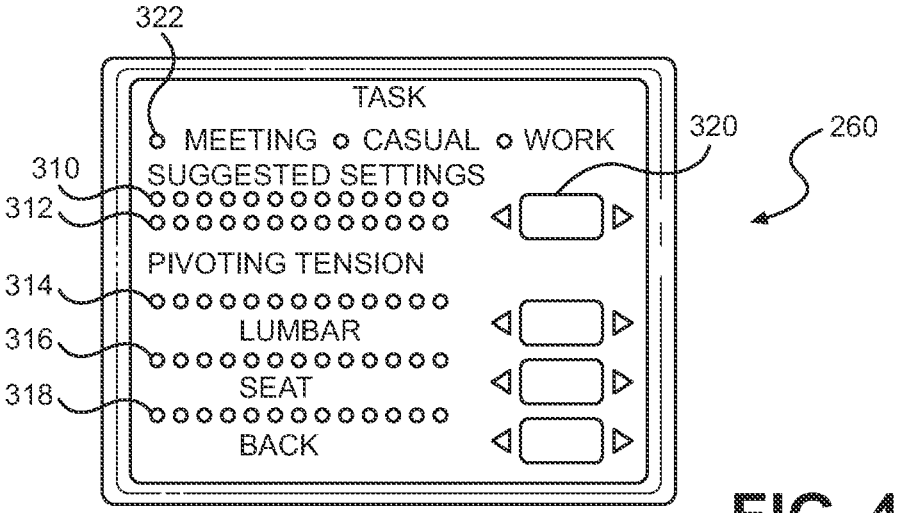
FIG. 44 is a top plan view of the control screen of the task chair control mechanism of FIG. 43.

As shown in FIG. 44, the display screen 260 provides an indication of the present seat setting for each sensed setting. By way of example and not limitation, the display screen 260 in FIG. 44 has an actual pivoting resistance indicator 312 for indicating the present pivoting resistance and a suggested pivoting resistance indicator 310 for indicating a suggested pivoting resistance, which can be based on the sensed weight of the occupant, the task at hand as selected by use of a task setting selection indicator 322, and any other relevant factor. The actual and suggested setting indicators could, for example, be a series of circles as shown, a continuous bar, or some other display. Using the task setting selection indicator 322, a seat occupant could select between a meeting setting, a casual setting, or a desk work setting, and the chair control mechanism 10 could adjust the suggested settings based on the selected task setting. Moreover, the display screen 260 can indicate actual and suggested settings for any other seat characteristic, including the lumbar tension setting 314, the seat tension setting 316, and the seat back tension setting 318. The actual settings can be adjusted by operation of a knob, switch, a handle, buttons 320, or any other effective means, including by touching or sliding one's finger to the desired circle or setting position.

Figure 45:
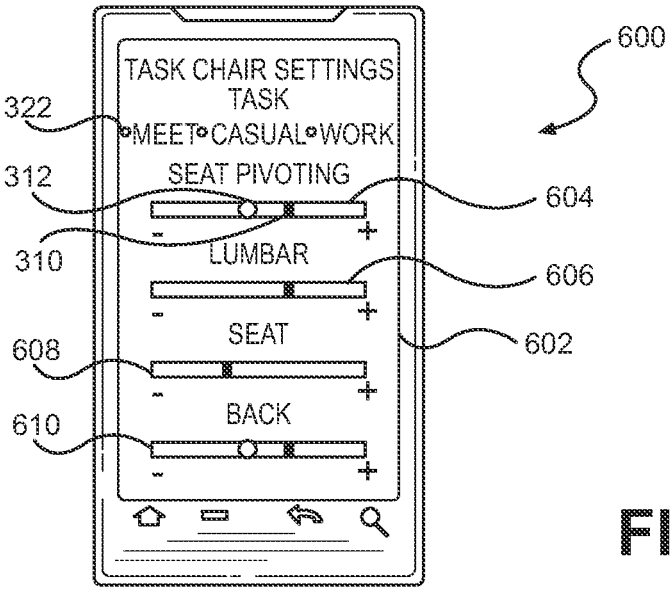
FIG. 45 is a top plan view of a smart phone operating a task chair setting application as disclosed herein.

In an even further variation of the invention, it is contemplated that the wireless transmitter 308 can send and receive sensed settings, control commands, seat occupant data, and other communications to a separate computing device, which could comprise a desk computer, a laptop computer, a wireless smart phone as indicated at 600, or any other computing device 600 running a dedicated task chair control and setting indication application program as depicted in FIG. 45. The control and setting indication program can provide on the display screen 602 a task setting selection indicator 322, a pivoting resistance indicator 604 with the actual setting 312 and the suggested setting 310, a lumbar tension setting indicator 606, a seat tension setting indicator 608, a back tension setting indicator 610, and indicators of any other characteristic. The smart phone application could have multiple pages and subpages, and a user could scroll or otherwise navigate through the application as desired. In each instance, the indicator 322, 604, 606, 608, and 610 can comprise an elongate bar as shown, a series of circles or other indicators, or any other means, and a user can perceive and potentially adjust the settings simply by touching the display screen 602. The user can match the suggested setting or choose his or her own setting.

Figure 46:
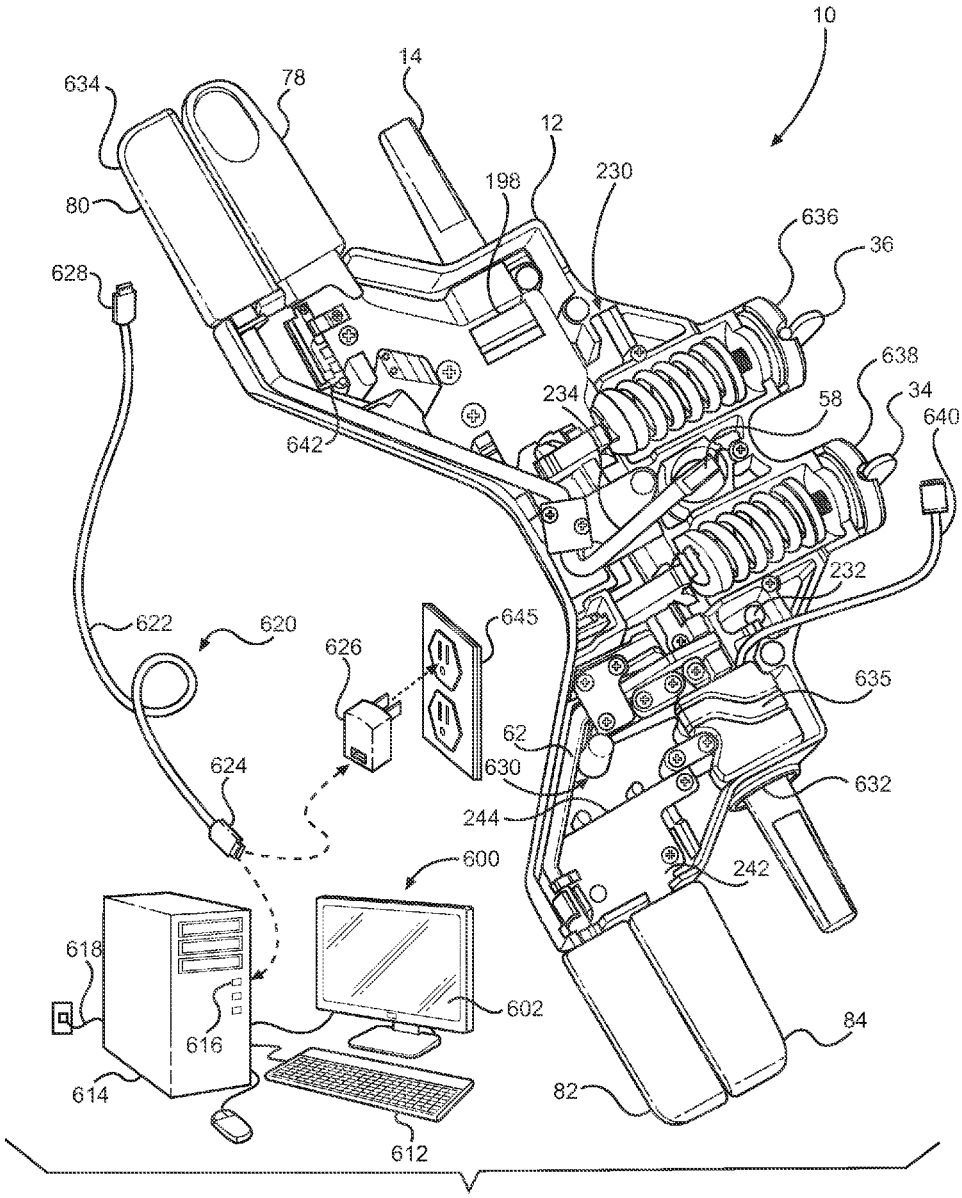
FIG. 46 is a top plan view of a task chair control mechanism with sensing, wireless communication, and power transfer capabilities as taught herein.
Figure 47:
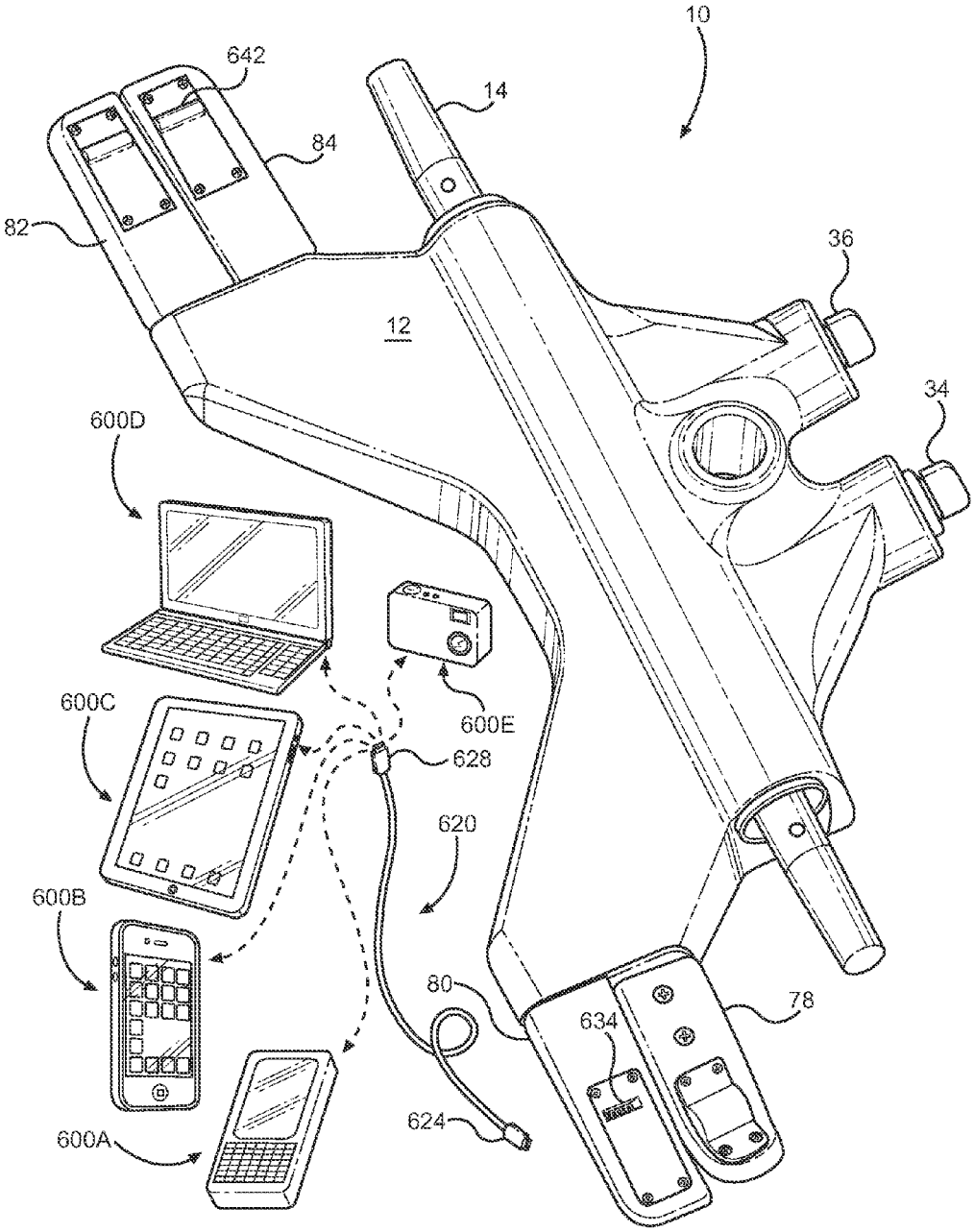
FIG. 47 is a bottom plan view of the task chair control mechanism of FIG. 46 illustrating power transfer capabilities relative to a variety of external devices.
Figure 48:
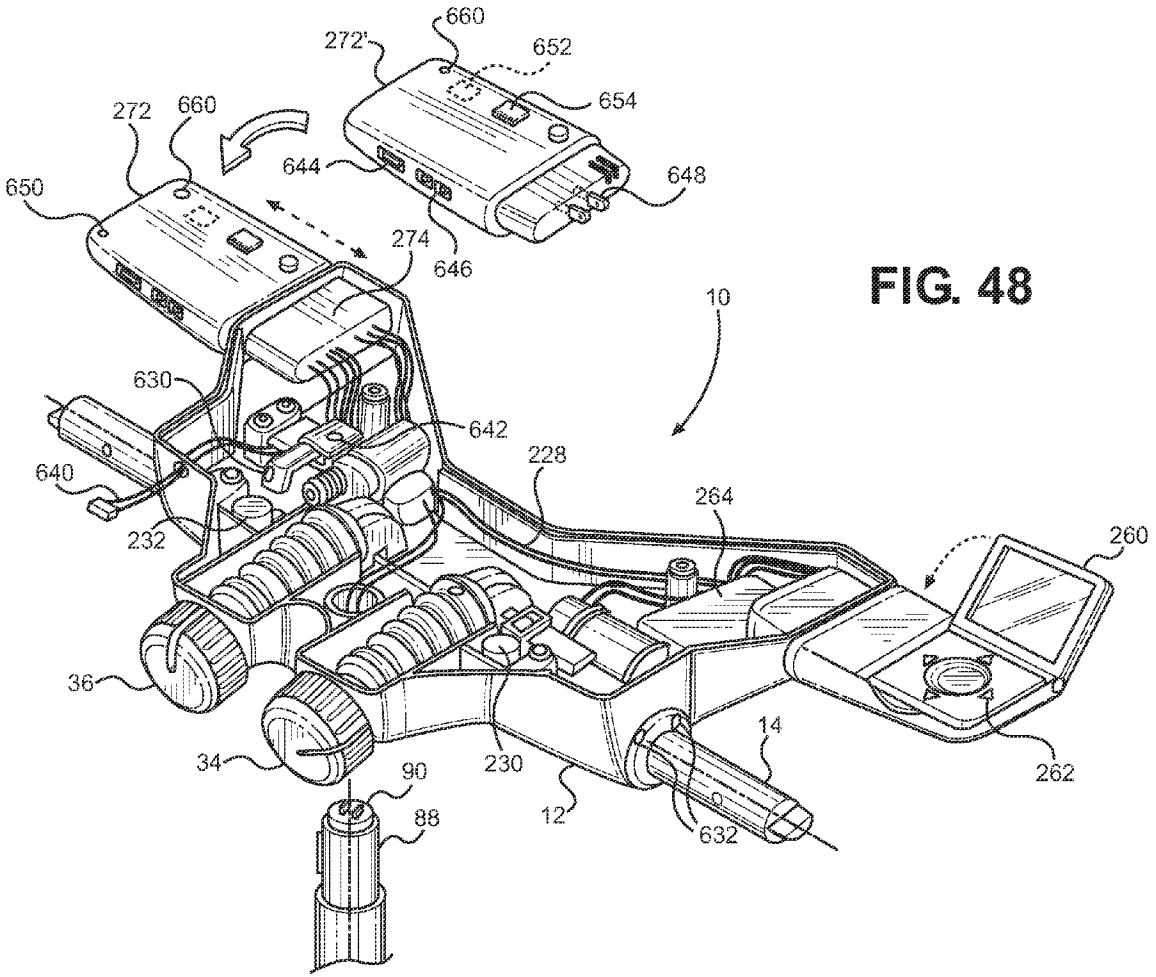
FIG. 48 is a perspective view of an alternative task chair control mechanism with power transfer and control capabilities as disclosed under the present invention.
Figure 49:
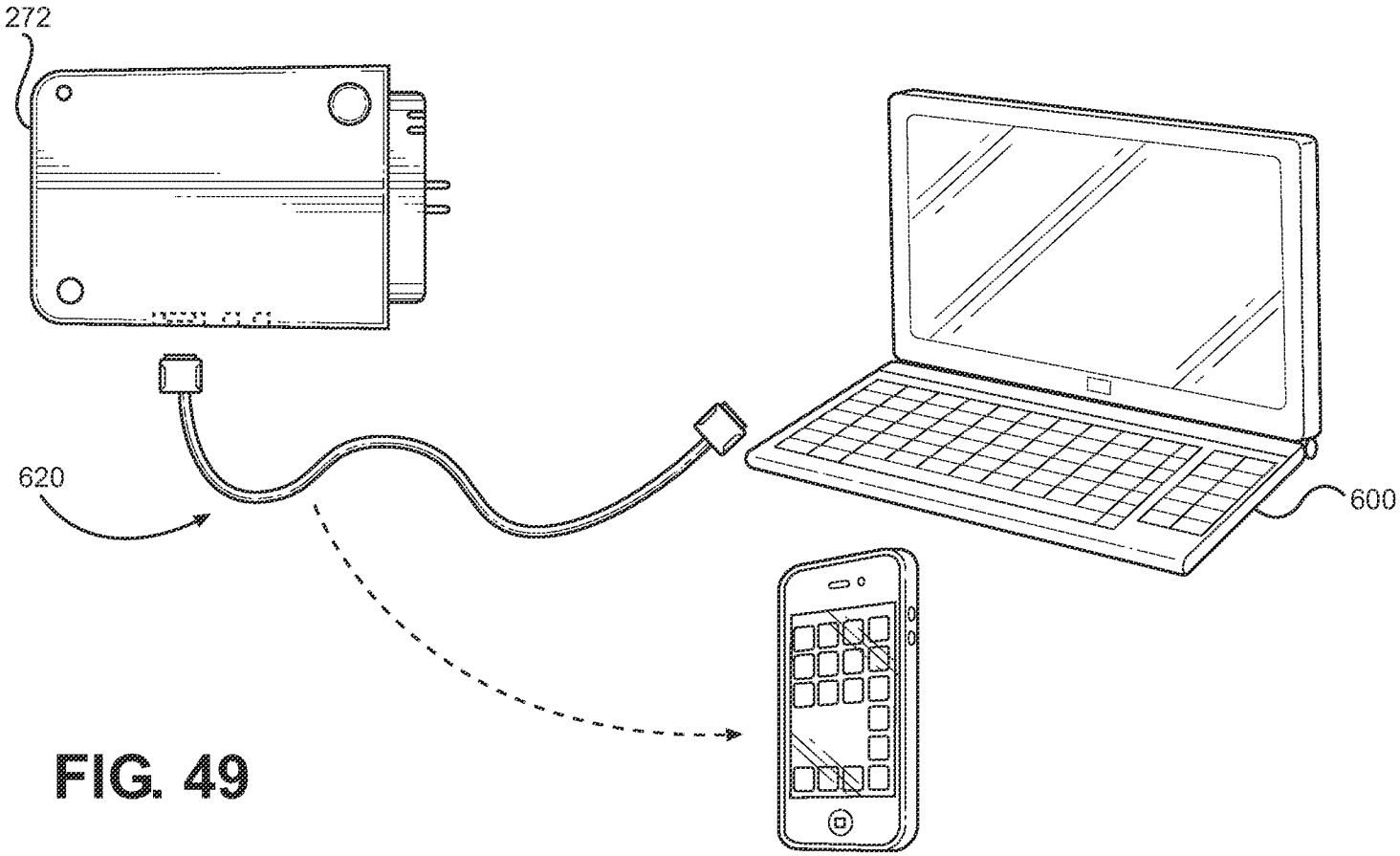
FIG. 49 is a perspective view of the portable power source as used to repower a computing device.
Figure 50:
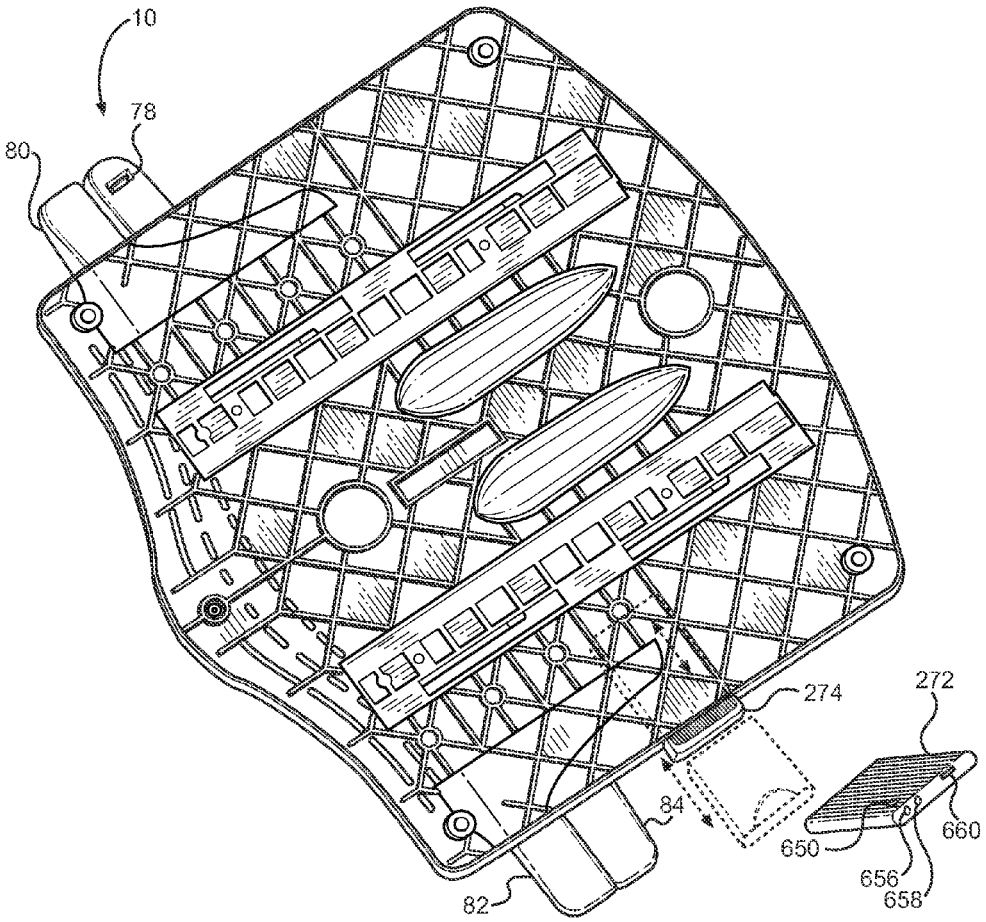
FIG. 50 is a top plan view of a seat pan retained relative to a task chair control mechanism according to the invention in conjunction with depictions of the control mechanism's power transfer, communication, and sensing capabilities.
Figure 51:
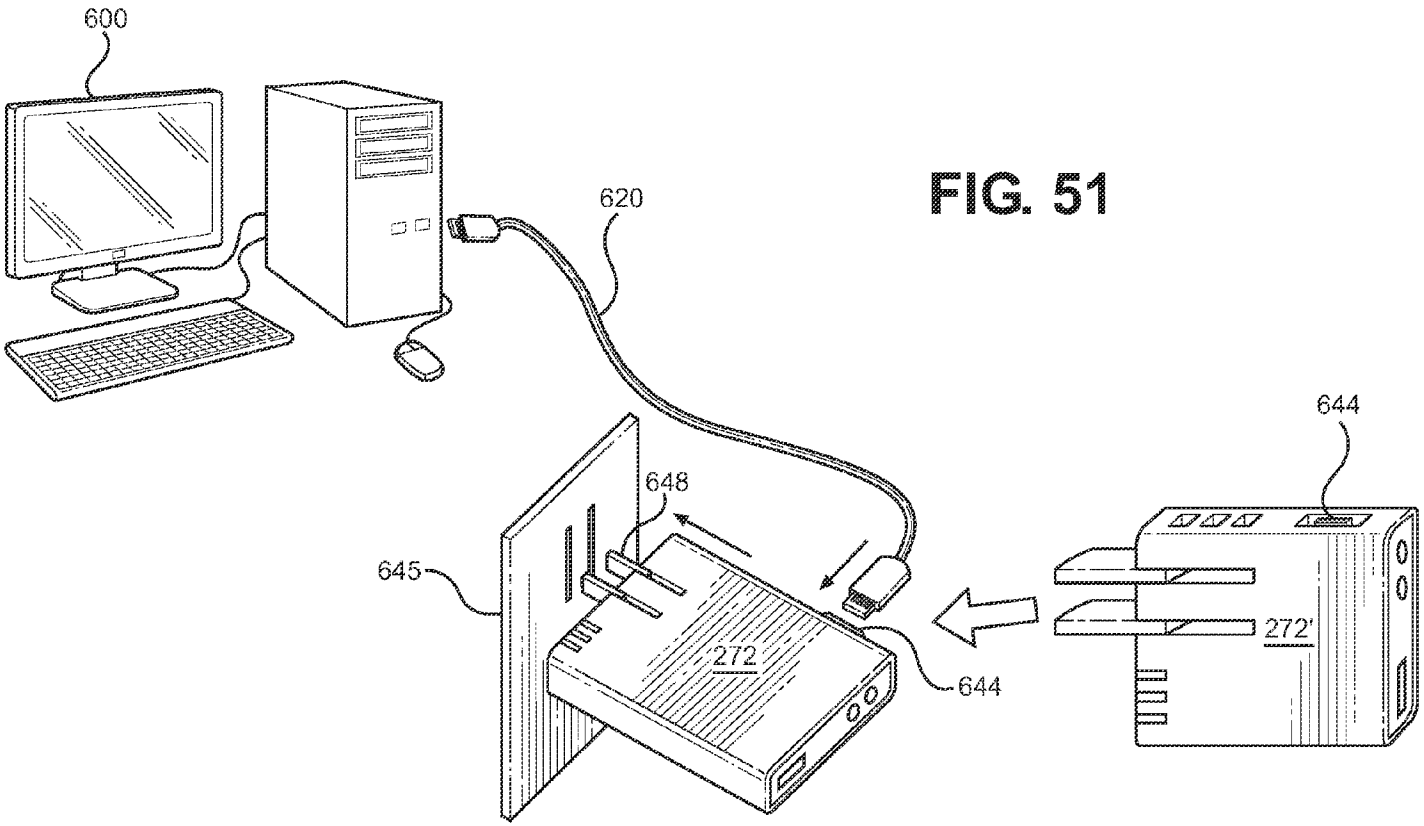
FIG. 51 is a perspective view of the portable power source positioned for recharging itself and for recharging a computing device.
Figure 52:
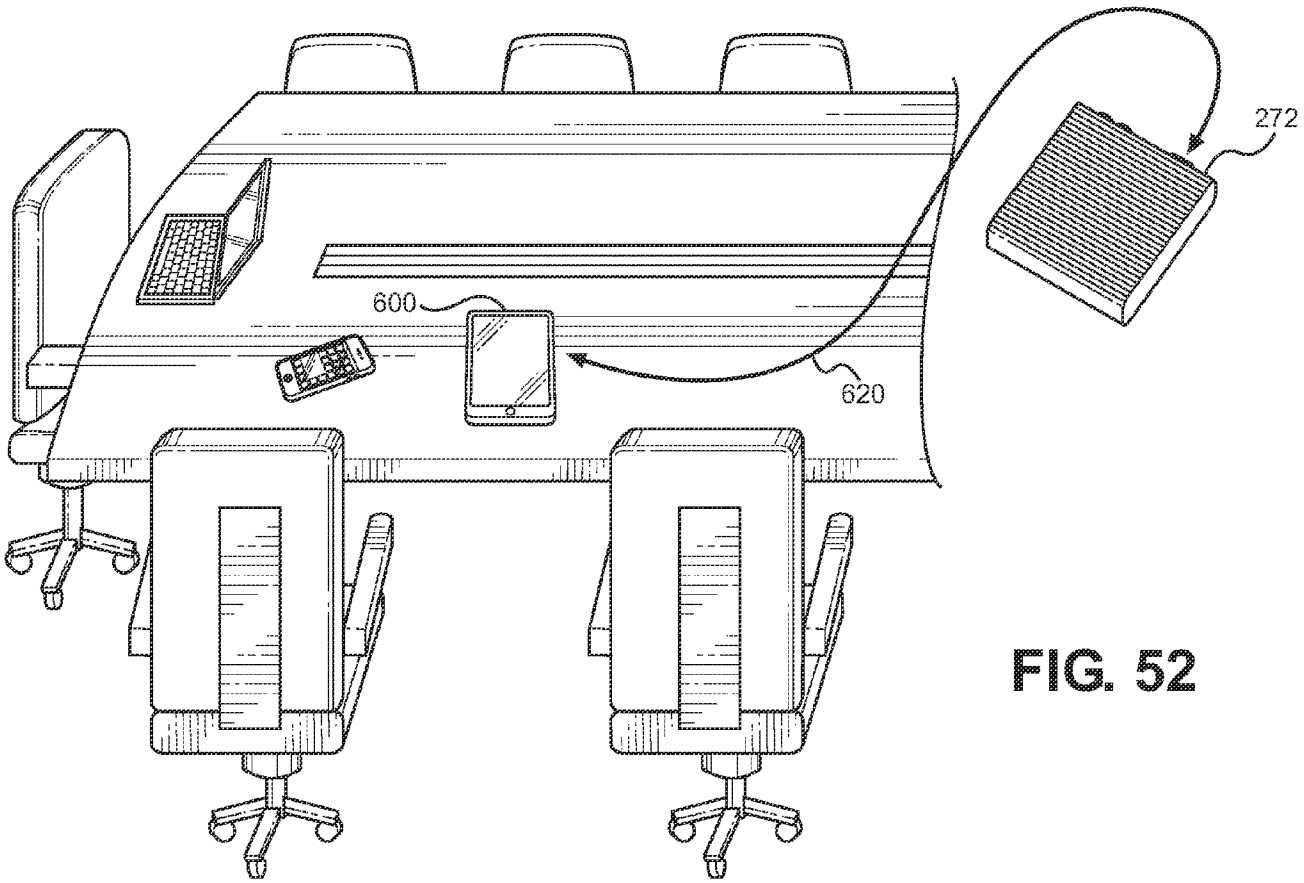
FIG. 52 is a perspective view of the portable power source positioned for recharging a portable computing device.
Figure 53:
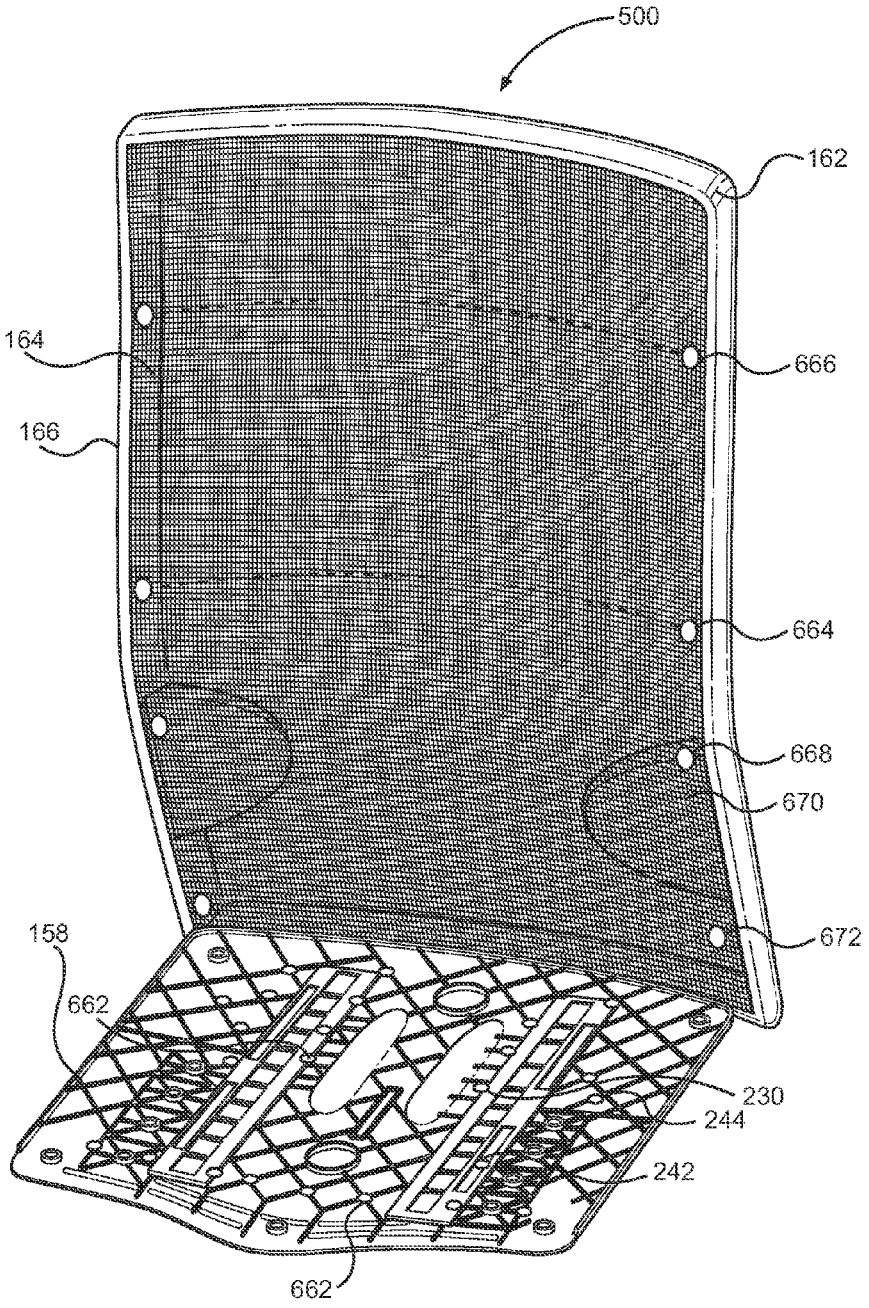
FIG. 53 is a perspective view of task chair back and bottom structures with sensors and adjustment capabilities as disclosed herein.

An understanding of the smart seating chairs with IC controls, electronic sensors, and wireless & power transfer capabilities disclosed herein can be better understood with reference to the following in conjunction with FIGS. 46 through 53. FIG. 46 comprises a top plan view of a task chair control mechanism 10 for a smart seating chair as shown and described previously with sensing, wireless communication, and power transfer capabilities. FIG. 47 provides a bottom plan view of the task chair control mechanism 10 of FIG. 46 illustrating power transfer capabilities relative to a variety of external devices. In FIG. 48, a perspective view is given of an alternative task chair control mechanism 10 with power transfer and control capabilities. In FIG. 49, a portable power source 272 as disclosed herein is prepared to be exploited to provide power to portable computing devices 600. Further, FIG. 50 is a top plan view of a seat base 158 retained relative to a task chair control mechanism 10 according to the invention. FIGS. 51 and 52 depict capabilities of the task chair control mechanism 10 for power transfer, communication, and sensing. Finally, FIG. 53 shows task chair back 162 and bottom 158 with sensors and adjustment capabilities as disclosed herein.

Looking further to FIG. 46, a task chair control mechanism 10 is depicted much as shown and described previously. However, the task chair control mechanism 10 incorporates a plurality of sensors for detecting setting, user, and usage characteristics. More particularly, a height adjustment sensor 234 detects the operation of the height adjustment lever 56, and left and right weight sensors 230 and 232 detect the weight and weight distribution on the smart seating chair incorporation the task chair control mechanism 10. Additionally, a seat recline angle sensor 632 detects the angle to which the seat back (not shown in this figure) is disposed. Moreover, the sensor channel 242 and the sensors 244 disposed thereabout cooperate to detect the depth of the seat bottom (not shown in this figure). Still further, a seat lock sensor 630 detects the locking position of the recline or locking lever 62. Electrical wiring 640 is provided for connecting to seat back sensors as described further below. A pivoting resistance sensor 642 detects the setting of the resistance adjustment handle 78 and thus the gross resistance provided by the task chair control mechanism 10, and personal resistance adjustment sensors 636 and 638 detect the fine resistance setting of the adjustment knobs 34 and 36.

Means are provided for permitting power and data transfer relative to the task chair control mechanism 10 whereby power can be transmitted to and from the mechanism 10 and data and commands can be imparted to and received from the task chair control mechanism 10. Multiple such means would be obvious to one skilled in the art after reading this disclosure. Each means, whether wired, wireless, or otherwise, is included within the scope of the invention except as it might be expressly limited. In the depicted example, of FIGS. 46 and 47, an electrical port 634, such as a USB port or any other type of electrical port, is disposed on the task chair control mechanism 10, such as within the top or bottom surfaces of one of the handles, the handle 80 being shown retaining the electrical port 634 in the drawings. Preferably, the port 634 will permit both power and data transfer bidirectionally, but it is possible to have multiple ports 634 accomplishing some or all transfer capabilities. An integrated circuit 635 or other electronic mechanism or mechanisms with operably associated wireless and Bluetooth communication and electronic memory permits data reception, retention, analysis, and transfer. Additionally, the control mechanism 10 can receive instructions remotely by wire or wirelessly for program updates, functionality, and user instructions.

As shown in FIG. 46, the electrical port 634 can permit an electrical connection of the task chair control mechanism 10 to a source of building power, such as an electrical outlet 645 through an electrical cord 620 that has a wiring portion 622, a first electrical coupling 628, such as a USB connector, and a second electrical coupling 624. The electrical port 634 produces electrical communication, whether through power transfer, data transfer, or both, between the control mechanism 10 and external devices 600. The second electrical coupling 624 can be selectively engaged with a wall plug adapter 626 for plugging into the electrical outlet 645 or with an electrical port 616, such as a USB port, disposed on a housing 614 of a computing device 600. The computing device 600 can receive electrical power through a power cord 628. Data transmitted to and from the task chair control mechanism 10 can be viewed on a display screen 602, and data and commands can be entered, edited, and transmitted for further processing by operation of a data entry mechanism 612, such as a keyboard.

As seen in FIG. 47 where an electrical port 634 is disposed along the lower surface of the handle 80, the electrical cord 620 can be exploited to transmit data and power to and from, by way of example and not limitation, portable telephones 600A, smart phones 600B, tablet computers 600C, laptop computers 600D, cameras 600E, and numerous other electronic devices beyond a traditional computer 600 as in FIG. 46. With that, data can be harvested from the task chair control mechanism 10. Moreover, where an electronic device is low on power or where the task chair control mechanism 10 is low on power, electrical power can be selectively transmitted to and from the task chair control mechanism 10. Also as shown in FIG. 47, a touch sensor switch 642 can be disposed along the bottom surface of each handle 78, 80, 82, and 84 whereby a user can induce the task chair control mechanism 10 into operation and illumination to provide visual indications as described previously merely by touching the switch 642.

As such, it will be appreciated that the port 634 can permit power and, potentially, data transfer to and from the power and data system of the task chair control mechanism 10. The port 634 or some other electrical interface can form part of a power platform for charging an internal battery of the control mechanism 10 or a portable batter power source 272 that may be fixedly or removably attached to the chair in some way as shown, for example, in FIG. 48. In addition to enabling a recharging of the power supply 272 of the control mechanism 10, the electrical interface ports 634 in FIGS. 46 and 47 and 644 and 646 in FIG. 48 provide the capability to use the power supply of the control mechanism 10 to recharge external devices, such as, but not limited to computers, laptops, tablets, phones, cameras, and other devices. Furthermore, the mechanism 10 provides the option of charging with a power cord 620 plugged into an AC wall outlet 645, potentially through an adaptor 626. In the depicted embodiment of FIG. 46, a high capacity lithium-ion battery 198 is located inside the control mechanism 10 to provide optional DC power.

Looking further to FIG. 48, the depicted task chair control mechanism 10 has a removable battery power source 272 and 272' as removed with a plug 648 for being plugged into a wall outlet 645 as necessary for recharging and other purposes. The power source 272 has an indicator LED 650 and an access switch 660. The power source 272 has an electrical port 644, such as a USB port, and mini data and electrical jacks 646. A wireless transmitter and potentially receiver unit 652 can permit wireless communications. The wireless unit 652 can be incorporated into the power source 272 and/or elsewhere in the control mechanism 10. The power source 272 can provide not only portable power to the chair but to other devices. As shown in FIGS. 47, 49, 51, and 52, for example, the power source 272 can provide portable power to a computer 600 or any other device that has a universal connection or an adaptor for providing an electrical connection through an electrical cord 620 or otherwise. With that, portable emergency charge power can be provided to various electronic devices 600. The power source 272 can simply be unplugged from the remainder of the control mechanism 10 as desired, such as for recharging through an electrical outlet 645, or for providing power to other devices 600 as in FIG. 49.

The control mechanism 10 can include internal memory 654, potentially coupled to the power source 272 or otherwise retained by the mechanism 10, for recording chair movement and seating and working habits. The acquired data can be processed and employed by the control mechanism 10 or by a computing device 600 in periodic or continuous communication therewith to perform automatic adjustments, to provide information to the user, and potentially to provide recommendations for settings, chair use, exercises, posture, and other matters. Data can be transferred wirelessly or by a direct connection to an external device 600, such as a computer, laptop, phone, or a remote location for further processing. The chair control mechanism 10 can additionally receive instruction by wire or wirelessly from remote locations with program updates, instructions, functions, and guidance.

The power platform formed by the power source 272, the memory 654, the wireless or wired transmission capabilities, and the remainder of the mechanism 10 can permit data transfer, whether wired or wirelessly, in relation to, for example, internet service and guidance and other applications that a furniture, internet, or other company can offer to its consumers using their product. For example, consumers using a given chair can log onto or be automatically connected to a dedicated website or application, whether via their computer, smart phone, or other electronic device. By way of example, the system can then provide heart advice, ergonomic personal seat advice, instructions, sales, marketing, connection to a doctor or other ergonomics specialist, or any other party that might provide advice and guidance regarding use of the chair, the chair itself, or the user him or herself. The control mechanism 10 and the accompanying data processing and communications abilities thus provide a command center with data input and output.

The portable battery power source 272, which plugs into the connector 274, or the power source 198 can take the form of one or more high capacity rechargeable lithium-ion or other battery types. The power sources 198 and 272 can be located, for example, in or on the seat, armrest, padding, the control mechanism, the back rest, or elsewhere. The power source 272 or 198 can power the chair LEDs, wireless, and other systems. The power source 272 or 298 can also act as additional power for the portable charging of other devices 600. Even further, as shown in FIG. 50, the portable power source 272 can incorporate a laser pointer 656, emergency light 658, and potentially other functionality. The power sources 198 and 272 can be charged directly from a wall outlet 645 or from an external device, such as a computing device 600 using one or more of the ports 634, 644, or 646.

As noted previously, the chair control mechanism 10 can have plural sensors for sensing seating performance settings and conditions. For example, the control mechanism 10 can include a seat slide position sensor, a power selection sensor, a seat lock sensor, weight sensors, lumbar sensors, lower lumbar compression sensor, back tension sensor, seat tension sensor, elastomeric material tension sensors, a height sensor, and personal tension selection sensors. Seat recline angle, seat height, and seat depth sensors can additionally be provided.

Through the back electronic connector 640 or another wired or wireless connection, electrical communication can be provided between a seat back 162 as shown in FIG. 53 and the chair control mechanism 10. As shown in FIG. 53, a chair 500 pursuant to the invention can have seat and back sensors with top, middle, and lower mesh or fabric tension and/or pressure sensors 666, 664, and 670, a lumbar height sensor 668, lower lumbar height sensors 672, weight sensors 230, seat slide sensors 242, and seating pressure or weight pattern sensors 662. The data obtained by these sensors can be transmitted to a memory device 654 for storage. Additionally or alternatively, the data can be selectively or automatically transmitted to an external recipient, such as a computer server, through a wired or wireless connection.

With certain details and embodiments of Smart Seating Chairs with IC Controls, Electronic Sensors, and Wireless & Power Transfer Capabilities 10 according to the present invention disclosed, it will be appreciated by one skilled in the art that changes and additions could be made thereto without deviating from the spirit or scope of the invention. This is particularly true when one bears in mind that the presently preferred embodiments merely exemplify the broader invention revealed herein. Accordingly, it will be clear that those with certain major features of the invention in mind could craft embodiments that incorporate those major features while not incorporating all of the features included in the preferred embodiments.

Therefore, the following claims are intended to define the scope of protection to be afforded to the inventor. Those claims shall be deemed to include equivalent constructions insofar as they do not depart from the spirit and scope of the invention. It must be further noted that a plurality of the following claims may express certain elements as means for performing a specific function, at times without the recital of structure or material. As the law demands, these claims shall be construed to cover not only the corresponding structure and material expressly described in this specification but also all equivalents thereof that might be now known or hereafter discovered.

I claim as deserving the protection of Letters Patent:

1. A mobile task chair with a control mechanism, the mobile task chair comprising:
- a mobile base structure;
- a seat bottom structure supported by the base structure;
- a seat back structure supported by the base structure;
- a control mechanism supported by the base structure;
- a power source electrically coupled to the control mechanism;
- an electrical sensor for sensing a seat characteristic of the mobile task chair wherein the sensor for sensing a seat characteristic comprises a pivoting resistance sensor operative to sense a pivoting resistance of the mobile task chair; and
- means for suggesting and displaying a suggested seat characteristic to a user wherein the means for suggesting and displaying a suggested seat characteristic suggests and displays a suggested pivoting resistance of the mobile task chair based at least in part on a weight of a seat occupant.

2. The mobile task chair with a control mechanism of claim 1 further comprising at least one electrical port in electrical communication with the control mechanism and wherein the at least one electrical port permits power and data transfer bidirectionally whereby the at least one electrical port can be employed to provide power to external electronic devices.

3. The mobile task chair with a control mechanism of claim 1 further comprising a wireless transmitter for producing electrical communication relative to the control mechanism.

4. The mobile task chair with a control mechanism of claim 1 further comprising a seat back recline angle sensor.

5. The mobile task chair with a control mechanism of claim 1 further comprising a weight sensor.

6. The mobile task chair with a control mechanism of claim 1 further comprising a seat depth sensor.

7. The mobile task chair with a control mechanism of claim 1 further comprising a sensor of at least one of fabric tension and pressure.

8. The mobile task chair with a control mechanism of claim 1 further comprising means for automatically adjusting a seat characteristic of the mobile task chair to an adjusted seat characteristic wherein the means for automatically adjusting a seat characteristic of the mobile task chair to an adjusted seat characteristic adjusts the seat characteristic based on a task selected by a user.

9. The mobile task chair with a control mechanism of claim 1 further comprising means for automatically adjusting a seat characteristic of the mobile task chair to an adjusted seat characteristic comprising the suggested pivoting resistance.

10. The mobile task chair with a control mechanism of claim 9 wherein the suggested pivoting resistance is further based on a task selected by a user.

11. The mobile task chair with a control mechanism of claim 1 wherein the suggested pivoting resistance comprises a suggested pivoting resistance of the seat back structure.

12. A mobile task chair with a control mechanism, the mobile task chair comprising:
- a mobile base structure;
- a seat bottom structure supported by the base structure;
- a seat back structure supported by the base structure;
- a control mechanism supported by the base structure;
- a power source electrically coupled to the control mechanism;
- an electrical sensor for sensing a seat characteristic of the mobile task chair wherein the sensor for sensing a seat characteristic comprises a pivoting resistance sensor operative to sense a pivoting resistance of the mobile task chair; and
- means for suggesting and displaying a suggested seat characteristic to a user wherein the means for suggesting and displaying a suggested seat characteristic suggests and displays a suggested pivoting resistance of the mobile task chair based at least in part on a task selected by a user.

13. The mobile task chair with a control mechanism of claim 12 further comprising means for automatically adjusting a seat characteristic of the mobile task chair to an adjusted seat characteristic comprising the suggested pivoting resistance.

14. The mobile task chair with a control mechanism of claim 13 wherein the suggested pivoting resistance is further based on a weight of a seat occupant.

15. The mobile task chair with a control mechanism of claim 12 wherein the suggested pivoting resistance comprises a suggested pivoting resistance of the seat back structure.

16. A mobile task chair with a control mechanism, the mobile task chair comprising:

a mobile base structure;

a seat bottom structure supported by the base structure;

a seat back structure supported by the base structure;

a control mechanism supported by the base structure;

a power source electrically coupled to the control mechanism;

an electrical sensor for sensing a seat characteristic of the mobile task chair wherein the sensor for sensing a seat characteristic comprises a pivoting resistance sensor operative to sense a pivoting resistance of the mobile task chair;

an electrical sensor for sensing a seat characteristic of the mobile task chair wherein the sensor for sensing a seat characteristic comprises a seat back recline angle sensor operative to sense a seat back recline angle;

means for suggesting and displaying a suggested seat characteristic to a user; and electronic memory for retaining data from the pivoting resistance sensor and the seat back recline angle sensor;

wherein the means for suggesting and displaying a suggested seat characteristic suggests and displays a suggested pivoting resistance of the mobile task chair based at least in part on retained data from the pivoting resistance sensor and the seat back recline angle sensor.

17. The mobile task chair with a control mechanism of claim 16 wherein the suggested pivoting resistance includes a gross resistance setting and a fine resistance setting.

18. The mobile task chair with a control mechanism of claim 16 further comprising means for automatically adjusting a seat characteristic of the mobile task chair to an adjusted seat characteristic comprising the suggested pivoting resistance.

19. The mobile task chair with a control mechanism of claim 18 wherein the suggested pivoting resistance is further based on a task selected by a user.

20. The mobile task chair with a control mechanism of claim 18 wherein the suggested pivoting resistance is further based on a weight of a seat occupant.

21. The mobile task chair with a control mechanism of claim 16 wherein the suggested pivoting resistance comprises a suggested pivoting resistance of the seat back structure.

* * * * *